US007363673B2

(12) United States Patent
Schonewille et al.

(10) Patent No.: US 7,363,673 B2
(45) Date of Patent: Apr. 29, 2008

(54) HAND HELD SCRUBBING TOOL

(75) Inventors: Todd Alan Schonewille, Athens (CA); Richard Peter Rosa, Kingston (CA); Sean David Wilkinson, Brockville (CA); Corey Donald MacTavish, Ottawa (CA); Jacob Richard Prosper, Brockville (CA); James Douglas Marshall, Mallorytown (CA); Oleksiy Petrovych Sergyeyenko, Brockville (CA); Vincent P. Cooper, Baltimore, MD (US); David Michael Shaver, Brockville (CA); Patrick Marcil, Ottawa (CA)

(73) Assignee: Black & Decker Inc., Newark, DE (US)

( * ) Notice: Subject to any disclaimer, the term of this patent is extended or adjusted under 35 U.S.C. 154(b) by 604 days.

(21) Appl. No.: 10/778,016

(22) Filed: Feb. 12, 2004

(65) Prior Publication Data

US 2004/0255410 A1 Dec. 23, 2004

Related U.S. Application Data

(60) Provisional application No. 60/532,958, filed on Dec. 29, 2003, provisional application No. 60/477,240, filed on Feb. 13, 2003, provisional application No. 60/447,232, filed on Feb. 13, 2003, provisional application No. 60/447,141, filed on Feb. 13, 2003, provisional application No. 60/447,113, filed on Feb. 13, 2003, provisional application No. 60/447,100, filed on Feb. 13, 2003.

(51) Int. Cl.
*A46B 13/04* (2006.01)

(52) U.S. Cl. ..... 15/29

(58) Field of Classification Search ..... 15/24, 15/29

See application file for complete search history.

(56) References Cited

U.S. PATENT DOCUMENTS

| | | | | |
|---|---|---|---|---|
| 1,952,910 A * | 3/1934 | Decker | 15/29 |
| 3,343,192 A | 9/1967 | Goldstein et al. | |
| 3,396,417 A | 8/1968 | Starr | |
| 3,443,272 A | 5/1969 | Trelc et al. | |
| 3,447,178 A | 6/1969 | Pickering | |
| 3,892,004 A | 7/1975 | Downes | |
| 3,943,591 A * | 3/1976 | Lanusse | 15/29 |

(Continued)

FOREIGN PATENT DOCUMENTS

DE DD 32 872 11/1964

(Continued)

OTHER PUBLICATIONS

Moulinex S.A. 2 Rue de l'Industrie, F-14123 Cormelles Le Royal "Electric apparatus for cleaning shoes".

(Continued)

*Primary Examiner*—Mark Spisich
(74) *Attorney, Agent, or Firm*—Harness, Dickey & Pierce, P.L.C.

(57) ABSTRACT

A hand-held motorized household cleaning apparatus that includes a housing, a battery located in the housing, a motor located in the housing and connected to the battery, an output drive shaft connected to the motor, a cleaning attachment coupled for movement with the output drive shaft and a liquid delivery system with a pressurized reservoir. A flexible adapter is also provided.

21 Claims, 33 Drawing Sheets

U.S. PATENT DOCUMENTS

| | | | | |
|---|---|---|---|---|
| 3,977,084 | A | | 8/1976 | Sloan |
| 4,060,870 | A | | 12/1977 | Cannarella |
| 4,129,257 | A | | 12/1978 | Eggert |
| 4,168,560 | A | * | 9/1979 | Doyel ..... 15/29 |
| 4,168,650 | A | | 9/1979 | Doyel |
| 4,748,998 | A | | 6/1988 | Färber et al. |
| 4,780,992 | A | * | 11/1988 | McKervey ..... 451/354 |
| 4,782,982 | A | | 11/1988 | Ellison |
| 4,792,066 | A | | 12/1988 | Kobayashi |
| 4,930,664 | A | | 6/1990 | Ellison |
| 4,930,686 | A | | 6/1990 | Ellison |
| 4,932,094 | A | | 6/1990 | McCowin |
| 4,964,398 | A | | 10/1990 | Jones |
| 5,208,933 | A | * | 5/1993 | Lustig et al. ..... 15/22.1 |
| 5,289,605 | A | | 3/1994 | Armbruster |
| 5,301,381 | A | | 4/1994 | Klupt |
| 5,309,594 | A | * | 5/1994 | Thompson ..... 15/97.1 |
| 5,333,337 | A | * | 8/1994 | Markley ..... 15/29 |
| 5,353,461 | A | | 10/1994 | Enriquez |
| 5,375,740 | A | | 12/1994 | Umetsu et al. |
| 5,394,584 | A | | 3/1995 | Breitschmid |
| 5,423,102 | A | | 6/1995 | Madison |
| 5,500,972 | A | | 3/1996 | Foster |
| 5,634,572 | A | | 6/1997 | Lane, Jr. et al. |
| 5,680,666 | A | | 10/1997 | Ra |
| 5,697,115 | A | | 12/1997 | Sciarra et al. |
| 5,700,146 | A | * | 12/1997 | Kucar ..... 433/82 |
| 5,701,625 | A | | 12/1997 | Siman |
| 5,718,014 | A | | 2/1998 | deBlois et al. |
| 5,775,539 | A | | 7/1998 | Bates et al. |
| 5,784,744 | A | | 7/1998 | Toran |
| 5,870,790 | A | | 2/1999 | Root et al. |
| D413,445 | S | | 9/1999 | deBlois et al. |
| 5,956,792 | A | | 9/1999 | Gutelius et al. |
| 5,960,503 | A | | 10/1999 | Del Pozo Y Mattei |
| 5,978,999 | A | | 11/1999 | deBlois et al. |
| 6,026,993 | A | | 2/2000 | Sperna Weiland |
| 6,031,969 | A | | 2/2000 | Burr et al. |
| 6,058,542 | A | | 5/2000 | Lo |
| 6,134,738 | A | | 10/2000 | Weber et al. |
| 6,170,108 | B1 | * | 1/2001 | Knight ..... 15/29 |
| 6,248,007 | B1 | | 6/2001 | deBlois et al. |
| 6,253,405 | B1 | | 7/2001 | Gutelius et al. |
| 6,292,971 | B1 | | 9/2001 | Chaudray |
| 6,502,766 | B1 | | 1/2003 | Streutker et al. |
| 6,554,614 | B1 | | 4/2003 | Dubbe et al. |
| 6,752,330 | B2 | | 6/2004 | DiMaggio et al. |
| 2002/0011531 | A1 | | 1/2002 | DiMaggio et al. |
| 2002/0074362 | A1 | | 6/2002 | Py et al. |
| 2003/0042330 | A1 | | 3/2003 | Streutker et al. |
| 2003/0052194 | A1 | | 3/2003 | Streutker et al. |
| 2004/0010876 | A1 | | 1/2004 | Kraemer |
| 2004/0074025 | A1 | | 4/2004 | Blaustein et al. |

FOREIGN PATENT DOCUMENTS

| | | |
|---|---|---|
| DE | 1 962 595 | 6/1967 |
| DE | GM 74 31 959 | 3/1975 |
| DE | P 23 46 677.5 | 5/1980 |
| DE | 87 10 130 | 6/1988 |
| DE | P 39 12 655.2 | 11/1989 |
| DE | P 42 26 928.8 | 2/1994 |
| DE | 35 10 107 | 1/1996 |
| DE | 202 14 940 | 3/2004 |
| EP | 0 275 218 | 1/1988 |
| EP | 0 847 713 | 11/1997 |
| EP | 0 905 038 | 9/1998 |
| WO | 01/96088 | 6/2001 |
| WO | 02/089632 | 2/2002 |
| WO | 2004/035268 | 10/2003 |
| WO | 02/07897 | 7/2004 |

OTHER PUBLICATIONS

Print out of a cleaning and polishing device. www.oami.eu.int/bulletin/2004/2004_012/000089008_0003.htm.
Black & Decker Household Products catalog p. 59.
Black & Decker Parts List for Scubber.

* cited by examiner

HAND HELD SCRUBBING TOOL

CROSS-REFERENCE TO RELATED APPLICATIONS

This application claims the benefit of U.S. Provisional Application Ser. No. 60/532,958 entitled Hand Held Scrubbing Tool, filed Dec. 29, 2003, U.S. Provisional Patent Application Ser. No. 60/447,240 entitled Hand-Held Cleaning Apparatus, filed Feb. 13, 2003, U.S. Provisional Patent Application Ser. No. 60/447,232 entitled Hand-Held Motorized Cleaning Apparatus With Integral Fluid Reservoir and Method of Constructing Same, filed Feb. 13, 2003, U.S. Provisional Patent Application Ser. No. 60/447,100 entitled Hand-Held Motorized Cleaning Apparatus With Extended Reach Capabilities, filed Feb. 13, 2003, U.S. Provisional Patent Application Ser. No. 60/447,141 entitled Cleaning Tool For Use With A Hand-Held Motorized Cleaning Apparatus, filed Feb. 13, 2003, and U.S. Provisional Patent Application Ser. No. 60/447,113 entitled Hand-Held Motorized Cleaning Apparatus And Caddy Therefor, filed Feb. 13, 2003.

INTRODUCTION

The present invention generally relates hand-held motorized cleaning apparatuses.

Hand-held mechanized cleaning tools are known in the art and commonly employ a single tool head, such as a brush, accessory or the like, that are rotated or reciprocated to scrub dirt and other materials from a work surface. While known tool heads generally perform adequately on a given type of surface, such as a relatively large surface, they are often times limited in their use for other types of cleaning and/or are generally susceptible to improvement. Accordingly, there is a need in the art for an improved hand-held mechanized cleaning tool.

SUMMARY

In one form, the present teachings provide a hand-held motorized household cleaning apparatus that includes a housing, a battery located in the housing, a motor located in the housing and connected to the battery, an output drive shaft connected to the motor, a cleaning attachment coupled for movement with the output drive shaft and a liquid delivery system. The liquid delivery system includes a reservoir, a nozzle, a valve and at least one fluid conduit. The reservoir is coupled to the housing and is operable for storing a pressurized fluid therein. The nozzle is coupled to the housing. The valve is at least partially housed in the housing and operable for selectively permitting the fluid to be dispensed through the fluid conduit between the reservoir and the nozzle.

In another form, the present teachings provide a hand-held motorized household cleaning apparatus with a housing, a battery located in the housing, a motor located in the housing and connected to the battery, an output drive shaft driven by the motor and being rotatable about a shaft axis, a cleaning attachment that is rotatable about an attachment axis, and a flexible adapter that may be selectively interposed between the output drive shaft and the cleaning attachment. The flexible adapter has a first drive end, which is configured to releasably engage the output drive shaft, and a second drive end, which is configured to releasably engage the cleaning attachment. The flexible adapter permits rotation of the cleaning attachment between a first position, wherein the attachment axis is generally coincident with the shaft axis, and a second position, wherein the attachment axis and the shaft axis are arranged in an oblique condition.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE VARIOUS EMBODIMENTS

Figure 1:
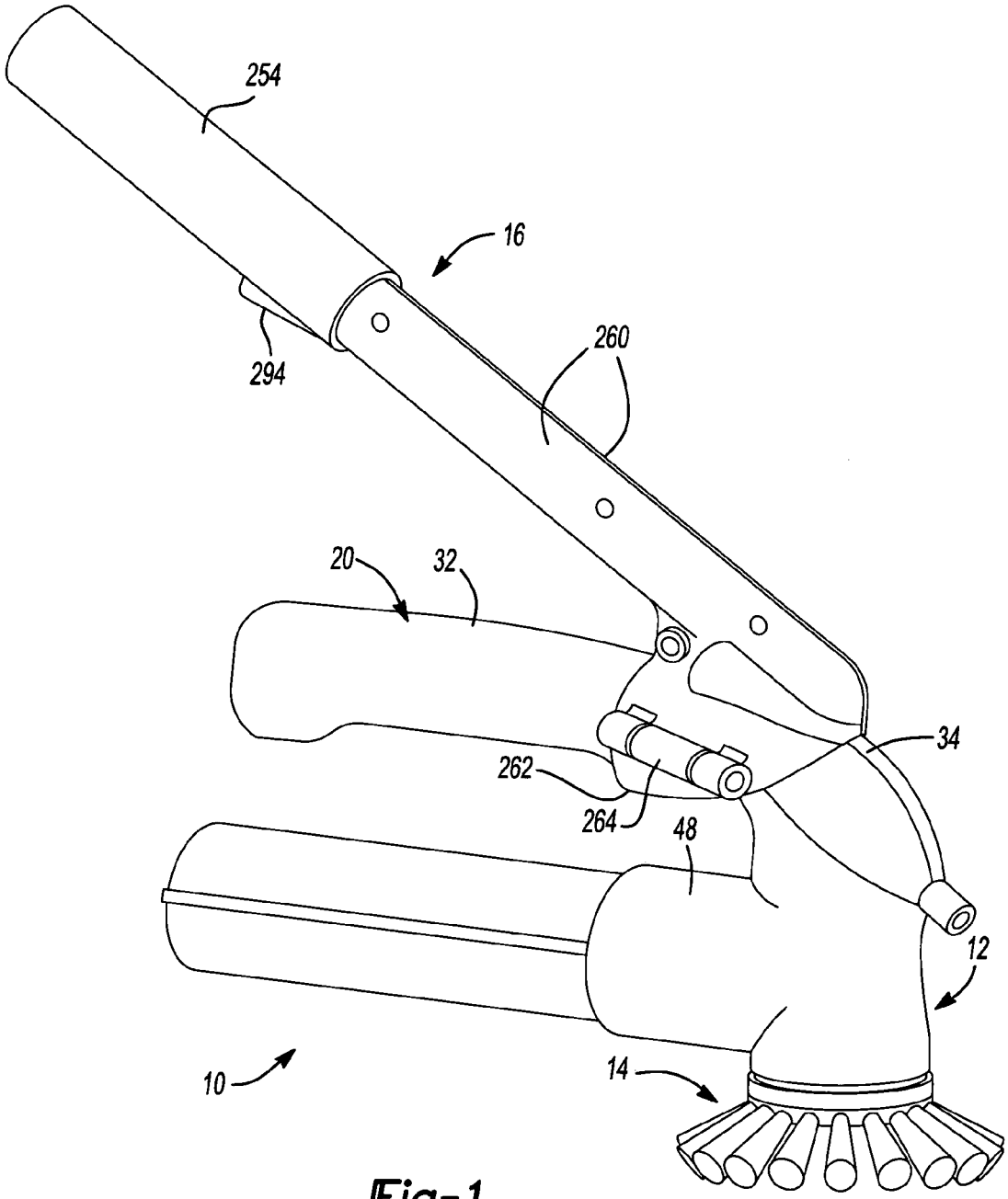
FIG. 1 is a perspective view of a hand-held motorized cleaning apparatus constructed in accordance with the teachings of the present invention.
Figure 2:
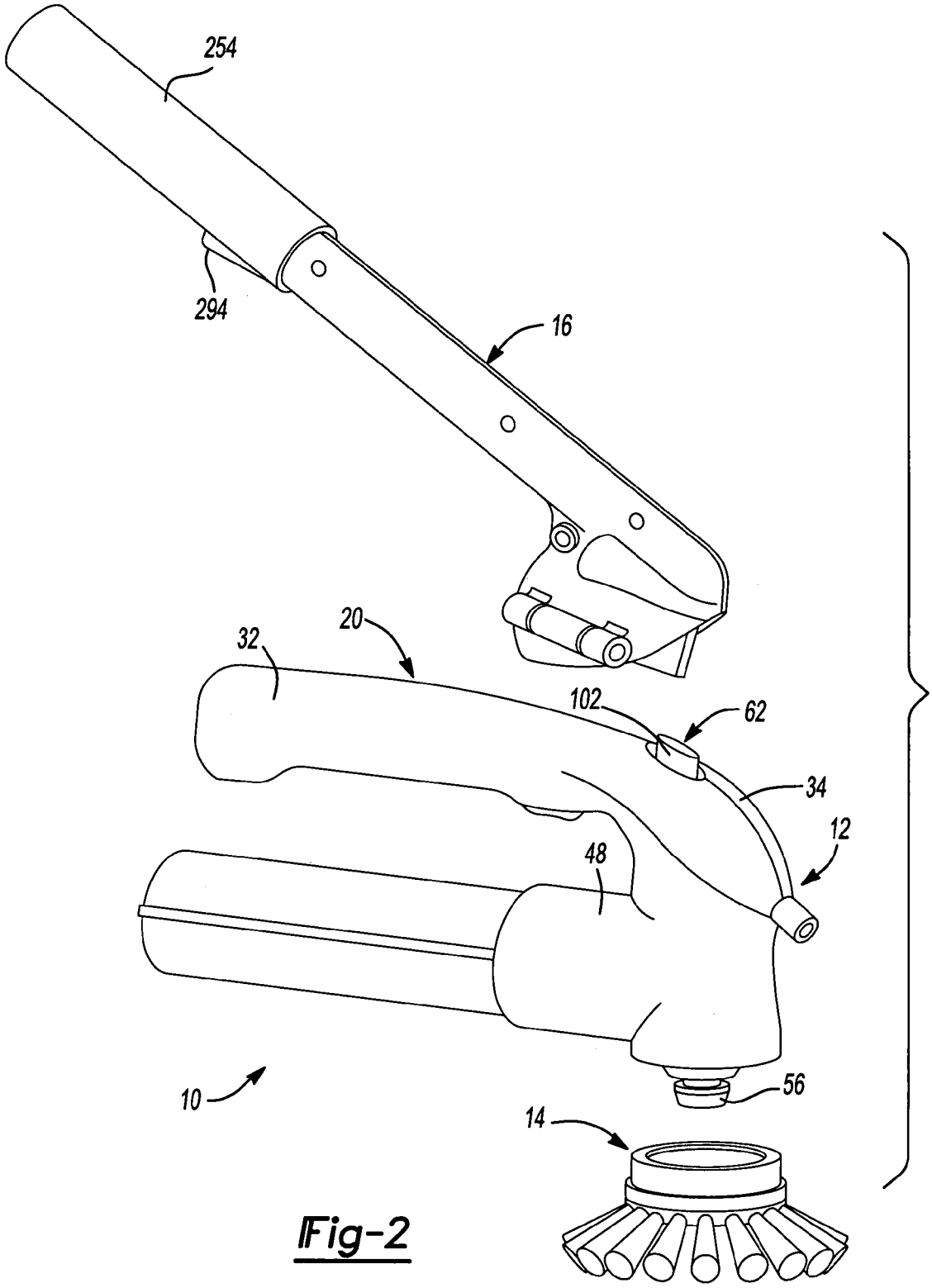
FIG. 2 is an exploded perspective view of the cleaning apparatus of FIG. 1.

With reference to FIGS. 1 and 2 of the drawings, a hand-held motorized cleaning apparatus constructed in accordance with the teachings of the present invention is generally indicated by reference numeral 10. The cleaning apparatus 10 may include a main body 12, a removable head 14 and a removable extension handle 16.

Figure 3:
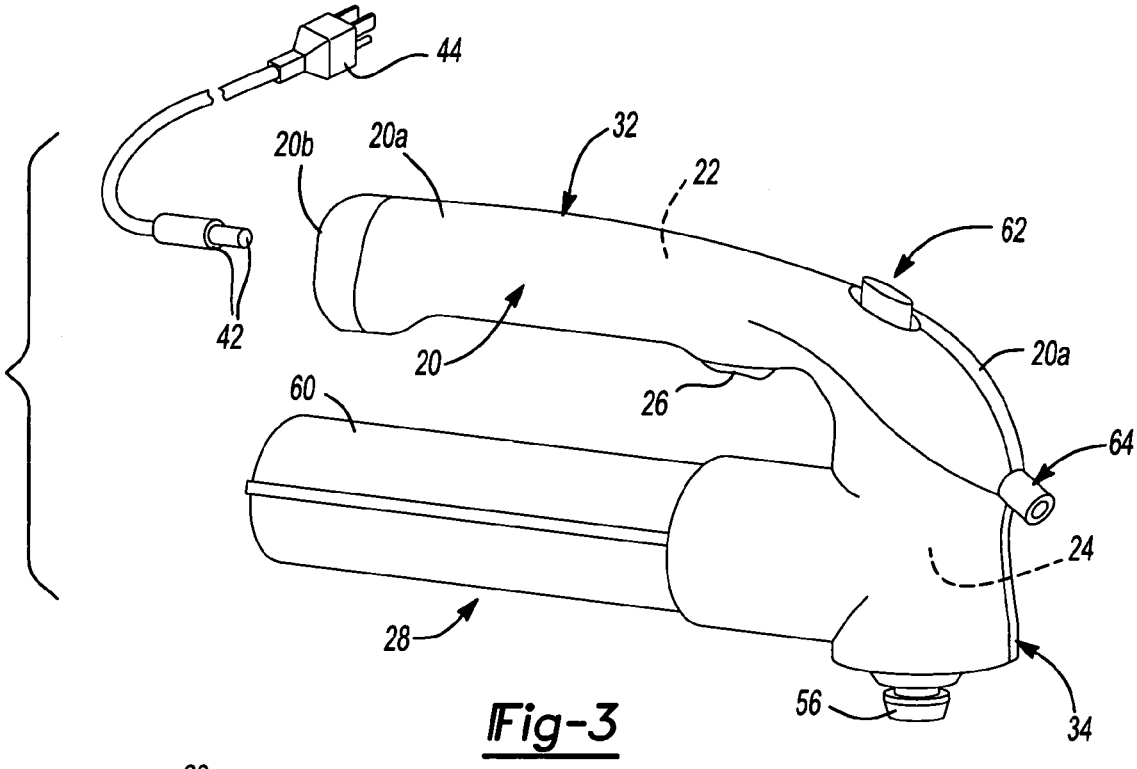
FIG. 3 is a perspective view of a portion of the hand-held motorized cleaning apparatus of FIG. 1 illustrating the main body in greater detail.

With reference to FIG. 3, the main body 12 may include a housing 20, a battery 22, a drive mechanism 24, a power switch 26, and a liquid dispensing system 28. With additional reference to FIG. 4, the housing 20 may include a pair of housing shells 20*a* and a cap 20*b*. The housing shells 20*a* may cooperate to define a handle 32 and a head portion 34. The handle 32 may define a battery cavity 36 into which the battery 22 may be housed. The head portion 34 may define a central cavity 38 in which the drive mechanism 24 and portions of the liquid dispensing system 28 may be housed. The housing 20 may further include a cap 20*b* that is fixedly secured to the housing shells 20*a* to thereby close off the open end of the handle 32. With brief reference to FIGS. 3 and 5, the cap 20*b* may include electrical contacts 40 that are configured to engage the battery 22 and a plurality of mating contacts 42 that are associated with a charger 44 to thereby permit the battery 22 to be recharged without necessitating its removal from the housing 20. Returning to FIGS. 1 and 2, the housing 20 may further include an overmold member 48 that is formed about the perimeter of portions of the housing 20 to enhance the capability of the housing 20 or portions thereof to be gripped by a user and/or to seal portions of the housing 20 to prevent the ingress of water or other fluids therein. Such overmolding is disclosed in further detail in U.S. Pat. Nos. 5,718,014 and 6,248,007, the entire disclosures of which are hereby incorporated by reference as if fully set forth herein.

While the housing 20 has been illustrated and described as employing housing shells 20*a* of a conventional clam-shell style, the invention, in its broader aspects may be formed somewhat differently. For example, the housing 20 may include housing shells 20*a*' as shown in FIG. 4A. In this embodiment, a first housing shell 20*a*' is formed with a unitarily formed handle 32, while the other housing shell 20*a*' is configured to close off the other half of the head portion 34.

Figure 5:
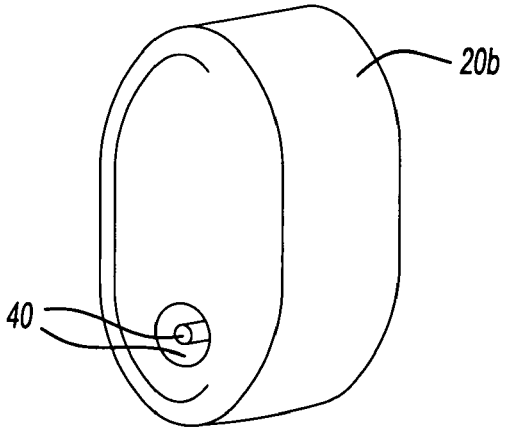
FIG. 5 is a rear elevation of a portion of the main body illustrating the contacts on the cap.
Figure 6:
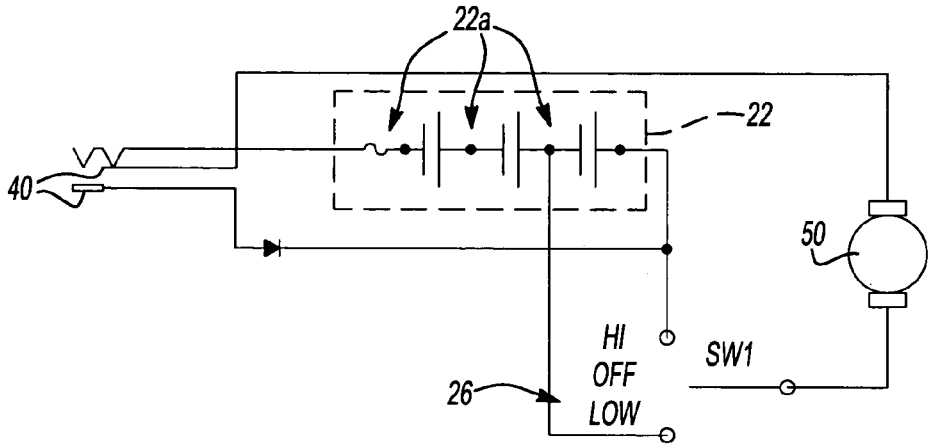
FIG. 6 is a schematic illustration of a portion of the main body illustrating the battery and power switch.

Returning to FIGS. 4 and 5 and with additional reference to FIG. 6, the battery 22, which may be disposed in the battery cavity 36, may be a conventional rechargeable battery having one or more cells, such as a nickel-cadmium cells, nickel-metal hydride or a lithium ion cells, that are electrically coupled to the contacts 40 in the cap 20*b*. In the particular example provided, the battery 22 is not user-serviceable and as such, is permanently disposed in the housing 20. Those of ordinary skill in the art will appreciate, however, that the battery 22 may be a rechargeable battery that is removable from the housing 20, for charging on a recharging base (not shown) or for use with one or more battery-powered tools (not shown), or may be disposable (e.g., disposable alkaline batteries).

The drive mechanism 24 may include a DC motor 50 and a transmission 52, which may be a planetary gearset, for converting the high-speed, low-torque output of the motor 50 to a relatively lower-speed, higher-torque output that is transmitted via an output member 56 to the removable head 14. The configuration of the output member 56 is known in the art and described in detail in U.S. Pat. Nos. 5,718,014 and 6,248,007 and as such, they need not be described in significant detail herein. Briefly, the output member 56 generally comprises a one-piece polymer member that may be attached to an output (not specifically shown) of the transmission 52. The output member 56 may include a stud with a shaft receiving area and a leading section that may have a generally triangular block shape. The output member 56 may also have a relatively narrow neck or shaft section behind the leading section, which may form slots behind the cantilevered generally triangular shaped tips of the leading section.

Returning to FIGS. 4 and 6, the power switch 26 may be mounted to the housing 20 at any convenient point and is electrically coupled to the battery 22 and the motor 50 to selectively control a flow of electricity therebetween. In the particular example provided, the power switch 26 is mounted to an underside of the handle 32 so as to be more easily operated by the fingers of a user when the cleaning apparatus 10 is in use. The power switch 26 may consist of a simple toggle switch that is operable for selectively supplying the full power of the battery 22 to the motor 50, or may be a multi-position switch which permits the battery 22 to provide two or more levels of power to the motor 50. In the example provided, the power switch 26 is a three-position switch that provides off, high, and low power settings. The off setting may conventionally break the electrical connection between the motor 50 and the battery 22, the high setting may conventionally couple the battery 22 to the motor 50 such that each of the cells 22*a* of the battery 22 are connected in series to thereby maximize the voltage of the electrical output provided by the battery 22 and the low setting may couple the battery 22 to the motor 50 such that only a portion of the cells 22*a* of the battery 22 are connected in series (the remaining cells 22*a* may not electrically coupled to another one of the cells 22*a*, or may be connected to another of the cells 22*a* in a parallel configuration).

Figure 4:
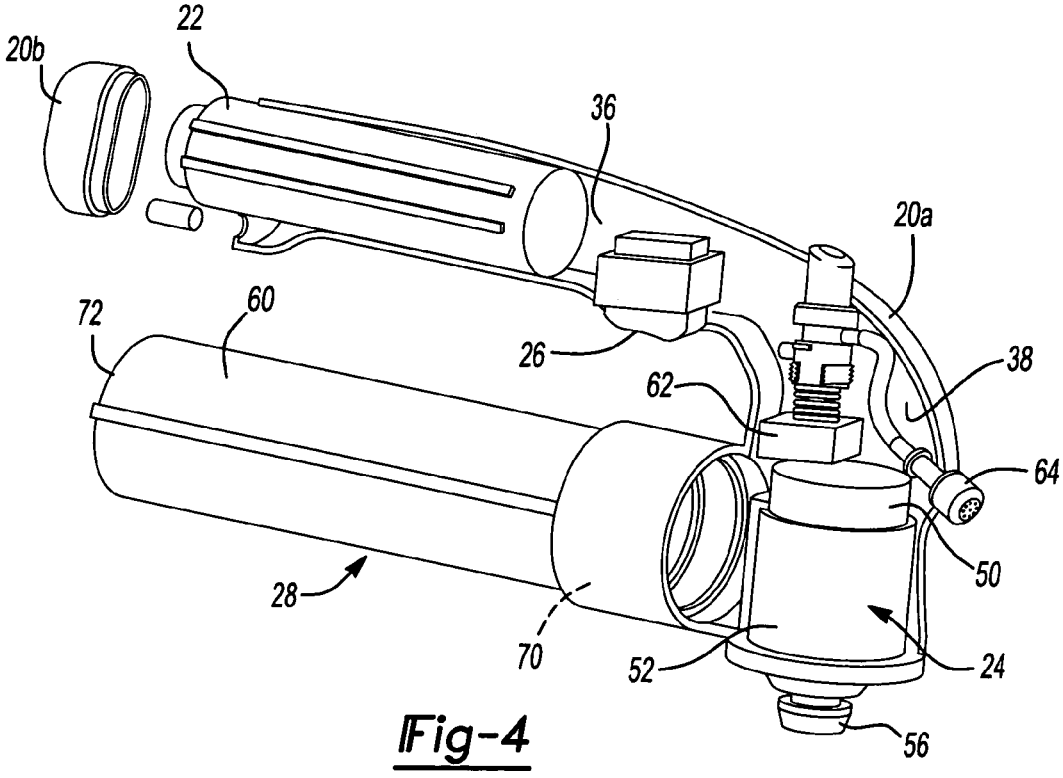
FIG. 4 is a perspective view similar to FIG. 3 but illustrating one portion of the main body in exploded therefrom and another portion of the main body in section.
Figure 4A:
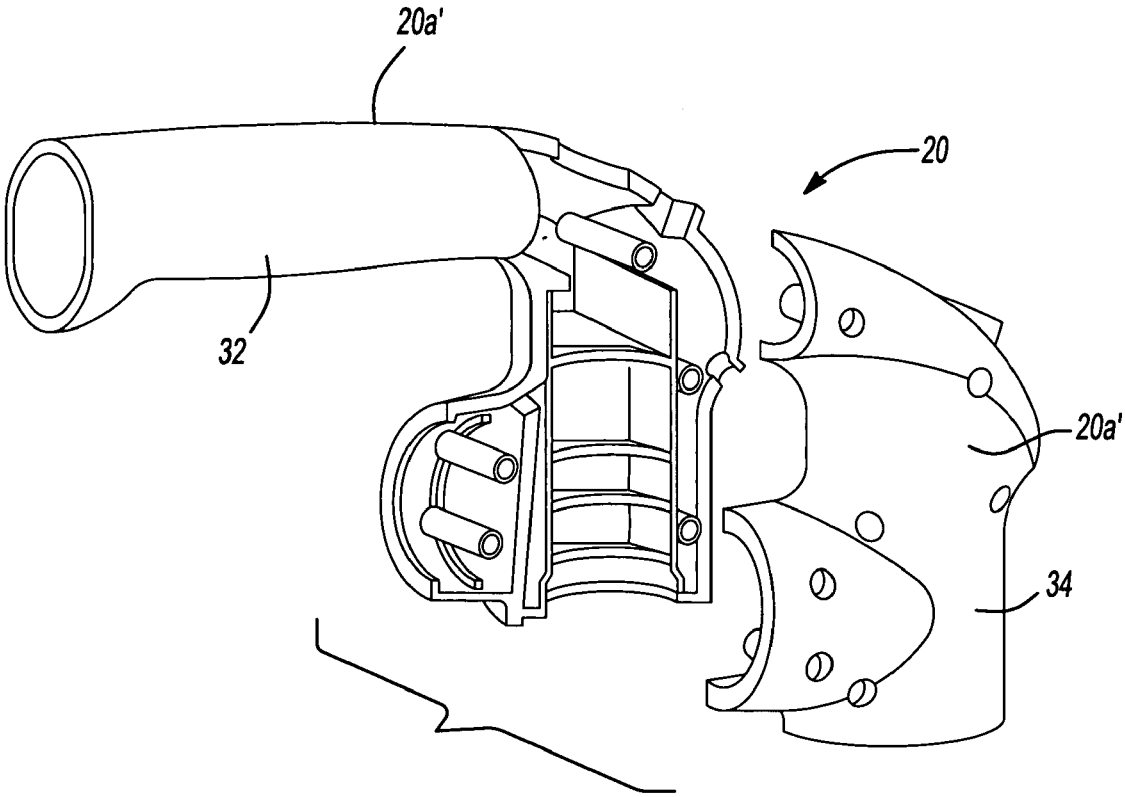
FIG. 4A is an exploded perspective view of another exemplary housing for the main body.
Figure 7:
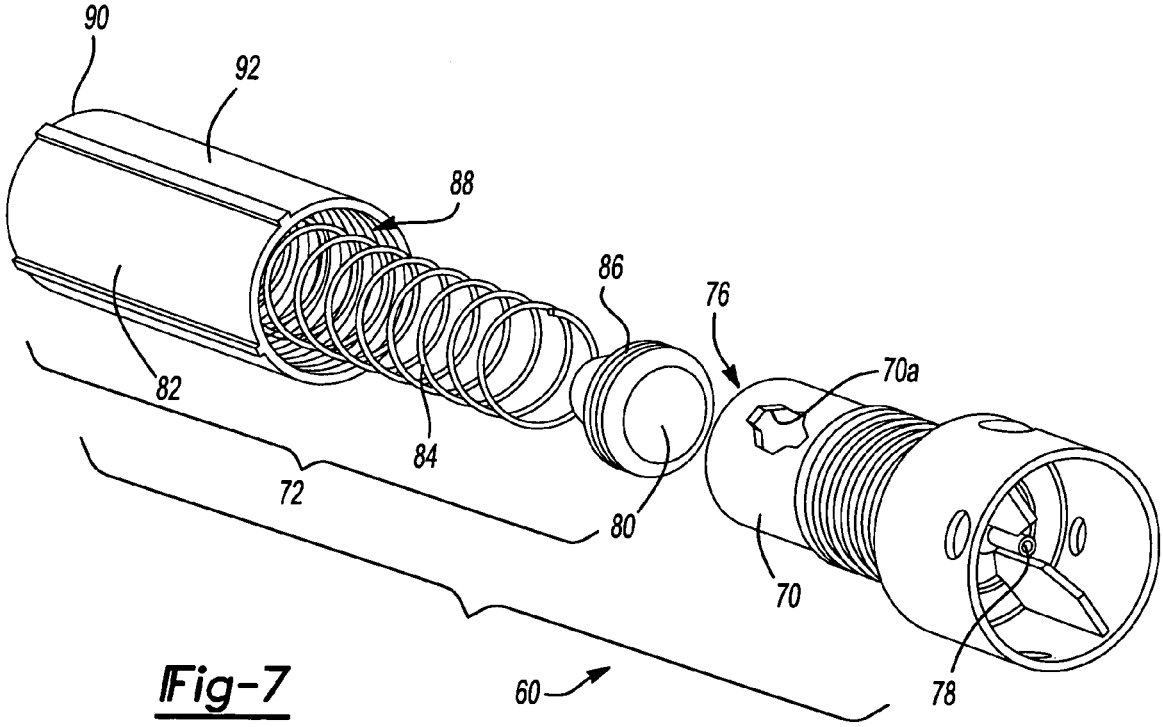
FIG. 7 is an exploded perspective view of a portion of the main body illustrating the piston assembly of the liquid dispensing system in greater detail.

With reference to FIGS. 3 and 4, the liquid dispensing system 28 may include a reservoir assembly 60, a valve assembly 62 and an output nozzle 64. With additional reference to FIG. 7, the reservoir assembly 60 may include a liquid reservoir 70 and a piston assembly 72. The liquid reservoir 70 may be fixedly coupled to the housing 20 and may include an input opening 76 into which a fluid may be dispensed, and an output stem 78 through which the fluid in the liquid reservoir 70 may be delivered to the valve assembly 62.

The piston assembly 72 may include a piston 80, a cylinder sleeve 82 and a spring 84. The piston 80 is configured to be received through the input opening 76 and slidingly disposed in the liquid reservoir 70. The piston 80 may include a seal member 86 that sealingly engages the interior wall 70*a* of the liquid reservoir 70. The cylinder sleeve 82 may have a cylindrical configuration that defines a spring cavity 88 having an open proximal end and an end wall 90 that closes the distal end of the cylinder sleeve 82. The cylinder sleeve 82 may be fixedly but removably coupled to the liquid reservoir 70. In the example provided, a portion of the spring cavity 88 at the proximal end of the cylinder sleeve 82 is configured to threadably engage the exterior of the liquid reservoir 70. Like the housing 20, the cylinder sleeve 82 may include an overmold 92 that is configured to aid the user of the cleaning apparatus 10 to grip the cylinder sleeve 82 when it is to be installed to or removed from the liquid reservoir 70.

The spring 84 is disposed between the piston 80 and the end wall 90 of the cylinder sleeve 82 and exerts a force onto the piston 80 that urges the piston 80 toward the output stem 78 to thereby maintain the fluid in the liquid reservoir 70 in a pressurized state. The end of the spring 84 proximate the piston 80 may be configured to engage the piston 80 so that the piston 80 may be withdrawn from the liquid reservoir 70 when the cylinder sleeve 82 and the liquid reservoir 70 are uncoupled from one another. A retractor (not shown) may be employed to retract the spring 84 into the cylinder sleeve 82 at times such as when the cylinder sleeve 82 is to be removed from the liquid reservoir 70 for the filling or recharging of the liquid reservoir 70. The retractor may be coupled to the piston 80 so that the piston assembly 72 is removed from the liquid reservoir 70 when the spring 84 is retracted. The retractor may further include a lock or latch that may be employed by the user to selectively maintain the spring 84 in the retracted condition.

Figure 8:
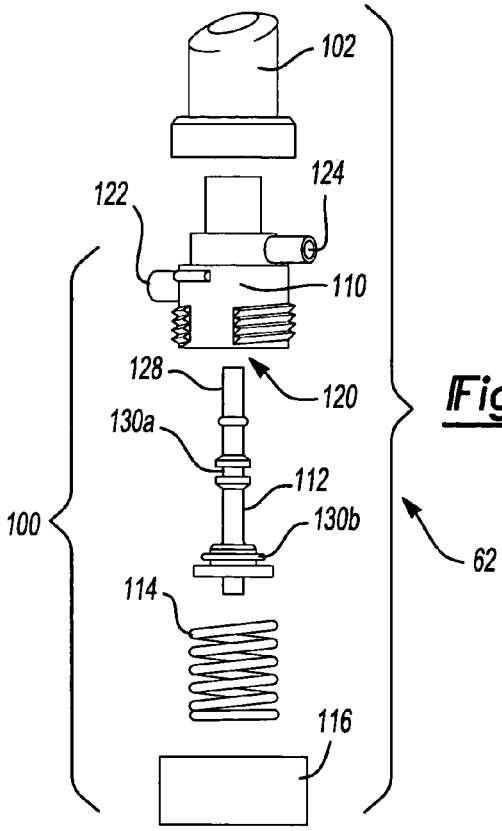
FIG. 8 is an exploded elevation view illustrating an exemplary a valve assembly for the liquid dispensing system.

With reference to FIGS. 4 and 8, the valve assembly 62 may include a valve 100 and an actuator 102. The valve 100 is a normally closed valve and may be configured in any suitable manner. In the example provided, the valve 100 may include a valve body 110, a valve stem 112, a valve spring 114 and a valve cap 116. The valve body 110 may define a valve stem cavity 120, an inlet 122, which is in fluid communication with the output stem 78 (FIG. 7) of the liquid reservoir 70, and an outlet 124, which is in fluid communication with the output nozzle 64. The valve stem 112 is received into the valve stem cavity 120 and may include a stem member 128 that may carry two or more seals 130*a*, 130*b*. The valve cap 116 is coupled to the valve body 110 such that the valve spring 114 urges the valve stem 112 into a position wherein a first one of the seals 130*a* may be sealingly engaged to the valve body 110 at a location above the outlet 124, while a second one of the seals 132*b* may be sealingly engaged to the valve body 110 at a location that is in-line with the inlet 122.

The actuator 102 may be coupled to the valve stem 112 and positioned so as to extend from the housing 20 where it may be depressed by the thumb or finger of one using the cleaning apparatus 10. As the valve stem 112 is slidably disposed in the valve body 110, downward movement of the valve stem 112 relative to the valve body 110 (which may be caused by depressing the actuator 102) positions the second seal 130*b* below the inlet 122. While the first seal 130*a* also translates downwardly, it is still positioned at a location above the outlet 124. With the first and second seals 130*a* and 130*b* located above and below the outlet 124 and the inlet 122, respectively, fluid in the liquid reservoir 70, which is under pressure by virtue of the piston assembly 72, may flow through the valve body 110 to the output nozzle 64.

Figure 9:
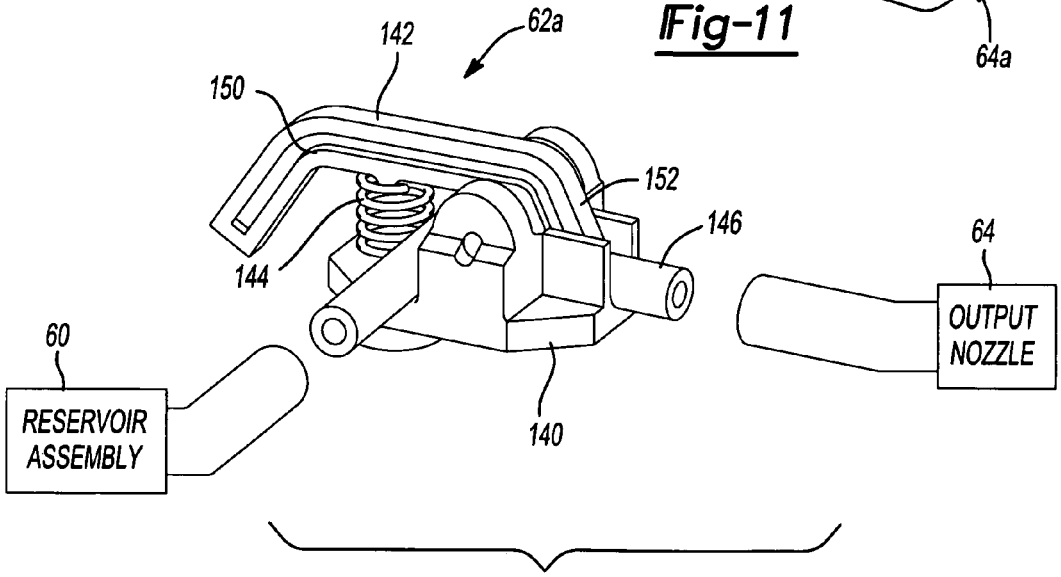
FIG. 9 is a perspective view illustrating another exemplary valve assembly for the liquid dispensing system.
Figure 12:
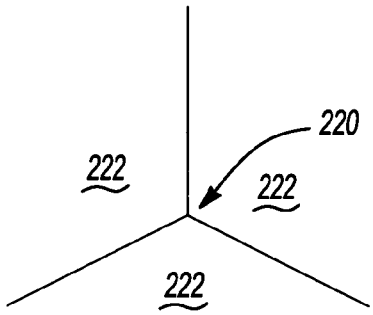
FIG. 12 is a perspective view of a portion of the hand-held motorized cleaning apparatus of FIG. 1 illustrating the removable head in greater detail.
Figure 12:
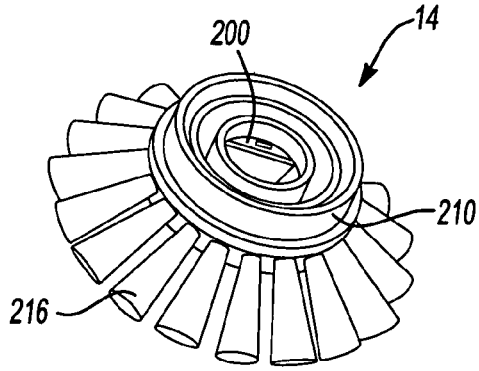
Figure 13:
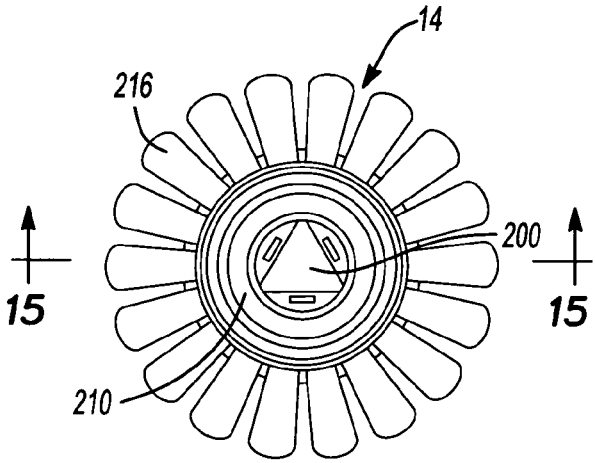
FIG. 13 is a top plan view of the removable head.
Figure 14:
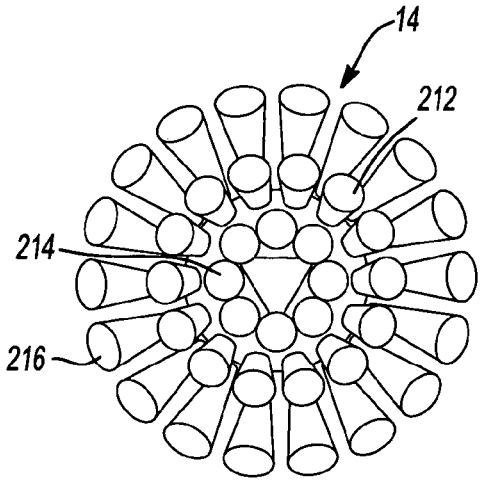
FIG. 14 is a bottom view of the removable head.
Figure 15:
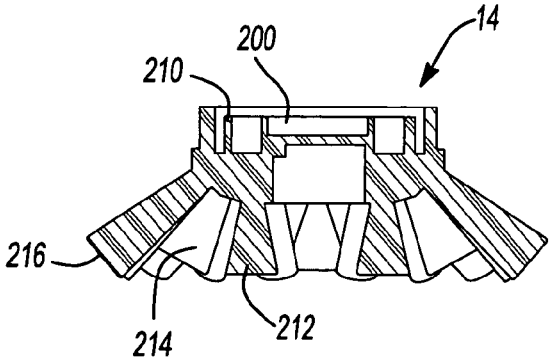
FIG. 15 is a sectional view of the removable head.
Figure 16:
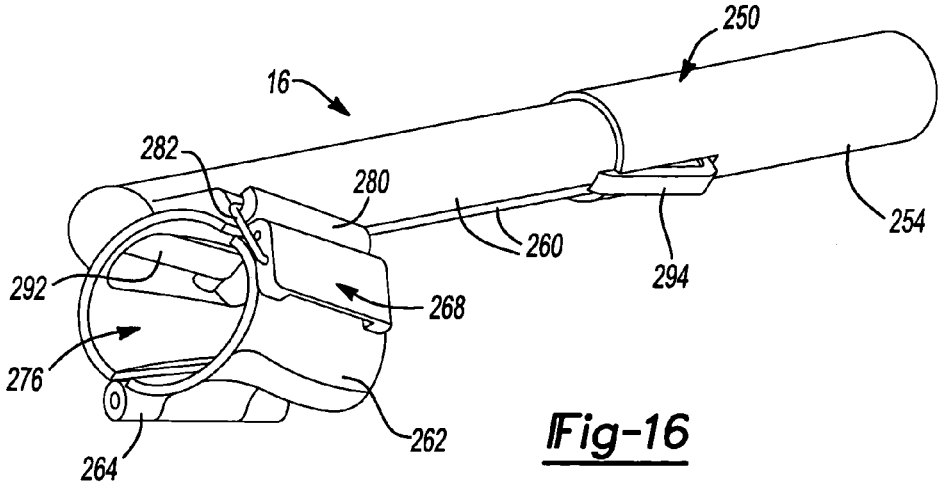
FIG. 16 is a perspective view of a portion of the hand-held motorized cleaning apparatus of FIG. 1 illustrating the removable extension handle in greater detail.
Figure 17:
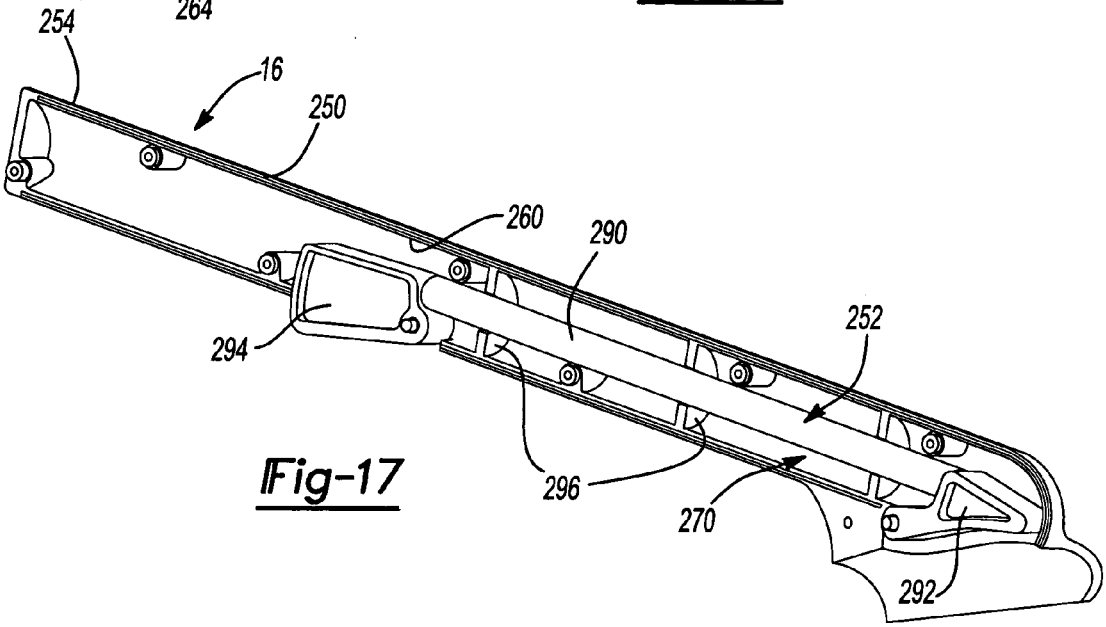
FIG. 17 is a longitudinal section view of a portion of the removable extension handle.

An alternative valve assembly 62*a* is illustrated in FIG. 9. The valve assembly 62*a* includes a mounting block 140, a pinch arm 142, and a compression spring 144. The mounting block 140 is configured to hold a hose 146 that interconnects the reservoir assembly 60 to the output nozzle 64. The pinch arm 142 is pivotably coupled to the mounting block 140 and includes an actuation arm 150 and a compression arm 152. The compression spring 144 is disposed between the mounting block 140 and the actuation arm 150 to thereby pivotably bias the actuation arm 150 upwardly so that the compression arm 152 engages and compresses the hose 146 to thereby inhibit fluid from flowing through the hose 146. To actuate the valve assembly 62*a*, the actuation arm 150 is pivoted downwardly relative to the mounting block 140 to thereby lift the compression arm 150 from the hose 146. As the fluid in the reservoir assembly 60 is under pressure, the fluid will cause the hose 146 to expand so that fluid may flow to the output nozzle 64.

Figure 10:
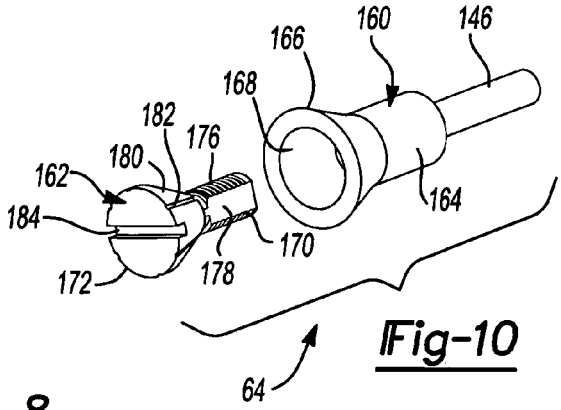
FIG. 10 is an exploded perspective view illustrating an exemplary output nozzle for the liquid dispensing system.

With reference to FIG. 10, the output nozzle 64 may include a nozzle mount 160 and a nozzle body 162. The nozzle mount 160 may include a body 164, which is configured to be coupled to the valve assembly 62 (FIG. 3) or the reservoir assembly 60 (FIG. 3) as appropriate via a conduit, such as a hose 146, and a receiver 166, which is configured to receive the nozzle body 162 at least partially therein. In the particular example provided, the receiver 166 includes a conically shaped interior sidewall 168.

The nozzle body 162 may include a stem portion 170 and a head portion 172. The stem portion 170 may be coupled to the body 164 of the nozzle mount 160 in any appropriate manner. In the example provided, the stem portion 170 includes a male thread form 176 that threadably engages a female thread form (not specifically shown) that is formed along the interior of the body 164. Fluid escapement features 178 may be formed in or on the output nozzle 64 to prevent the stem portion 170 from blocking the flow of fluid through the nozzle mount 160. In the example provided, the fluid escapement features 178 include a pair of flats that are formed on the opposite sides of the stem portion 170.

The head portion 172 is configured with a shape that conforms to the interior surface 168 of the receiver 166. The exterior surface 180 of the head portion 172 may include one or more channels 182 that may extend along the length of the exterior surface 180. The channels 182 may be spaced about the exterior surface 180 in any desired manner. For example, the channels 182 may spiral about the head portion 172, and/or may extend in a direction that is angled to the longitudinal axis of the head portion 172 so as to intersect the longitudinal axis and/or may extend in directions that are angled to the longitudinal axis of the head portion 172 and which are skewed to the longitudinal axis. An assembly feature, such as a slot 184, may be formed on the head portion 172 to facilitate the installation and adjustment of the nozzle body 162 to the nozzle mount 160.

In operation, the nozzle body 162 may be rotated relative to the nozzle mount 160 to thereby alter an amount of clearance between the interior surface 168 of the receiver 166 and the exterior surface 180 of the head portion 172. As those of ordinary skill in the art will appreciate from this disclosure, the amount of such clearance dictates, at least partially, the amount of fluid that may be dispensed by the output nozzle 64 and/or the size of the stream that is dispensed. The channels 182 in the exterior surface 180 of the head portion 172 ensure that fluid may be dispensed even when the exterior surface 180 of the head portion 172 is abutted against the interior surface 168 of the receiver 166. Alternatively, the channels 182 may be omitted so as to inhibit fluid dispensing if the exterior surface 180 of the head portion 172 is abutted against the interior surface 168 of the receiver 166.

Figure 11:
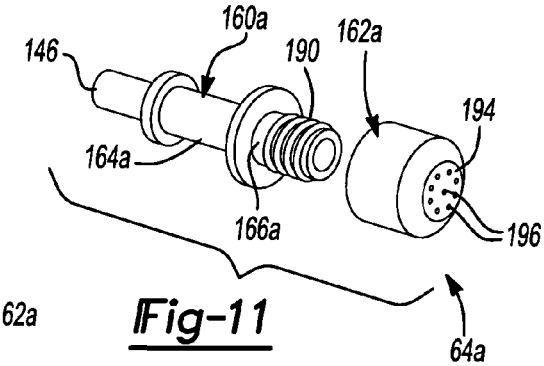
FIG. 11 is an exploded perspective view illustrating another exemplary output nozzle for the liquid dispensing system.

With reference to FIG. 11, another exemplary output nozzle constructed in accordance with the teachings of the present invention is generally indicated by reference numeral 64*a*. The output nozzle 64*a* may include a nozzle mount 160*a* and a nozzle body 162*a*. The nozzle mount 160*a* may include a body 164*a*, which is configured to be coupled to the valve assembly 62 (FIG. 3) or the reservoir assembly 60 (FIG. 3) as appropriate via a conduit, such as a hose 146, and a receiver 166*a*, which is configured to engage the nozzle body 162*a*. In the particular example provided, the receiver 166*a* includes an externally threaded hollow stem 190 that is in fluid connection with the body 164*a* and configured to threadably engage the nozzle body 162*a*. The nozzle body 162*a* may include an end face 194 having a plurality of fluid dispensing apertures 196 formed therethrough. In operation, fluid flowing through the nozzle mount 160*a* is forced through the fluid dispensing apertures 196 in the nozzle body 162*a*.

With reference to FIGS. 1, 2 and 12 through 15, the removable head 14 may be removably coupled to the output member 56 and may include a generally triangular socket 200 that is configured to receive the leading section of the output member 56 in a known manner. The removable head 14 may be configured in any desired manner and may include a plurality of bristles or a pad-like scouring member. In the example provided, the removable head 14 includes a brush body 210 to which is coupled a plurality of first bristles 212, a plurality of second bristles 214 and a plurality of third bristles 216, all of the bristles being relatively soft. The first bristles 212 may be disposed generally parallel to a rotational axis of the removable head 14 and may have a length of about 18 mm. The second bristles 214 may be disposed at an angle of about 2520 relative to the rotational axis of the removable head 14 and may have a length of about 20 mm. The third bristles 216 may be disposed at an angle of about 50° relative to the rotational axis of the removable head 14 and may have a length of about 32.5 mm. Construction of the removable head 14 in this manner permits the bristles to effectively clean a corner 220 that is defined by three walls 222 that are orthogonal to one another.

With reference to FIGS. 1, 2, 16 and 17, the extension handle 16 may include a handle housing 250 and a handle actuator 252. The handle housing 250 is configured to engage the housing 20 and provide an extended handle 254 that is relatively further away from the removable head 14 than the handle 32. In the particular example provided, the handle housing 250 includes a pair of handle housing shells 260, a clasp member 262, a hinge 264 and a latch 268. The handle housing shells 260 cooperate to define a cavity 270 into which the handle actuator 252 may be received. The clasp member 262 is coupled to one of the handle housing shells 260 via the hinge 264 and cooperates with the handle housing shells 260 to define an aperture 276 that is configured to receive the head portion 34 of the housing 20 therein. The aperture 276 may be configured so that it engages the head portion 34 at a predetermined location to thereby locate the handle actuator 252 relative to the actuator 102. The latch 268 may be a conventional over-center camming latch and may include first and second latch members 280 and 282, respectively, that may be disengaged from one another to permit the clasp member 262 to be rotated outwardly to thereby couple the extension handle 16 to or remove the extension handle 16 from the handle 32. Engagement of the first and second latch members 280 and 282 to one another while the handle housing 250 is engaged to the head portion 34 of the housing 20 fixedly couples the extension handle 16 to the main body 12.

The handle actuator 252 may include a triggering rod 290, an auxiliary actuator 292 and an auxiliary trigger 294. The triggering rod 290 may be journally supported by wall members 296 that are formed in the handle housing shells 260 so as to be slidable therein between the auxiliary actuator 292 and the auxiliary trigger 294. The auxiliary actuator 292 and the auxiliary trigger 294 may each be pivotably coupled to one of the handle housing shells 260. Upward rotation of the auxiliary actuator 292 causes the triggering rod 290 to slide within the handle housing 250 toward the auxiliary trigger 294. Similarly, upward rotation of the auxiliary trigger 294 causes the triggering rod 290 to slide within the handle housing 250 toward the auxiliary actuator 292. It should be noted that as contact between the actuator 102 and the auxiliary actuator 292 when the extension handle 16 is coupled to the main body 12 biases the auxiliary actuator 292 into the upwardly rotated position. To operate the liquid dispensing system 28 when the extension handle 16 is coupled to the main body 12, the user need only depress the auxiliary trigger 294 (i.e., rotate the auxiliary trigger 294 upward). This movement of the auxiliary trigger 294 is translated through the triggering rod 290 and to the auxiliary actuator 292, which in turn pushes the actuator 102 downwardly to cause liquid to be dispensed in the manner that is described above.

Figure 18:
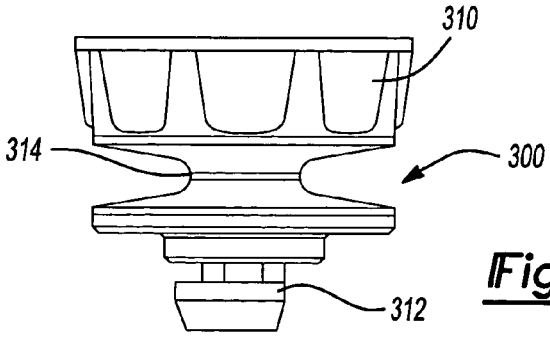
FIG. 18 is an elevation view of a flexible adapter constructed in accordance with the teachings of the present invention.
Figure 19:
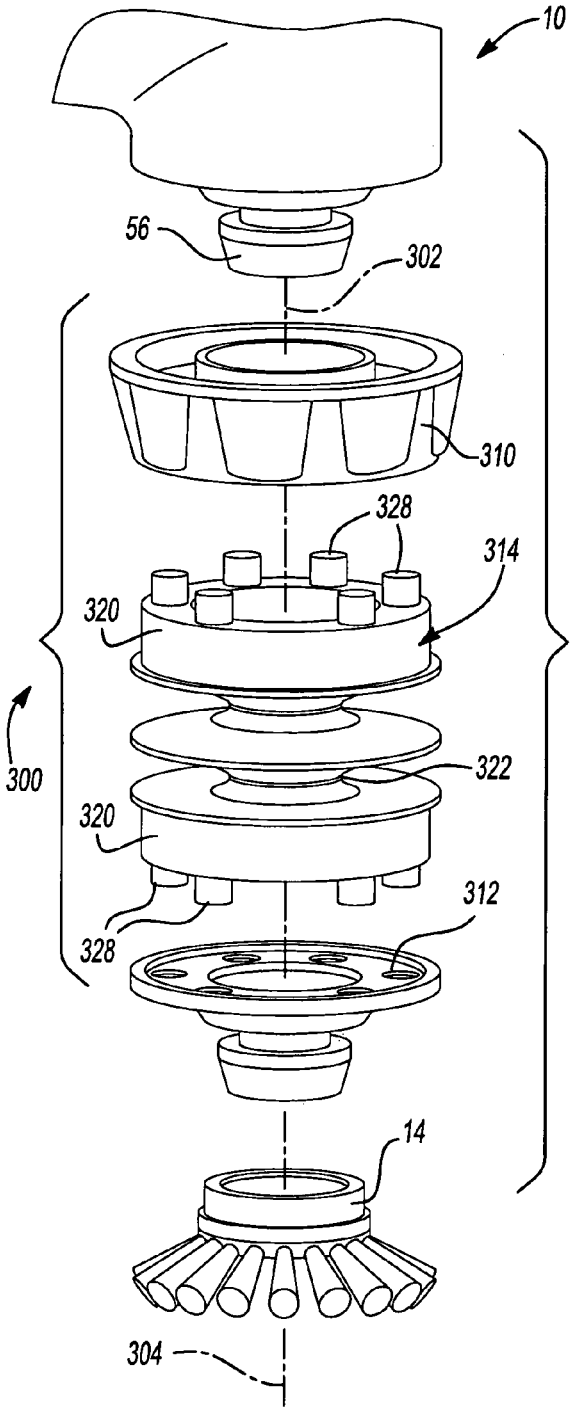
FIG. 19 is an exploded perspective view of the flexible adapter of FIG. 18 in operative association with the hand-held motorized cleaning apparatus of FIG. 1.
Figure 20:
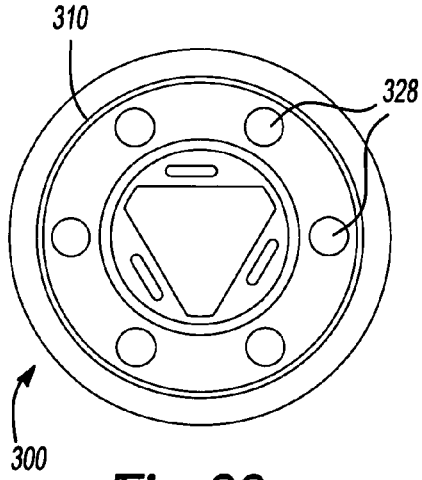
FIG. 20 is a top plan view of the flexible adapter of FIG. 18.

With reference to FIGS. 18 through 20, the cleaning apparatus 10 may further include a flexible adapter 300 that permits the rotational axes 302 and 304 of the output member 56 and the removable head 14, respectively, to be moved relative to one another between a position wherein the axes 302 and 304 are coincident, and a position wherein the rotational axes 302 and 304 are disposed in an oblique condition. The flexible adapter 300 may include a female socket 310, a male socket 312 and flexible member 314 that interconnects the female socket 310 and the male socket 312. The female socket 310 may be configured in a manner that is similar to the configuration of the generally triangular socket of the removable head 14, whereas the male socket 312 may be configured in a manner that is similar to the configuration of the leading section of the output member 56.

The flexible member 314 may be formed from an elastomeric material that may have a durometer of about 35 Shore A to about 60 Shore A. The flexible member 314 includes a pair of mounting flanges 320 that are separated by a necked-down portion 322. Each of the mounting flanges 320 includes a plurality of drive tabs 328 that engage corresponding features that are formed into the female and male sockets 310 and 312.

In the example provided, the female and male sockets 310 and 312 are preformed and thereafter inserted into a mold (not shown) that may be employed to both form the flexible member 314 and fixedly couple the flexible member 314 to the female and male sockets 310 and 312. The drive tabs 328 extend through the female and male sockets 310 and 312 and are configured so as to inhibit axial movement of the female and male sockets 310 and 312 relative to the flexible member 314.

In operation, the resilient nature of the material from which the flexible member 314 is formed tends to maintain the female and male sockets 310 and 312 about a common rotational axis. The necked-down portion 322, however, permits the removable head 14 to be rotated even when the axes 302 and 304 are arranged in an oblique manner.

While the cleaning apparatus has been described and illustrated as employing a liquid dispensing system with a liquid reservoir of a specific configuration, those of ordinary skill in the art will appreciate that the invention, in its broader aspects, may be configured somewhat differently.

Figure 21:
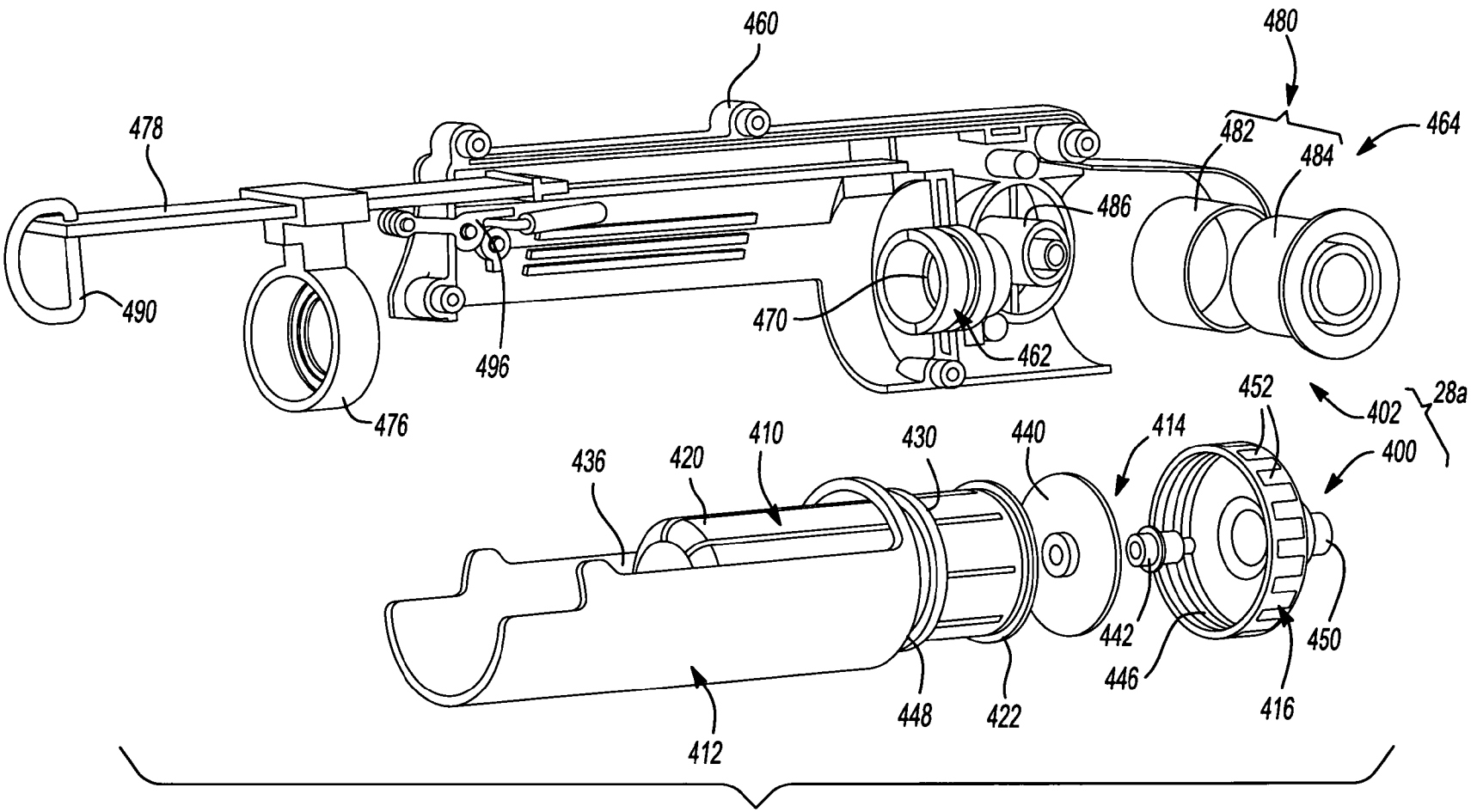
FIG. 21 is an exploded perspective view in partial section of another exemplary liquid dispensing system constructed in accordance with the teachings of the present invention.

For example, the liquid dispensing system may be configured as illustrated in FIG. 21. In this example, the liquid dispensing system 28*a* may include a cartridge assembly 400 and a housing assembly 402. The cartridge assembly 400 may include a liner 410, a liner holder 412, a valve assembly 414, and a liner lid holder 416.

The liner 410 may include a body portion 420, which may be formed from a sheet plastic material, and a flange portion 422. The body portion 420 forms a collapsible container that may be filled with a desired liquid. The flange portion 422 extends about the circumference of the open end of the body portion 420. The flange portion 422 extends outwardly from the body portion 420 and may optionally extend inwardly to effectively close off the open end of the body portion 420. This latter configuration may be desirable, for example, for marketing liners 410 that have been pre-filled with a liquid.

The liner holder 412 may be a generally tubular housing into which the body portion 420 of the liner 410 may be received. The liner holder 412 may also include an abutting face 430 against which the flange portion 422 may be abutted. In the particular example provided, the liner holder 412 does not extend continuously about the circumference of the body portion 420 to thereby define a window 436 through which a user of the cleaning apparatus 10 may readily determine the extent to which the liner 410 is filled with a liquid. Alternatively, the liner holder 412 may be formed in whole or in part with a transparent material that permits the user to view the liner 410 therethrough.

The valve assembly 414 may include a valve disk 440 and a valve 442. The valve disk 440 may be an annular disk that is configured to abut the flange portion 422 of the liner 410 on a side opposite the liner holder 412. The valve 442 is coupled to the valve disk 440 and is configured to receive fluid from the liner 410. In situations where the flange portion 422 of the liner closes off the open end of the body portion 420, the valve 442 may be configured to pierce the flange portion 422 when the cartridge assembly 400 is assembled.

The liner lid holder 416 is configured to engage the liner holder 412 such that the flange portion 422 of the liner 410 is clamped between and sealingly engages the abutting face 430 and the valve disk 440. In the example provided, the liner lid holder 416 is an annular collar having a set of internal threads 446, which are configured to threadably engage mating external threads 448 formed on the liner holder 412, and a nosepiece 450. The nosepiece 450 extends forwardly and has an interior diameter that is configured to receive the valve 442 therethrough. The exterior of the liner lid holder 416 may include features, such as recesses or protrusions 452 that permit the liner lid holder 416 to be more easily gripped by the hand of a user.

The housing assembly 402 may include a housing 460, a receiver 462 and a compressor 464. The housing 460 may be integrally formed the housing 20 (FIG. 1) or may be unitarily formed and coupled thereto. The housing 460 serves as a mount for the receiver 462 and the compressor 464 and is configured to receive the cartridge assembly 400. In this regard, one of the cartridge assembly 400 and the housing 460 may include a set of hooks (not shown) that are configured to engage the other one of the cartridge assembly 400 and the housing 460 when they are assembled to one another to thereby support a rearward end of the cartridge assembly 400.

The receiver 462 is a sleeve-like member that is configured to receive the nosepiece 450 of the liner lid holder 416. In one embodiment, the receiver 462 aligns the valve 442 to an output 470 that is formed in the receiver 462 so that the valve 442 sealingly engages the output 470. Alternatively, one or both of the nosepiece 450 and the receiver 462 may carry a seal member (not shown), such as an O-ring, for sealingly engaging the other one of the nosepiece 450 and the receiver 462.

The compressor 464 may include a piston 476 that is movable into and out of the liner holder 412 to apply a compressive force onto the contents of the liner 410. In the example provided, the piston 476 is mounted for translation relative to the housing 460 and biased forwardly by a spring 480. The spring 480 may be of any type (e.g., a compression spring), but in the particular example provided, is a band or constant-force spring of the type that is commonly employed in commercially available tape measures. The band spring may include a flat band 482 that is coiled about a spool 484 that is supported on a hub 486 that is formed on the housing 460. A first end of the flat band 482 engages the hub 486, while the opposite end of the flat band 482 is fixedly coupled to the piston 476. The flat band 482 is configured to bias the piston 476 forwardly toward the hub 486.

A retractor 490 may be employed to permit a user to pull the piston 476 rearwardly for loading and unloading of the cartridge assembly 400 to the housing assembly 402. The retractor 490 may include an arm 478, a dog 478*a*, which may be coupled to a forward end of the arm 478, and a pull 490*a*, which may be coupled to a rearward portion of the arm 478 and may be shaped in any desired manner to permit the user to use one or more fingers and/or a thumb to actuate the retractor 490. In the example provided, the arm 478 is a structural link between the dog 478*a* and the pull 490*a* such that rearward movement of the arm 478 (in response to the user pulling the pull 490*a* in a rearward direction) causes corresponding rearward movement of the dog 478*a*. While the arm 478 is configured to slide through an aperture 478*b* in the piston 476, contact between the dog 478*a* and the piston 476 (when the dog 478*a* is being moved in a rearward direction) moves the piston 476 in a rearward direction. A spring (not shown) may be employed to bias the dog 478*a* forwardly.

The compressor 464 may further include a latch 496 that engages the arm 478, the dog 478*a* or the piston 476 when the piston 476 is located in a rearward position to thereby maintain the piston 476 in such condition for the loading and/or unloading of the cartridge assembly 400 to/from the housing assembly 402.

To load the cartridge assembly 400, the user may pull the pull 490*a* to move the piston 476 rearwardly and may engage the latch 496 to maintain the piston 476 at a rearward position. A liner 410 may be inserted to the liner holder 412 such that the flange portion 422 abuts the abutting face 430 and thereafter filled with a desired liquid. The valve assembly 414 is installed over the flange portion 422 and the liner lid holder 416 is coupled to the liner holder 412 to thereby seal the flange portion 422 of the liner 410 between the abutting face 430 and the valve disk 440. The cartridge assembly 400 is installed to the housing assembly 402 such that the nosepiece 450 is received into the receiver 462 and if so configured, the liner holder 412 engages the housing assembly 402. The latch 268 may thereafter manipulated to permit the piston 476 to travel forwardly and contact the liner 410. A force, which may be generated by the spring 480, may be applied onto the liner 410 which places the fluid in the liner 410 in a pressurized state. The valve 442 may be configured to open in response to the pressurized state of the fluid in the liner 410, or may be opened in response to contact between the valve 442 and another element, such as the receiver 462.

Figure 22:
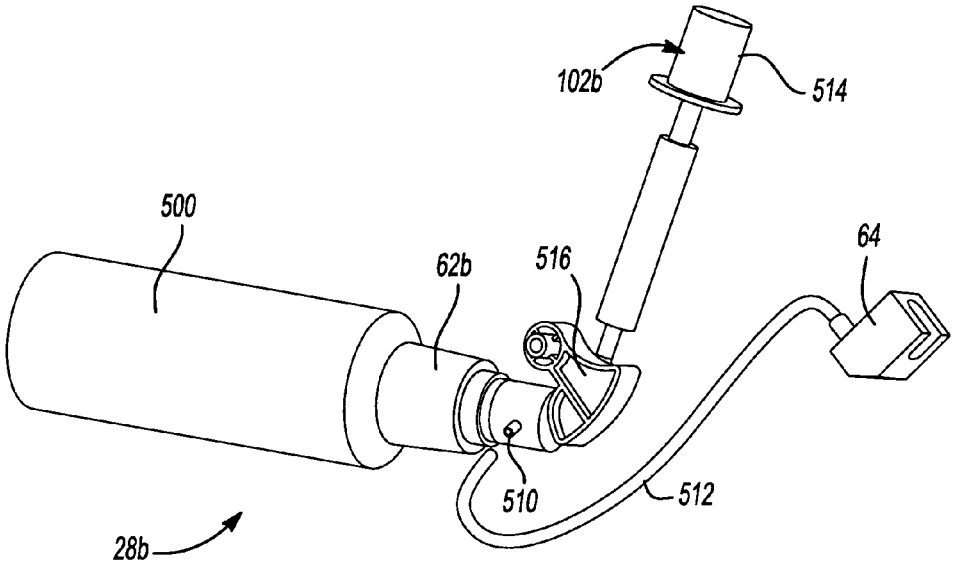
FIG. 22 is a perspective view of another exemplary liquid dispensing system constructed in accordance with the teachings of the present invention.
Figure 23:
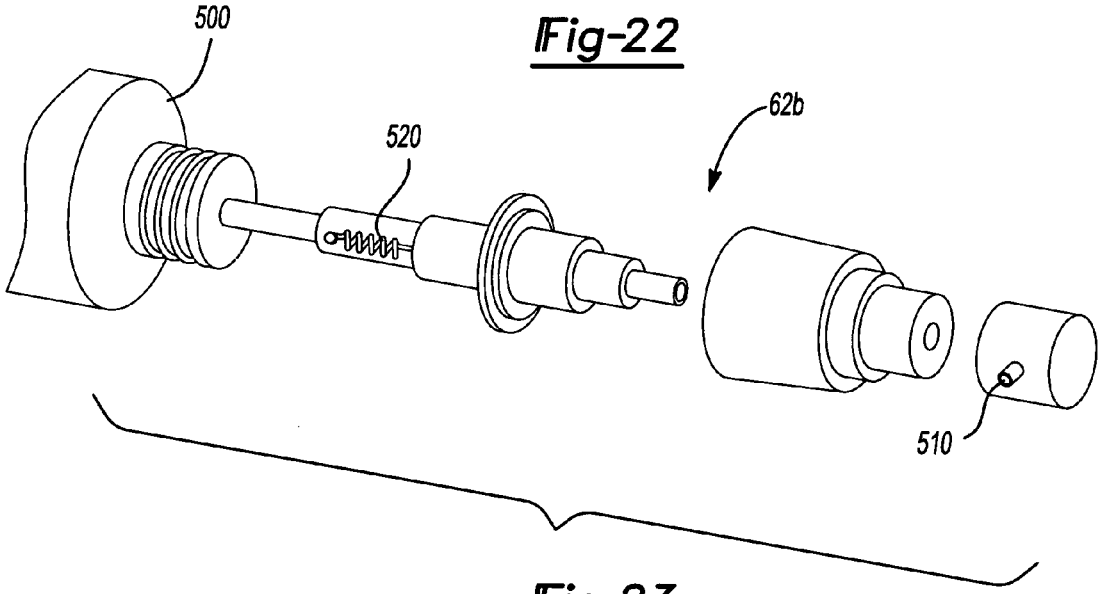
FIG. 23 is an exploded perspective view of a portion of the liquid dispensing system of FIG. 22.

Yet another liquid dispensing system is illustrated in FIGS. 22 and 23. In this example, the liquid dispensing system 28*b* includes a reservoir bottle 500 and a valve assembly 62*b*. The reservoir bottle 500 may be removably coupled to the valve assembly 62*b* via a threaded connection. The valve assembly 62*b* may be part of a pump that is of a type that is well known in the art and employed in conjunction with various commercially available liquid household cleaners that employ manually operated spray bottles. The valve assembly 62*b* may have an outlet 510 that is coupled in fluid connection to the output nozzle 64 by a hose 512. The actuator 102*b* in this example includes a push button 514 and a rocker 516 that is pivotably mounted in the housing 20 (FIG. 1) of the cleaning apparatus 10 (FIG. 1).

To dispense fluids from the reservoir bottle 500, the push button 514 is depressed, which causes the rocker 516 to pivot downwardly and actuate the valve assembly 62*b*. As the valve assembly 62*b* is part of a pump in the example provided, fluid is dispensed through the hose 512 after which the valve assembly 62*b* is opened to permit fluid in the reservoir to be drawn into the pump. One or more springs 520 may be employed to return the rocker 516. While this embodiment has been described and illustrated as entirely manually powered, those of ordinary skill in the art will appreciate from this disclosure that the reservoir 500 may alternatively be a disposable aerosol-type container and the valve assembly 62*b* a normally-closed valve that may be selectively opened by the rocker 516 to cause the contents of the reservoir 500 to be dispensed.

Figure 24:
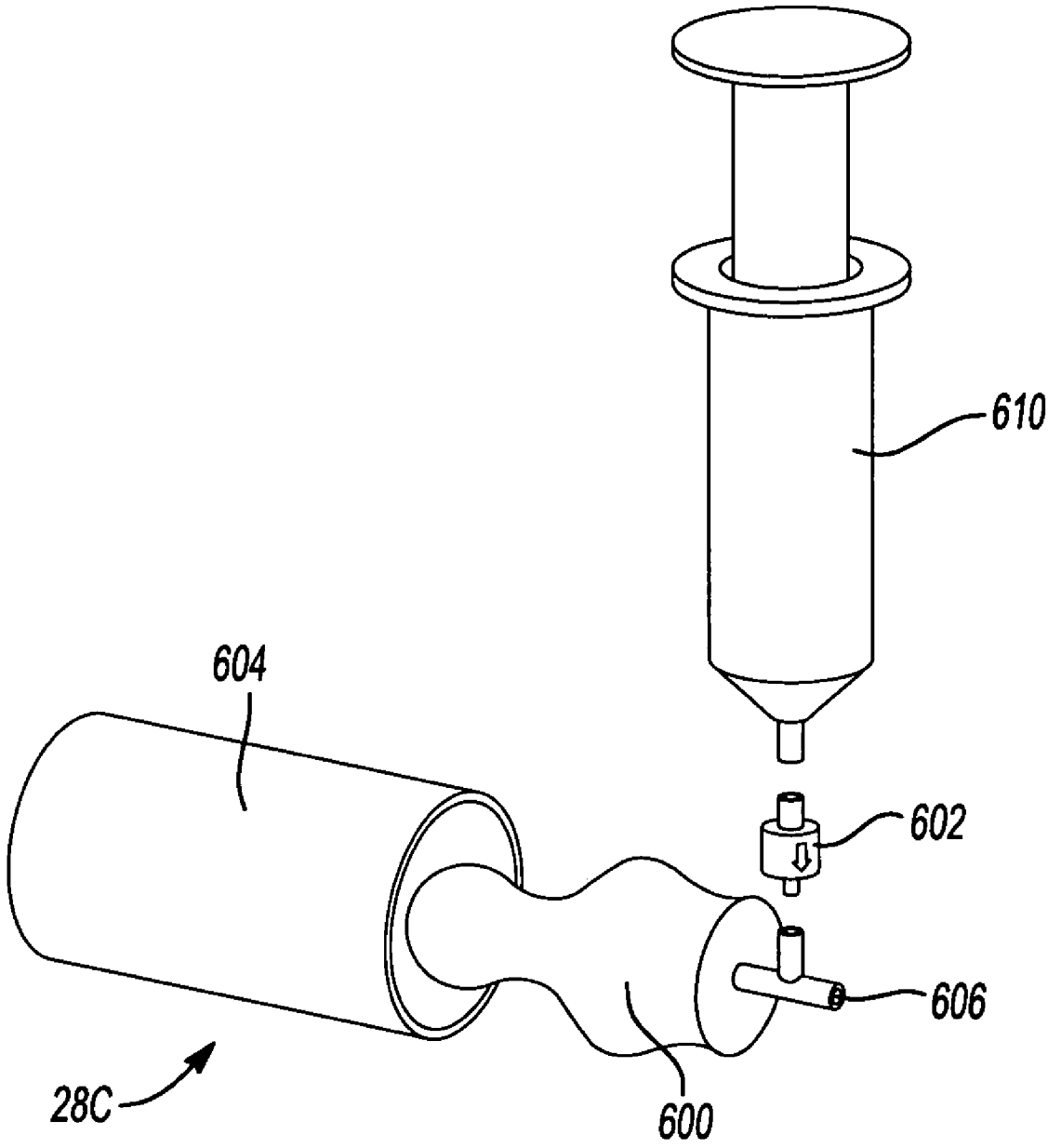
FIG. 24 is a perspective view of yet another exemplary liquid dispensing system constructed in accordance with the teachings of the present invention.

Yet another liquid dispensing system is illustrated in FIG. 24, wherein the liquid dispensing system 28*c* may include a resilient bladder 600 and a check valve 602. The bladder 600 may be disposed in a bladder housing 604 that may be employed to inhibit the overfilling of the bladder 600. The bladder 600 may be filled by forcing a fluid through the check valve 602 and into the conduit 606 that interconnects the bladder 600 and the valve assembly 62 (FIG. 4). As the valve assembly 62 (FIG. 4) includes a normally closed valve in this example, the fluid is forced into the bladder 600 causing the bladder 600 to expand within the bladder housing 604. The check valve 602 conventionally inhibits fluid from flowing from the conduit 606 through the check valve 602. Due to the resilient nature of the bladder 600, the wall of the bladder 600 exerts a force onto the fluid therein. In the example provided, the fluid is illustrated as being introduced through the check valve 602 into the conduit 606 via a syringe 610, but those skilled in the art will appreciate that a pressurized, pre-filled disposable container may also be used to charge the bladder 600.

Figure 25:
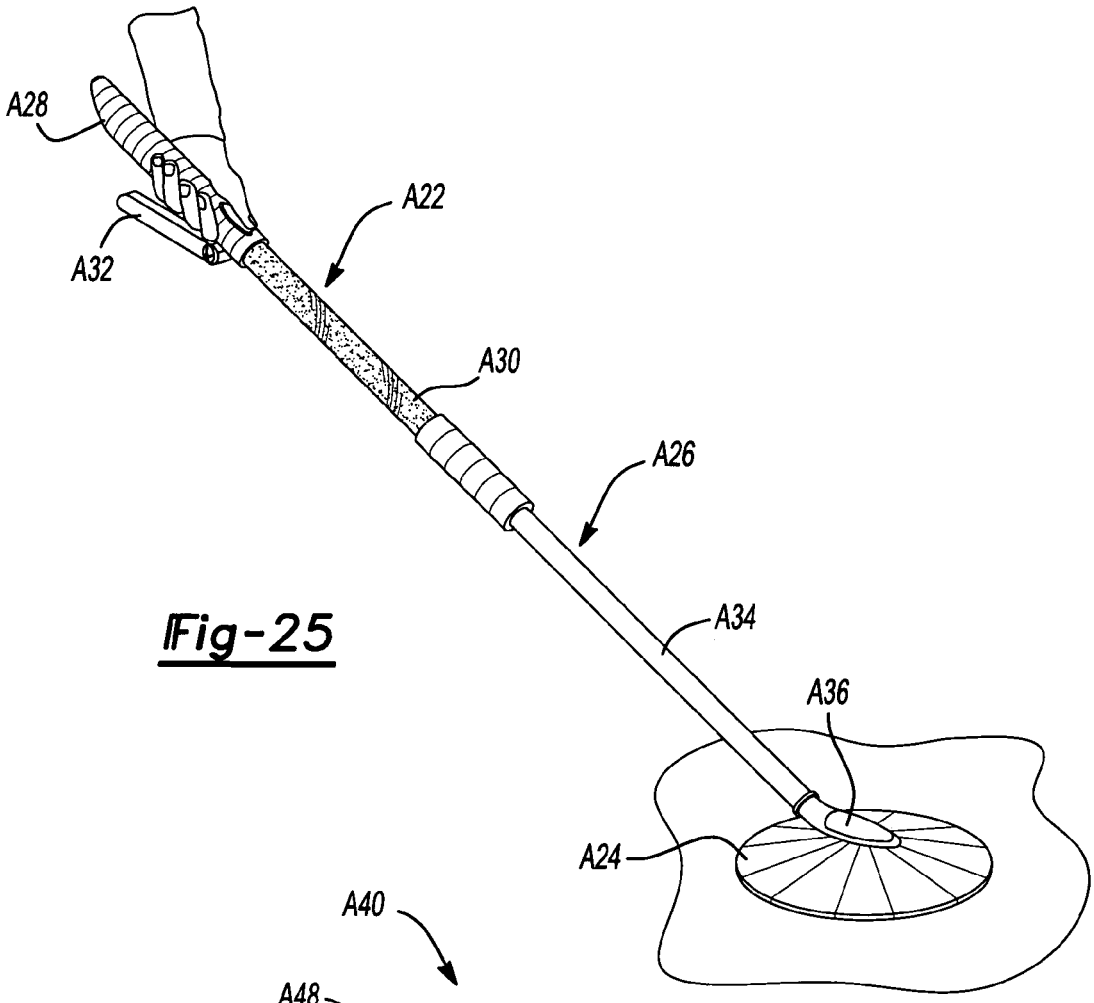
FIG. 25 is a perspective view of another cleaning tool constructed in accordance with the teachings of the present invention.

Referring to FIG. 25, an alternative preferred cleaning tool A22 is shown. The cleaning tool A22 may include a cleaning head A24, an elongated portion A26 and a graspable portion A28 which may be held with a single hand of a user. The elongated portion A26 may include a cleaning fluid/solution reservoir A30 for holding a quantity of cleaning fluid/solution therein. Thus, it will be appreciated that the cleaning fluid/solution could comprise a readily flowable fluid or alternatively a gel or other cleaning solution having a gel-like consistency. A trigger A32 may be used to pump the cleaning fluid/solution held within the reservoir A30 through a neck portion A34 of the elongated handle A26 to the cleaning head A24 where it may be released into a brush A36 of the cleaning head A24 or an area proximate the brush A36. The graspable handle portion A28 may be removable from the reservoir A30, such as by threaded engagement therewith, to allow the cleaning fluid/solution to be replenished as needed.

Figure 26:
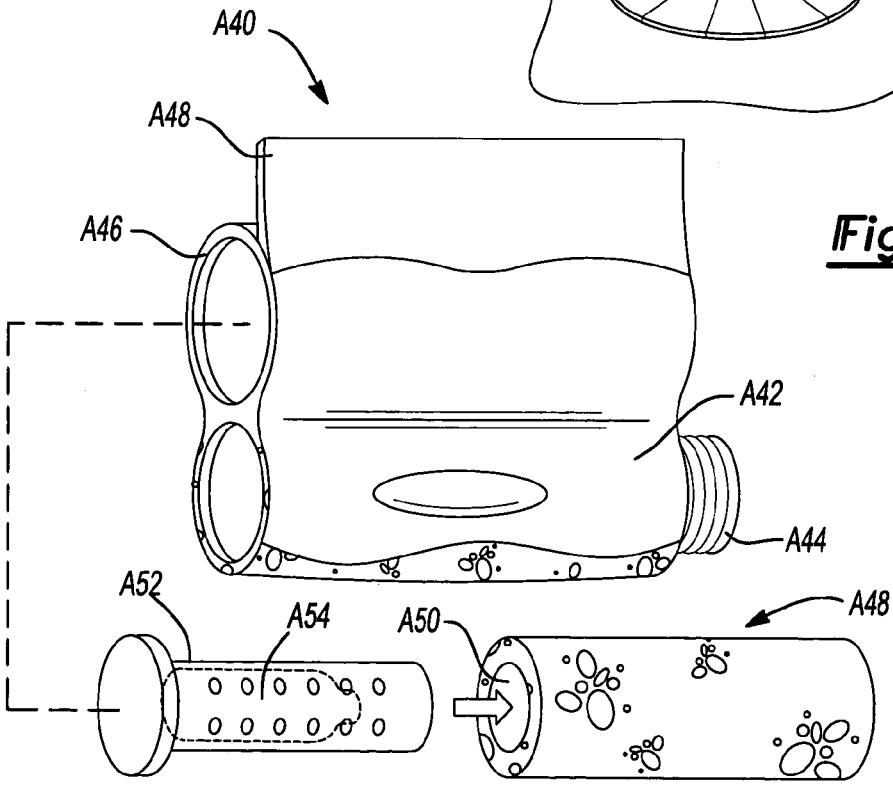
FIG. 26 is an exploded perspective view of another hand held cleaning tool constructed in accordance with the teachings of the present invention, the cleaning tool forming a brush/squeegee cleaning apparatus with a rechargeable DC battery.
Figure 27:
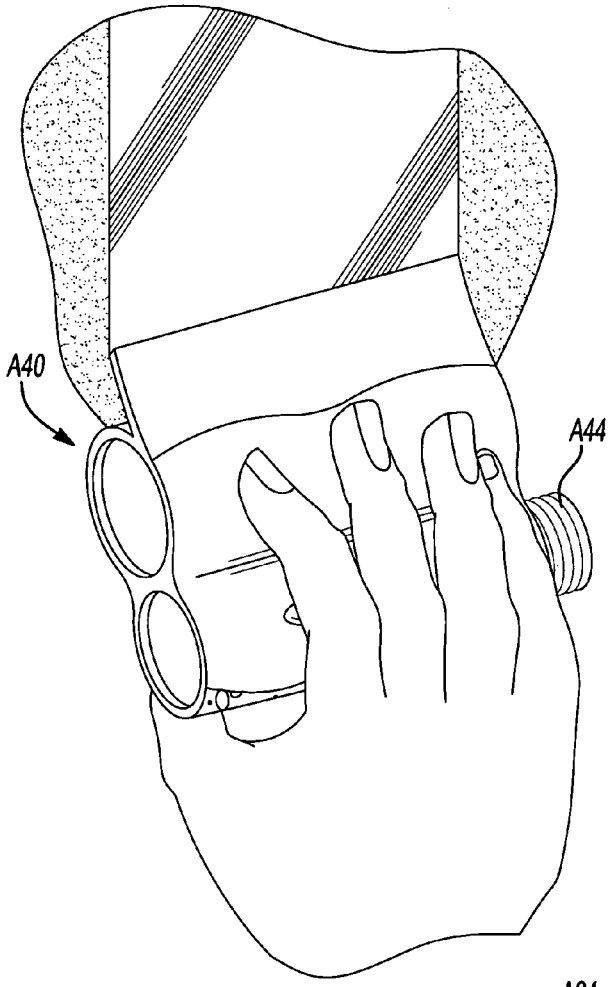
FIG. 27 is a view of the cleaning tool of FIG. 26 in use.

Referring to FIGS. 26 and 27, a cleaning tool A40 in accordance with an alternative preferred embodiment of the present invention is shown. The cleaning tool A40 may include a housing A42 adapted to receive a releasable, rechargeable DC battery A44 for powering an internally disposed motor (not shown). A pad assembly A46 may be driven rotationally by the motor via a suitable drive mechanism. A squeegee A48 may be disposed adjacent the pad assembly A46. Thus, either the pad A46 assembly or the squeegee A48 can be selected for use simply by the user orientating the tool A40 as desired relative to a work surface. The brush assembly A46 may include a replaceable cleaning pad 48 having a cylindrical, interior void 50 into which a reservoir 52 for holding a quantity of cleaning fluid/solution may be inserted therein. The reservoir 52 may include small openings 54 through which the cleaning fluid/solution may flow into the replaceable pad 48 as the pad is driven rotationally by the motor of the tool 40. The tool 40 thus forms a very light weight, easily graspable cleaning implement which can be used especially effectively on windows and other surfaces where both the cleaning brush and a squeegee would typically be used (i.e., especially glass surfaces).

Figure 28:
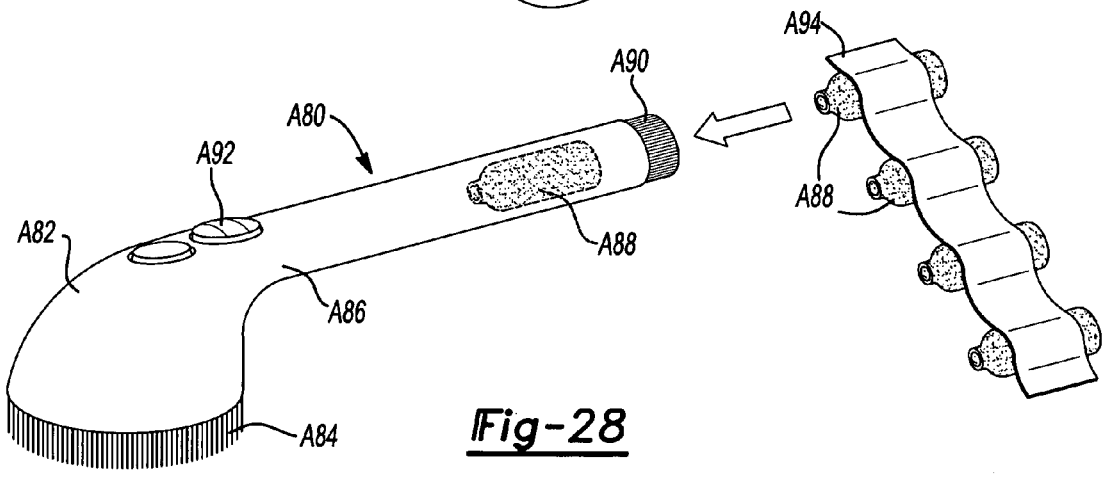
FIG. 28 is a perspective view of another cleaning tool constructed in accordance with the teachings of the present invention incorporating the use of replaceable cleaning fluid/solution cartridges that may be held in a handle portion of the tool.

Referring now to FIG. 28, a cleaning tool A80 in accordance with another alternative preferred embodiment of the present invention is illustrated. The cleaning tool A80 may include a cleaning head portion A82 having a brush A84, a handle portion A86 which may be at least partially hollow, and a cleaning fluid/solution cartridge A88 that may be adapted to be inserted within the handle portion A86. An end cap A90 may be used to hold the cleaning cartridge A88 within the handle portion A86. It will be appreciated that the cleaning cartridge A88 could include an area adapted to be punctured or otherwise pierced by internal structure within the cleaning tool A80 to thus release the contents of the cartridge A88. The cleaning head A82 may further include a control A92 which may be pushed by the user to help dispense fluid into the brush A84. In this regard, it will be appreciated that control A92 may open or close an internally disposed valve, thus allowing the user to control the application of cleaning fluid/solution to the brush A84. The cartridges A88 may be supplied in any appropriate manner, such as in a release strip A94 and packaged in predetermined quantities for sale at the retail level.

Figure 29:
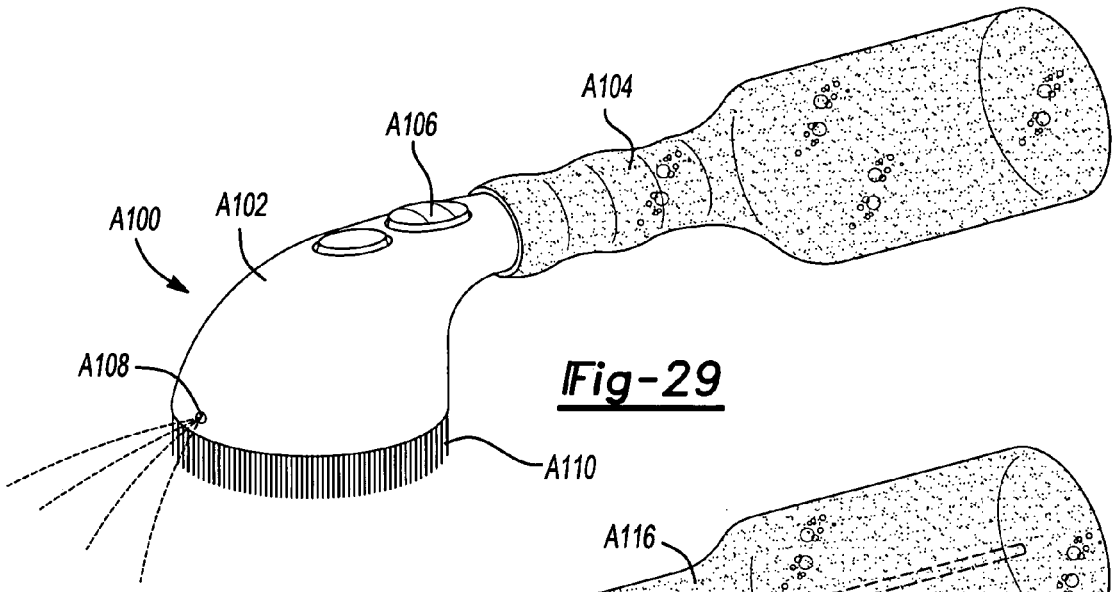
FIG. 29 is a perspective view of another cleaning tool constructed in accordance with the teachings of the present invention incorporating an independent fluid/solution reservoir that is removably attached to an independent cleaning head.

Referring to FIG. 29, a cleaning tool A100 is illustrated which forms a variation of the cleaning tool A80 of FIG. 28. The cleaning tool A100 may include a cleaning head A102, which may be adapted to be removably coupled to a bottle or like element A104 having a quantity of cleaning fluid/solution therein. The cleaning head A102 may be threadably engaged to the element A104, snap-fit coupled together, or coupled by any suitable means that allows quick and easy attachment and removal of the cleaning bottle A104. The user actuatable control A106 may allow the fluid/solution within the bottle A104 to be applied through an orifice A108 at a location that may be just above a scrub brush A110 of the cleaning head A102. Again, control A106 could be used to provide a pumping action to help withdraw fluid from the bottle A104. Advantageously, the bottle A104 functions as a handle for the tool A100.

Figure 30:
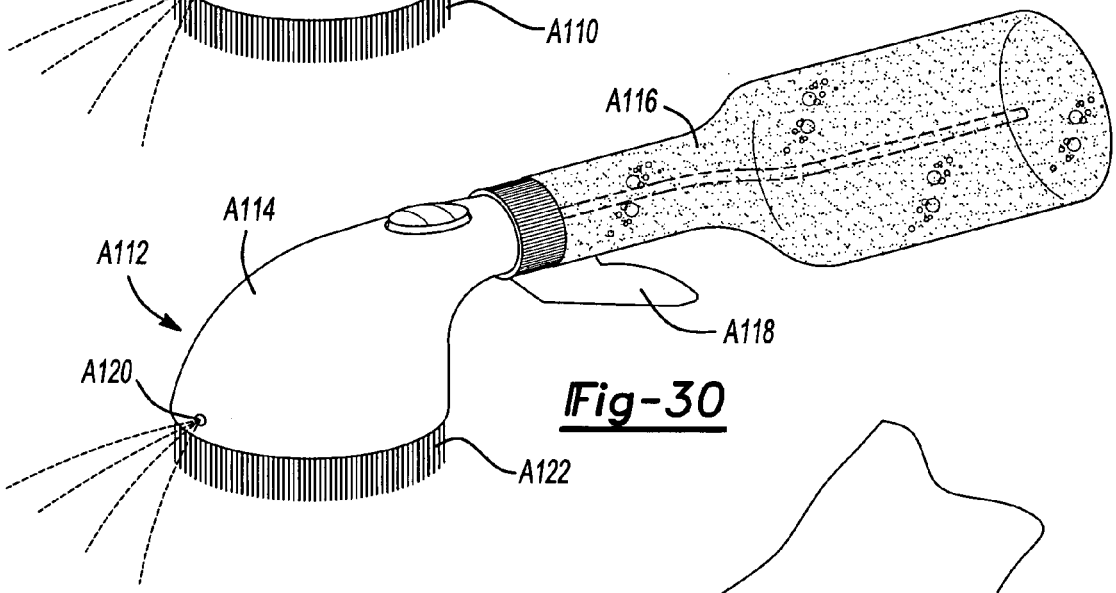
FIG. 30 is a perspective view of a cleaning tool of similar to that of FIG. 29 but incorporating a removable, pump actuated cleaning fluid/solution reservoir.

Referring to FIG. 30, a including tool A112 is shown that forms still another variation of the cleaning tool A80. Cleaning tool A112 may have a cleaning head A114, which may be threadably coupled to a container A116 of cleaning fluid/solution. The container A116 may include a pump lever A118 which can be easily actuated by the user. In this embodiment, as with the cleaning tool A100, a neck portion of the container A116 forms the handle for the cleaning tool. The container A116 further includes a conventional, internal pump mechanism with a pump lever A118 that may be employed to actuate the internal pump mechanism to cause the cleaning fluid/solution to be dispensed. Cleaning fluid/solution may be pumped out of an orifice A120 above a scrub brush or cleaning pad A122 as the user engages the pump lever.

Figure 31:
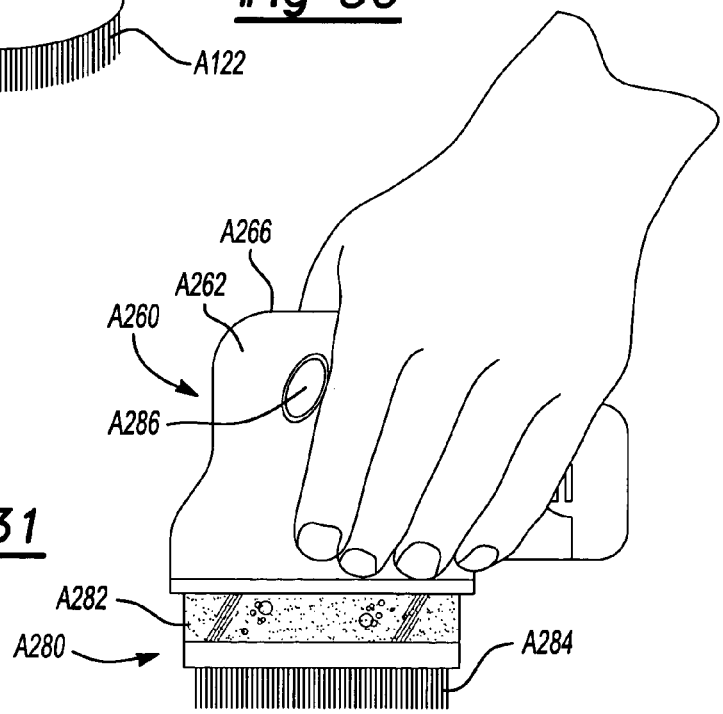
FIG. 31 is a view of another cleaning tool constructed in accordance with the teachings of the present invention, the cleaning tool including a fluid delivery system with a reservoir that is located in an attachment, such as a brush.

Referring now to FIG. 31, still another preferred form of the cleaning tool of the present invention is shown. The cleaning tool A260, which is especially well adapted to be controlled while positioned in the palm of a hand of use, may include a main housing portion A262 and a transversely extending handle portion A264. Handle portion A262 may have a curved upper surface A266 which may be comfortably received by a palm of a hand of the user. Elongated handle portion A264 may receive one or more internally disposed, rechargeable DC batteries A268 which may be secured therein via a releasable cap A270. A motor A272 may be powered by the battery or batteries A268 and may drive a gear reduction assembly A274, which in turn has an output shaft A276 which may be coupled to a cleaning brush assembly A280. The brush assembly A280 may include a cleaning fluid/solution reservoir A282 and a scrub brush A284. A control A286 on the housing portion A262 may be used to apply a pumping action to the reservoir A282 to help release fluid into the brush A284. Alternatively, fluid may be dispensed from the cleaning fluid/solution reservoir A282 as a result of another force or action, such as centrifugal force. The palm shaped surface A266 allows the user to place considerable pressure on the brush A284.

Figure 32:
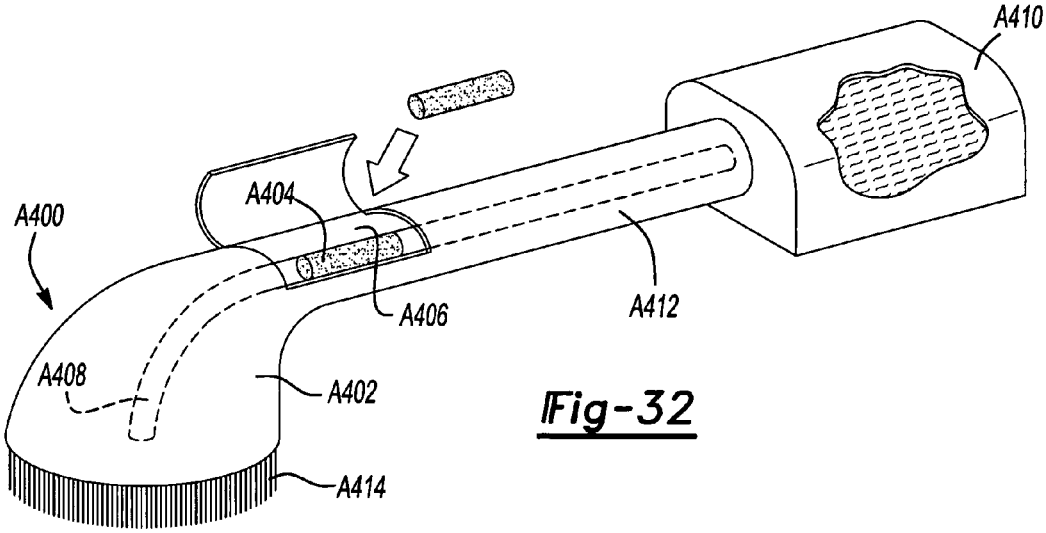
FIG. 32 is a simplified perspective view of still another cleaning tool constructed in accordance with the teachings of the present invention, the cleaning tool being configured to receive a porous solid in a cartridge-like form that is positioned within a fluid path such that fluid passing through the solid dissolves the solid so that the chemicals that in the porous solid may be applied to a cleaning head of the tool.

Referring to FIG. 32, a cleaning tool A400 constructed in accordance with the teachings of the present invention is shown. The cleaning tool A400 may have a cleaning head A402 that may receive a solid cleaning cartridge A404 in a desired area, such as within a recessed area A406. The cleaning cartridge A404 may be generally porous and include any form of concentrated chemical (e.g., a soap or detergent or any other type of chemical that may be used for cleaning, buffing, shining, waxing, etc., which releases the chemical (e.g., by dissolving) gradually as the cleaning cartridge A404 is exposed to fluids. The cleaning cartridge A404 is disposed in a fluid flow path A408 which may be in communication with an associated water source, such as a water reservoir A410 that may be releasably coupled to a neck portion A412 of the tool A400. Fluid from the water source (e.g., the water reservoir A410) thus flows through the flow path A408 and chemical(s) are gradually released by the cleaning cartridge A404 to provide a mixture of water and cleaning solution at a brush A414 thereof. When a given cleaning cartridge A404 is completely used up, then a new clean cartridge A404 can be easily inserted in the recess A406.

Figure 33:
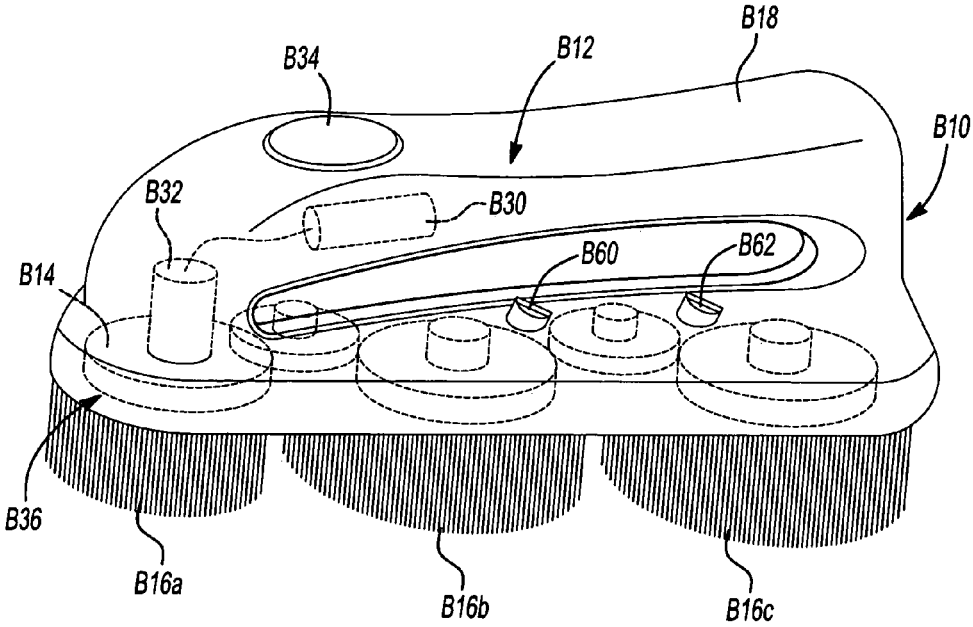
FIG. 33 is a perspective view of another hand-held motorized cleaning tool constructed in accordance with the teachings of the present invention.
Figure 34:
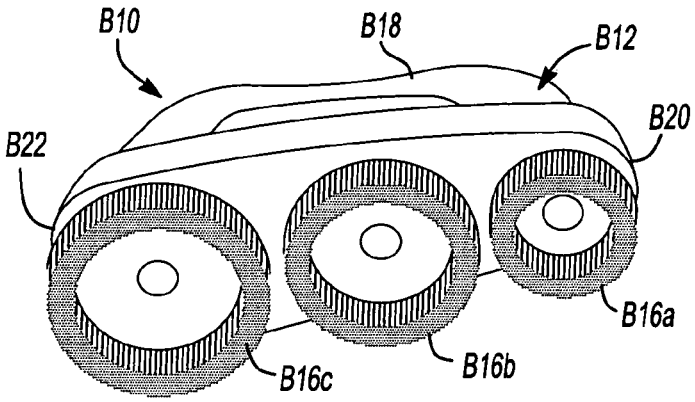
FIG. 34 is a bottom perspective view of the hand-held motorized cleaning tool of FIG. 33.

With reference to FIGS. 33 and 34 of the drawings, another hand-held motorized cleaning tool constructed in accordance with the teachings of the present invention is generally indicated by reference numeral B10. The motorized cleaning tool B10 is illustrated to include a housing B12, a power-and-drive train B14 and a plurality of tool head attachments B16*a*, B16*b* and B16*c*.

The housing B12 defines a handle B18 and operably houses the power-and-drive train B14. The housing B12 has a generally triangular shape in bottom view, with its nose B20 being relatively smaller than its rear end B22. This configuration permits the cleaning tool B10 to access via the nose B20 of the housing B12 relatively tight areas, such as corners, while maintaining the capacity for cleaning relatively large surfaces, such as floors.

The power-and-drive train B14 includes a battery pack B30, a drive motor B32, a power switch B34 and a transmission B36. The motor B32 is electrically coupled to the battery pack B30 via the power switch B34 in a known manner. Due to the conventional nature of such battery packs, a detailed discussion of the battery pack B30 need not be provided herein except to note that the battery pack B30 may include one or more battery cell that may be of any known type. For example, the battery pack B30 may be a discrete and removable unit having one or more nickel-cadmium (NiCd), lead-acid, lithium ion, lithium ion polymer, alkaline or nickel-metal-hydride (NiMH) cells that are rechargeable via a separate charging station, or may be a unit having one or more nickel-cadmium (NiCd), lead-acid, lithium ion, lithium ion polymer, alkaline or nickel-metal-hydride (NiMH) cells that are permanently housed in the housing B12 and rechargeable charger that is wholly or partially housed in the housing, or may include a plurality of conventional commercially available reusable or disposable battery cells, such as lithium or alkaline batteries (e.g., AA, C, D and/or 9V alkaline batteries).

Figure 35:
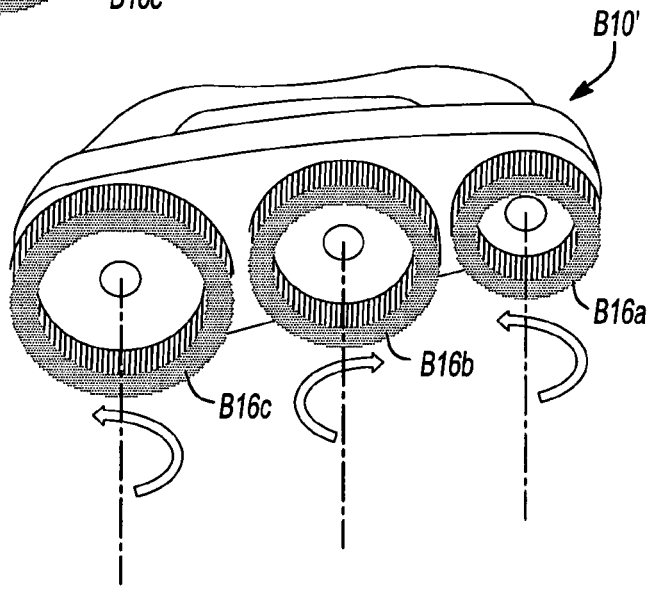
FIG. 35 is a schematic illustration of the transmission of the hand-held motorized cleaning tool of FIG. 33.

With additional reference to FIG. 35, the transmission B36 includes a gear train B40 having an input gear B41 that is coupled for rotation with the output shaft B32*a* of the motor B32. The gear train B40 further includes a first output gear B42, a first idler gear B44, a second output gear B46, a second idler gear B48 and a third output gear B50. An output member B54*a*, B54*b* and B54*c* is coupled for rotation to the output gears B42, B46 and B50, respectively; each output member B54*a*, B54*b* and B54*c* is employed to releasably secure the tool heads B16*a*, B16*b* and B16*c*, respectively, to the transmission B36.

In the particular embodiment illustrated, the transmission B36 further includes a first switch B60 and a second switch B62, which are employed to selectively uncouple the second output gear B46 and the third output gear B50, respectively, from gear train B40 such that one or more of the tool heads B16*b* and B16*c* are placed in a stationary (i.e., unpowered) condition. In the particular example provided, the first switch B60 is coupled to the first idler gear B44 and permits the first idler gear B44 to be translated between a first position, wherein the first idler gear B44 is meshingly engaged to both the first and second idler gears B42 and B46, and a second position, wherein the first idler gear B44 is disengaged from at least one of the first and second idler gears B42 and B46.

Likewise, the second switch B62 is coupled to the second idler gear B48 and permits the second idler gear B48 to be translated between a first position, wherein the second idler gear B48 is meshingly engaged to both the second and third idler gears B46 and B50, and a second position, wherein the second idler gear B48 is disengaged from at least one of the second and third idler gears B46 and B50.

As noted above, the tool heads B16*a*, B16*b* and B16*c* are removably coupled to the output members B54*a*, B54*b* and B54*c*, respectively, such that rotation of an output member causes the associated tool head to rotate. In the particular embodiment illustrated, each of the tool heads B16*a*, B16*b* and B16*c* is a rotary brush, but as those skilled in the art will appreciate, they could alternatively be a pad or sponge-like material of the various types that are well known in the art for use in tasks such as cleaning, polishing and buffing.

Configuration of the cleaning tool B10 in the manner described above permits the user to selectively engage or disengage the third output gear B50 via the second switch B62 or the second and third output gears B46 and B50 via the switch B60 to thereby divert rotary power to the desired tool head or tool heads in a desired manner.

Figure 36:
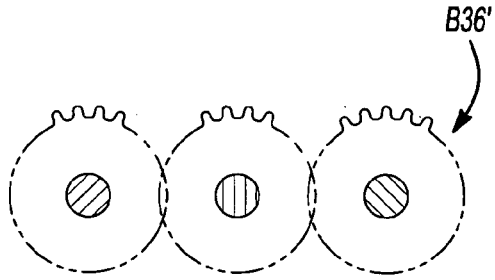
FIG. 36 is a view similar to that of FIG. 34 but illustrating an alternately constructed hand-held motorized cleaning tool.
Figure 37:
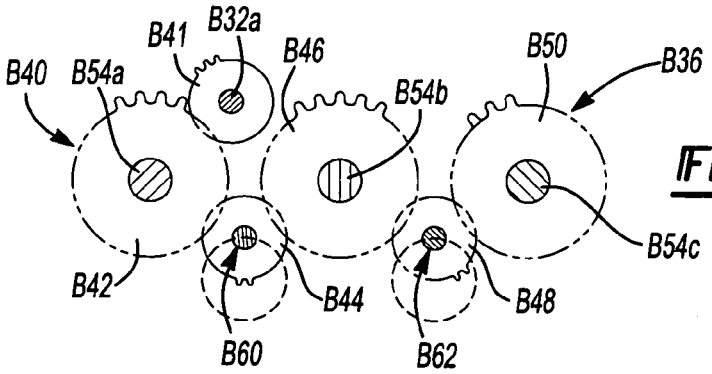
FIG. 37 is a schematic illustration of the transmission of the hand-held motorized cleaning tool of FIG. 36.

In FIGS. 36 and 37, an alternatively constructed cleaning tool B10' is illustrated. The cleaning tool B10' is generally similar to the cleaning tool B10 of FIG. 33, except that the configuration of the transmission B36' is changed somewhat so that the tool head B16*b* rotates in a direction that is opposite that of the tool heads B16*a* and B16*c*. Construction in this manner is advantageous in that the torque produced by the tool heads B16*a* and B16*c* is largely offset by the torque that is produced by the tool head B16*b* to that the cleaning tool B10' is somewhat easier for the user to control. Like the transmission B36 that is illustrated in conjunction with the cleaning tool B10 of FIG. 33, the transmission B36' may optionally include one or more switches (not shown) for selectively disabling one or more of the tool heads B16*a*, B16*b* and B16*c*.

Figure 38:
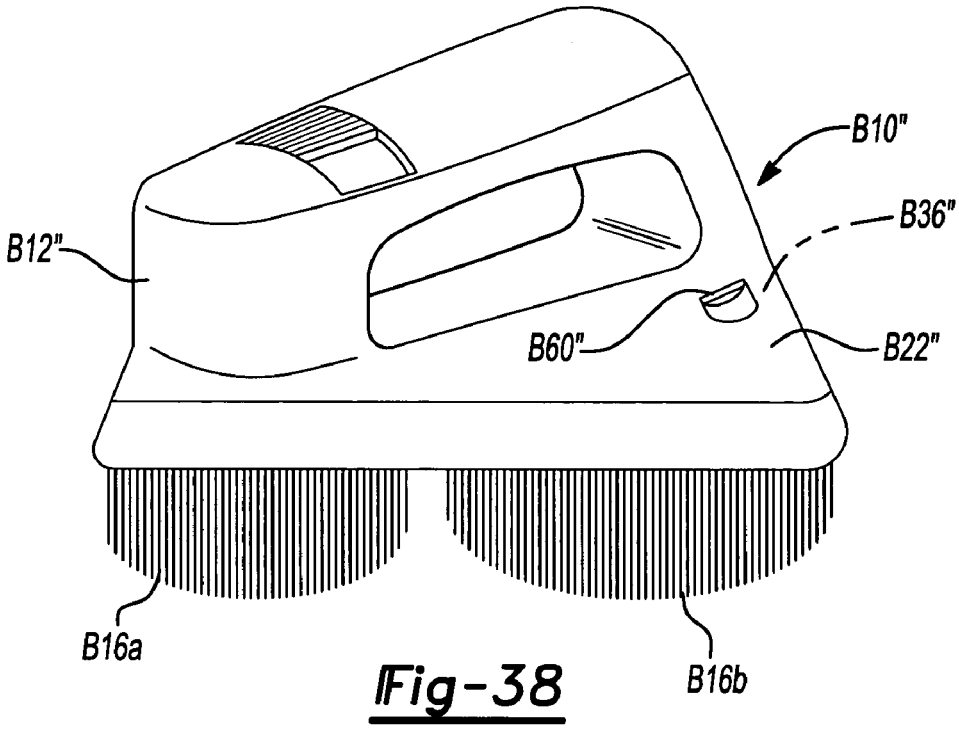
FIG. 38 is a view similar to that of FIG. 33 but illustrating a second alternately constructed hand-held motorized cleaning tool.
Figure 39:
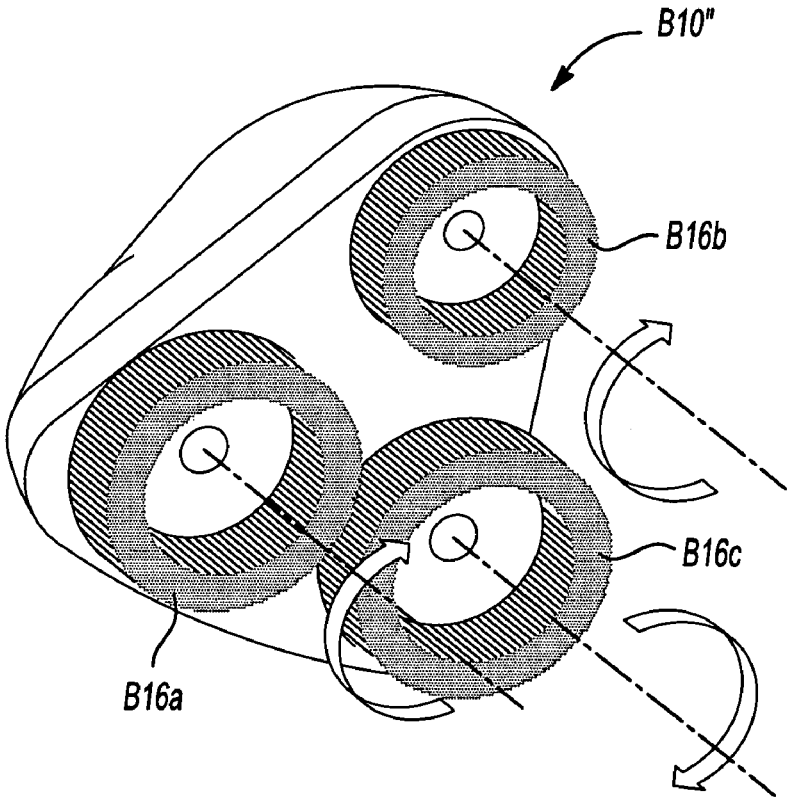
FIG. 39 is a bottom perspective view of the hand-held motorized cleaning tool of FIG. 38.

The cleaning tool B10" illustrated in FIGS. 38 and 39 is also similar to the embodiment illustrated in FIG. 33, except that the housing B12" of the cleaning tool B10" is somewhat shorter in length and wider at its rear end B22" to accommodate the tool heads B16*a*, B16*b* and B16*c* in a triangular arrangement rather than the in-line arrangement that is best illustrated in FIG. 34. In the example illustrated, the transmission B36" includes a single (optional) switch B60" which may be employed to selectively disable the tool heads B16*b* and B16*c*.

Figure 40:
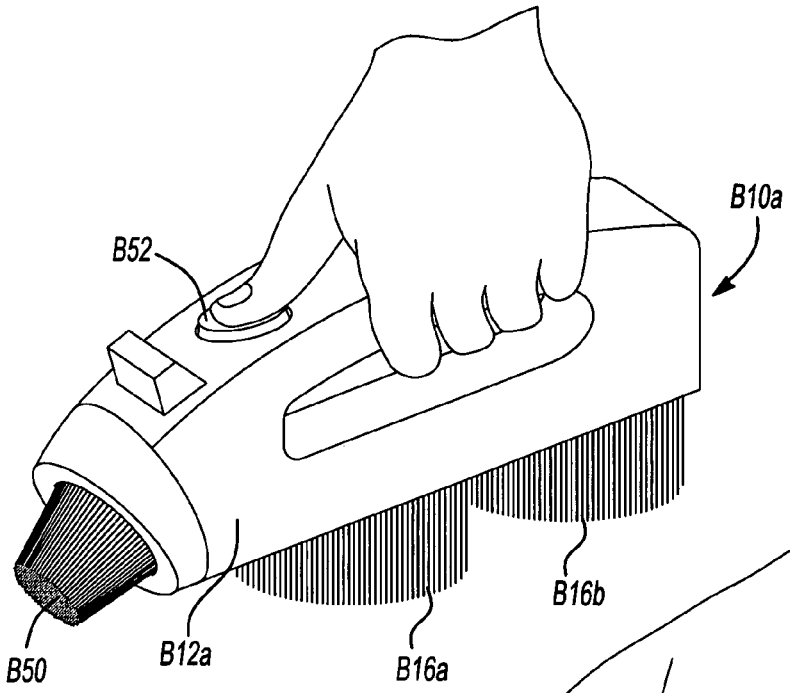
FIG. 40 is a perspective view of another hand-held motorized cleaning tool constructed in accordance with the teachings of the present invention.
Figure 41:
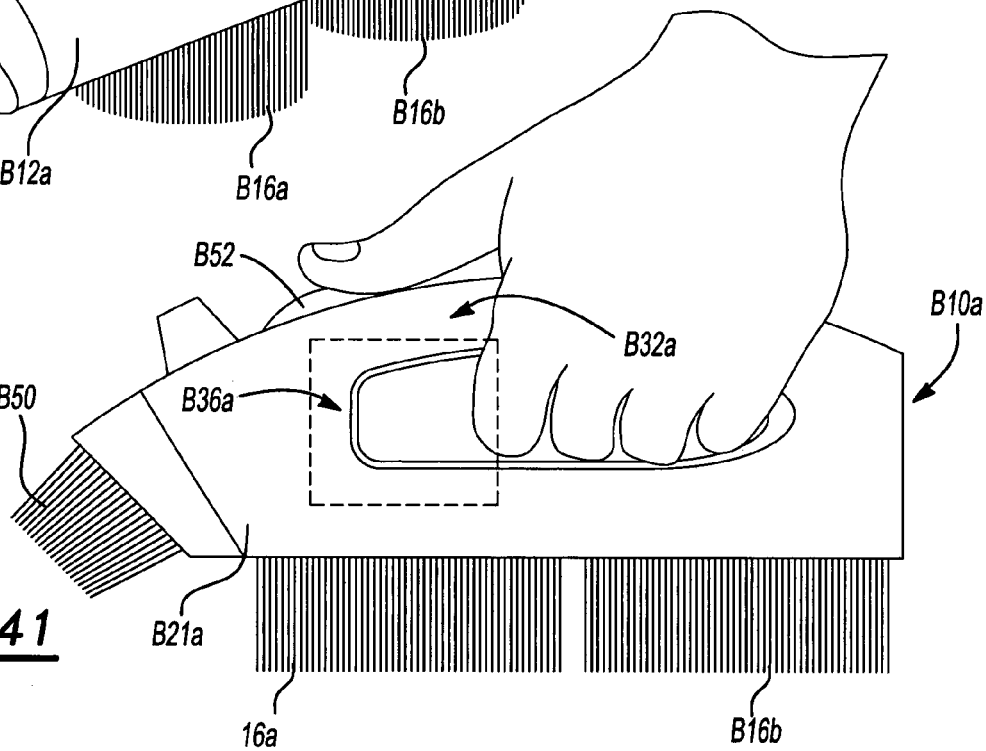
FIG. 41 is a side elevation view of the hand-held motorized cleaning tool of FIG. 40 illustrating the secondary tool head in an extended condition.

In FIGS. 40 and 41, another cleaning tool constructed in accordance with the teachings of the present invention is generally indicated by reference numeral B10*a*. The cleaning tool B10*a* is generally similar to the cleaning tool B10 of FIG. 33 except that it includes a pair of counter-rotating tool heads B16*a* and B16*b*, which are employed for primary or large surface cleaning tasks, and a secondary or detail tool head B50 that may be employed as necessary for detail cleaning.

The secondary tool head B50 is illustrated as being a bristle brush but may alternatively be formed from a pad or sponge-like material of the various types that are well known in the art and employed on tasks such as scrubbing, polishing and buffing. The secondary tool head B50 is slidably housed in the housing B12*a* of the cleaning tool B10*a* and movable via an actuator B52 between an extended position, which is illustrated in FIG. 41, and a retracted position, which is illustrated in FIG. 40.

Figure 42:
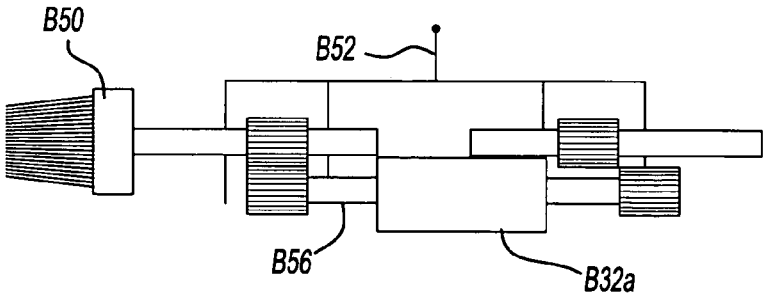
FIG. 42 is a schematic illustration of a portion of the transmission of the hand-held motorized cleaning tool of FIG. 40.
Figure 43:
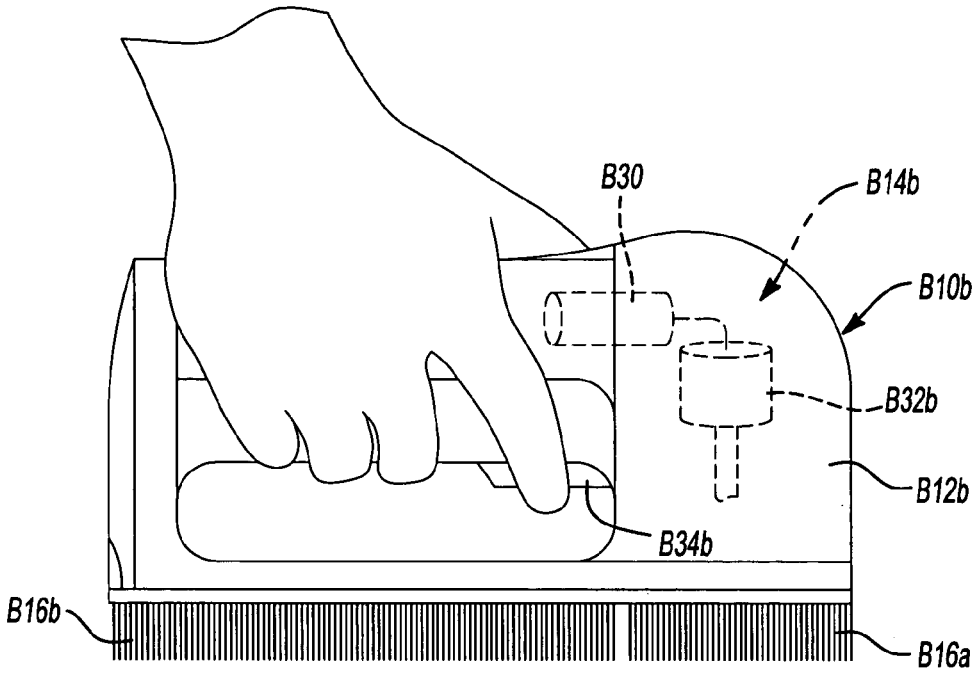
FIG. 43 is a side elevation view of another hand-held motorized cleaning tool constructed in accordance with the teachings of the present invention.
Figure 44:
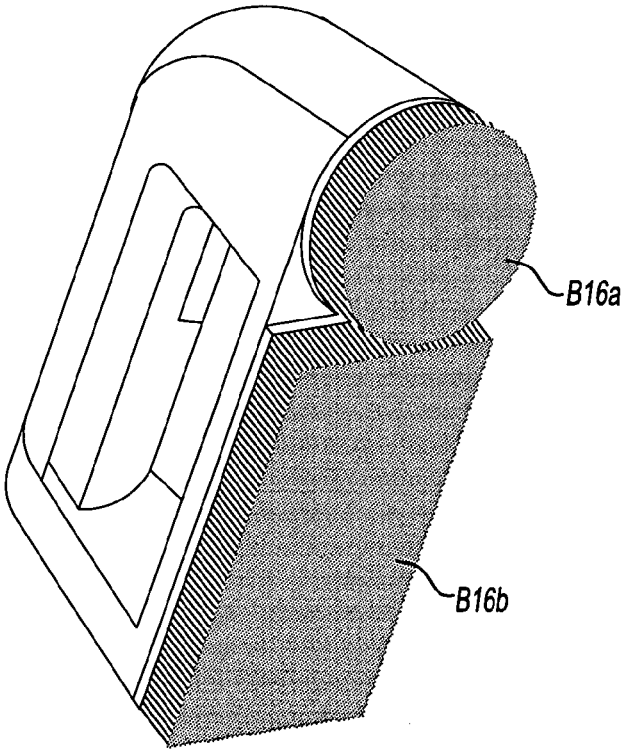
FIG. 44 is a perspective view of the hand-held motorized cleaning tool of FIG. 43.
Figure 45:
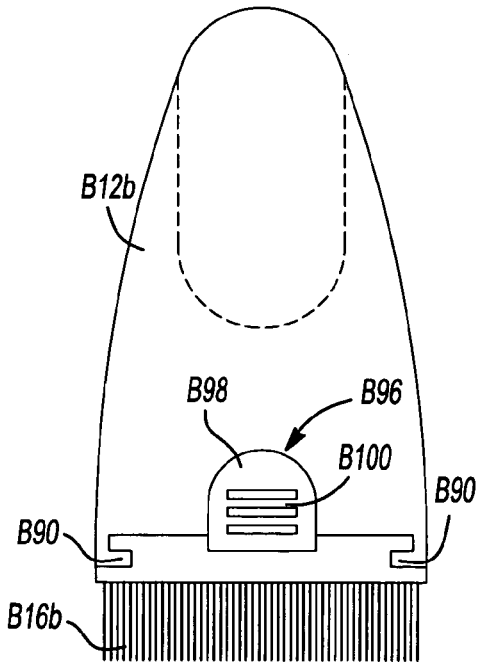
FIG. 45 is a rear elevation view of the hand-held motorized cleaning tool of FIG. 43.
Figure 46:
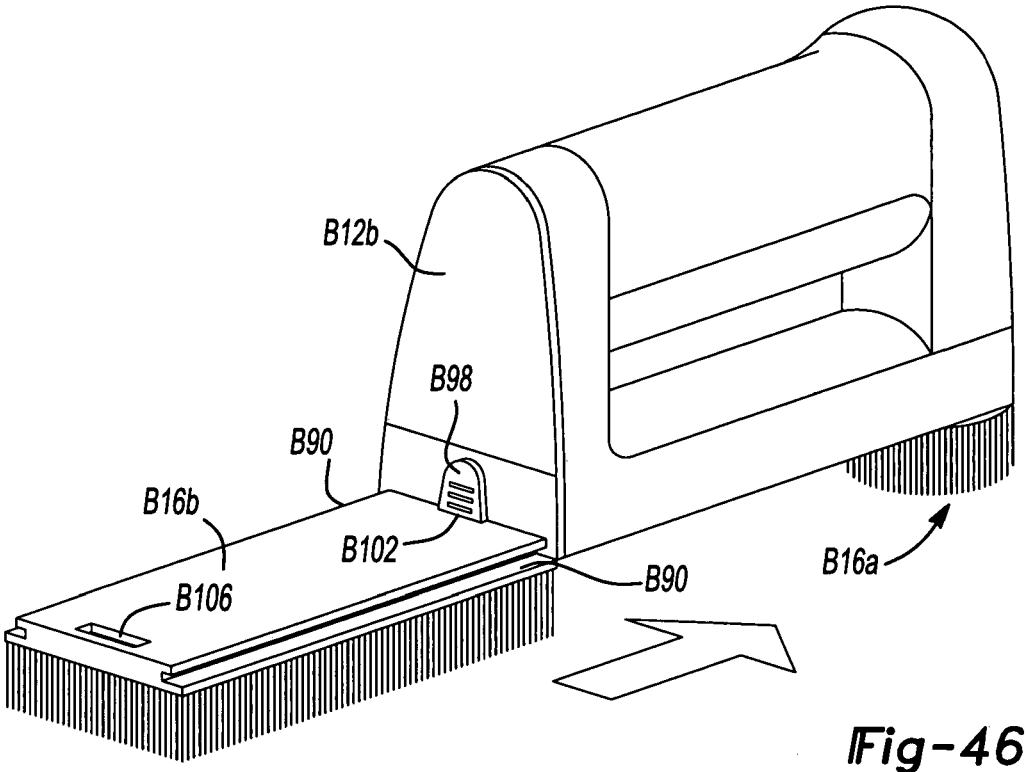
FIG. 46 is a perspective view of the hand-held motorized cleaning tool of FIG. 43 illustrating the loading of a tool head to the housing.

In its simplest form, neither the motor B32*a* nor the transmission B36*a* is coupled to the secondary tool head B50 and the user of the cleaning tool B10*a* is therefore required to manually reciprocate the secondary tool head B50 on a work surface to perform the desired detail cleaning task. With additional reference to FIG. 42, the actuator B52 may also be operable for selectively coupling (and uncoupling) the secondary tool head B50 to the output shaft B56 of the motor B32*a* to thereby provide the secondary tool head B50 with a source of rotary power. Preferably, the actuator B52 also simultaneously uncouples (and re-couples) the remainder of the transmission B36*a* from the output shaft B56 so that the tool heads B16*a* and B16*b* are maintained in an unpowered state while the secondary tool head B50 is being employed.

In FIGS. 43 through 46, another cleaning tool constructed in accordance with the teachings of the present invention is generally indicated by reference numeral B10*b*. The cleaning tool B10*b* includes a housing B12*b*, a first tool head B16*a*, a second tool head B16*b* and a power-and-drive train B14*b* that is housed in the housing B12*b* and which includes a battery pack B30, a motor B32*b* and power switch B34*b* for selectively operating the motor B32*b*.

The first tool head B16*a* is configured to receive a rotational input that is provided by the motor B32*b* and may be a brush, pad or sponge-like material of a type that is well known in the art and employed for tasks such as scrubbing, polishing and buffing. The first tool head B16*a* may be coupled to the power-and-drive train B14*b* by any appropriate means, but is preferably removably coupled thereto with VELCRO®.

The second tool head B16*b* may be a brush, pad or sponge-like material of a type that is well known in the art and employed for tasks such as scrubbing, polishing and buffing and need not be identical in configuration to that of the first tool head B16*a*. The second tool head B16*b* is configured to be received between a pair of laterally spaced-apart guide rails B90 that are formed in the housing B12*b*. The guide rails B90 cooperate to fix the second tool head B16*b* laterally relative to the housing B12*b*, while a latch B96 is employed to fix the second tool head B16*b* longitudinally relative to the housing B12*b*. The latch B96 includes a locking tab B98 that is biased downwardly away from the housing B12*b*. The locking tab B98 includes a tactile portion B100, which is configured to be engaged by the finger or thumb of the user to push the locking tab B98 upwards when loading or unloading the second tool head B16*b* to the guide rails B90 (illustrated in FIG. 46), and an engagement portion B102, which is configured to engage a corresponding slot or aperture B106 (FIG. 46) that is formed into the second tool head B16*b* when the locking tab B98 is biased in a downward position.

Figure 47:
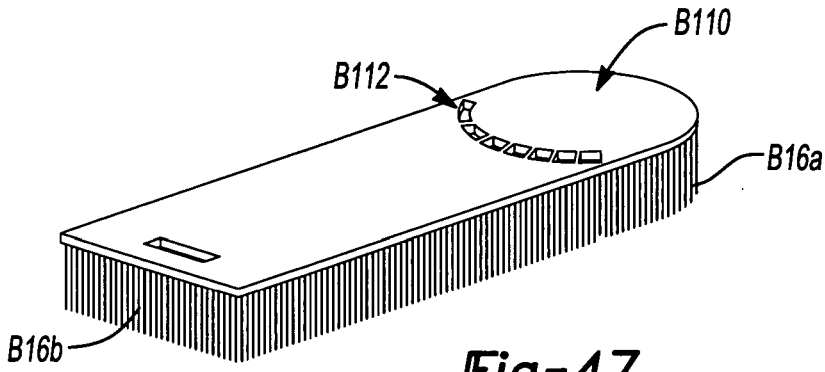
FIG. 47 is a perspective view of an alternately constructed tool head for the hand-held motorized cleaning tool of FIG. 43.
Figure 48:
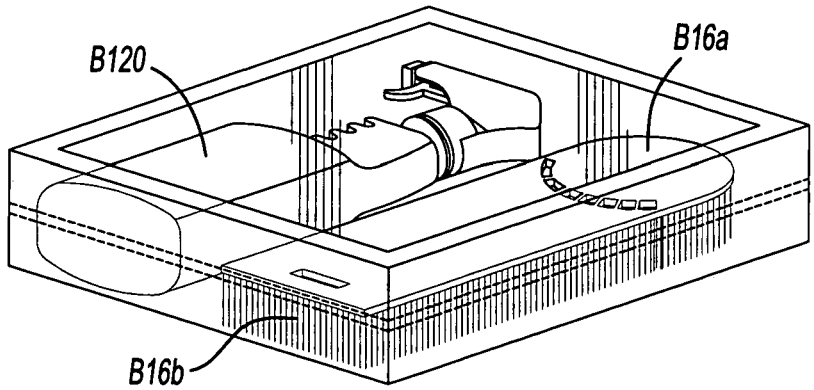
FIG. 48 is a perspective view of the alternately constructed tool head of FIG. 47 as packaged with a cleanser or cleaner.
Figure 49:
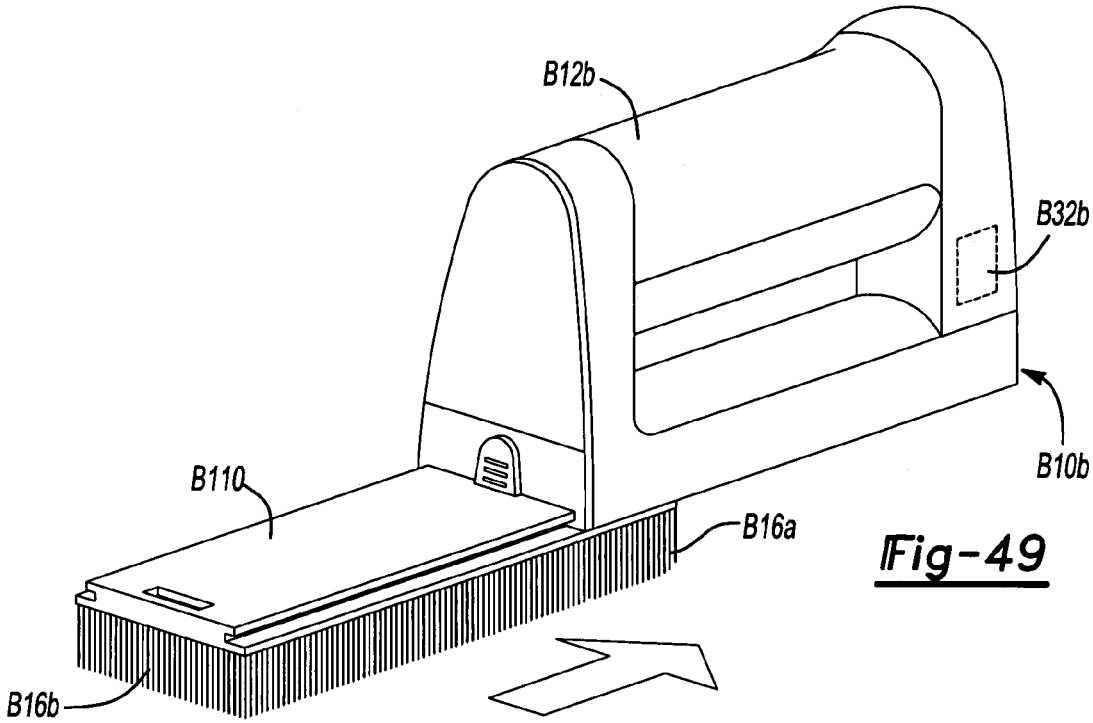
FIG. 49 is a perspective view illustrating the loading of the alternately constructed tool head to the hand-held motorized cleaning tool of FIG. 43.

With reference to FIGS. 47 through 49, the first and second tool heads B16*a* and B16*b* may be formed as a unit with a common base or backer B110. In the particular example provided, the backer B10 includes a plurality of perforations B112 that serve to delineate the first and second tool heads B16*a* and B16*b*. While the user of the cleaning tool B10*b* may separate the first and second tool heads B16*a* and B16*b* from one another prior to their installation to the housing B12*b*, the user may, in the alternative, load the tool heads B16*a* and B16*b* as a unit through the rear end B22*b* of the housing B12*b* and thereafter operate the cleaning tool B10*b* (i.e., operate the motor B32*b*) so as to rotate the first tool head B16*a* and tear the portion of the backer B110 between the perforations B112.

FIG. 48 illustrates the packaging of the tool heads B16*a* and B16*b* with a suitable commercially available cleaner or cleanser B120. In this embodiment, the amount of cleaner or cleanser B120 that is packaged with the tool heads B16*a* and B16*b* is tailored to match the lifespan of the first and second tool heads B16*a* and B16*b* such that one or both of the tool heads B16*a* and B16*b* are worn out by the time the contents of the bottle of cleaner or cleanser B120 are used.

Figure 50:
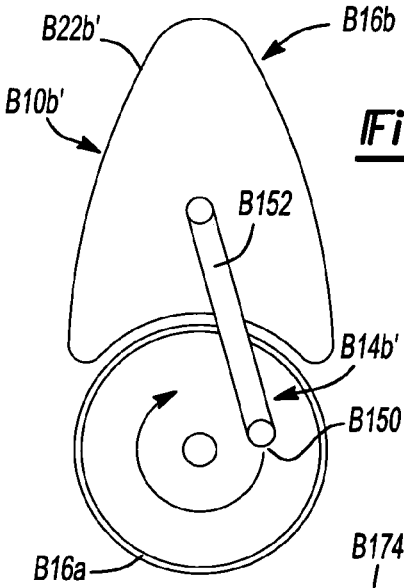
FIG. 50 is a schematic view of an alternately constructed hand-held motorized cleaning tool that is similar to the hand-held motorized cleaning tool of FIG. 43.

FIG. 50 schematically illustrates an alternately configured cleaning tool B10*b*' having a somewhat different power-and-drive train B14*b*' that provides the tool head B16*a* with a source of rotary power and provides the tool head B16*b* with a source of reciprocating power via a conventional rotating cam B150 and linkage B152. In this embodiment, the tool head B16*b* is pointed at its rear end B22*b*' so as to more easily fit into corners and perform detail cleaning tasks.

Figure 51:
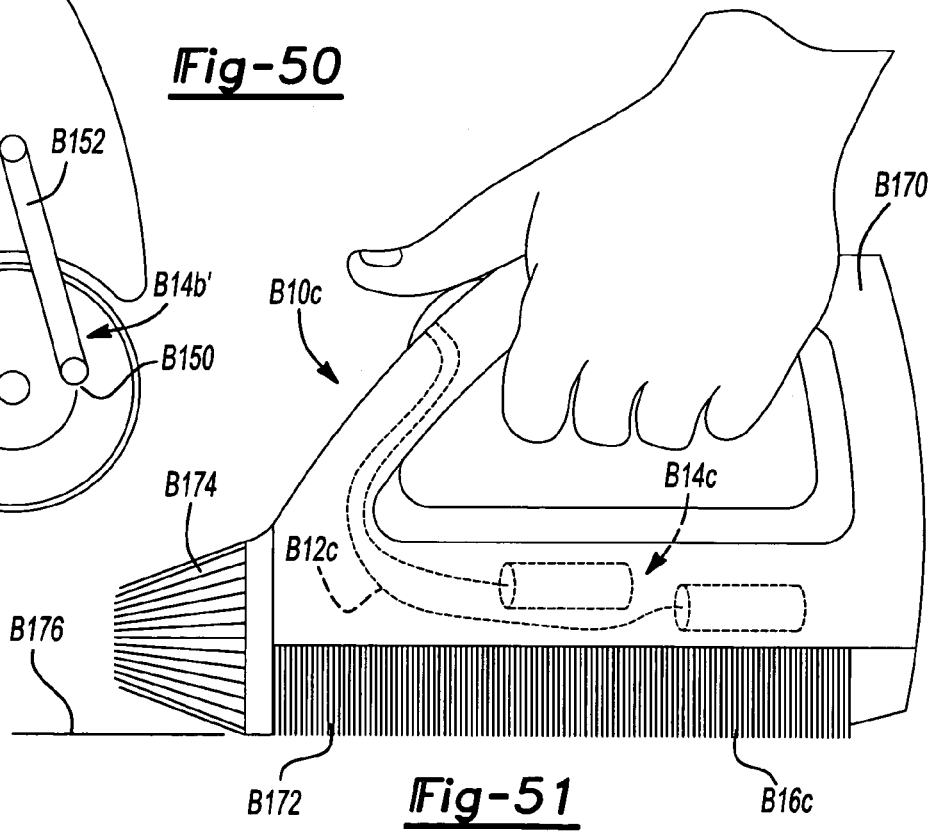
FIG. 51 is a side elevation view of another hand-held motorized cleaning tool constructed in accordance with the teachings of the present invention.
Figure 52:
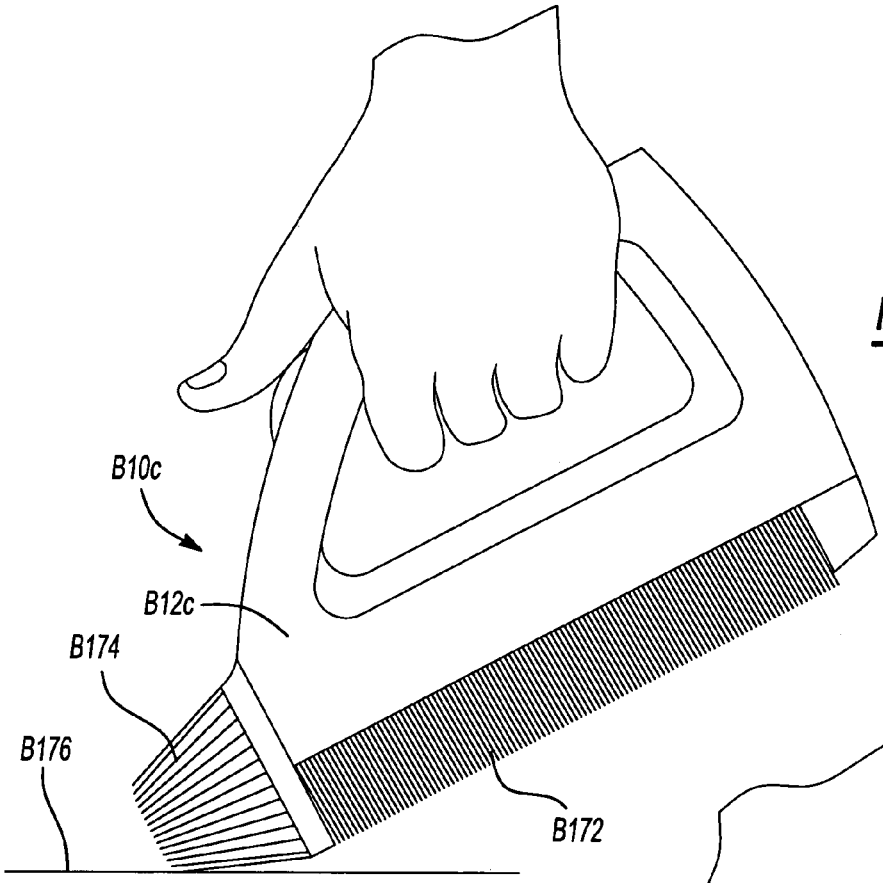
FIG. 52 is a perspective view of the hand-held motorized cleaning tool of FIG. 51.
Figure 53:
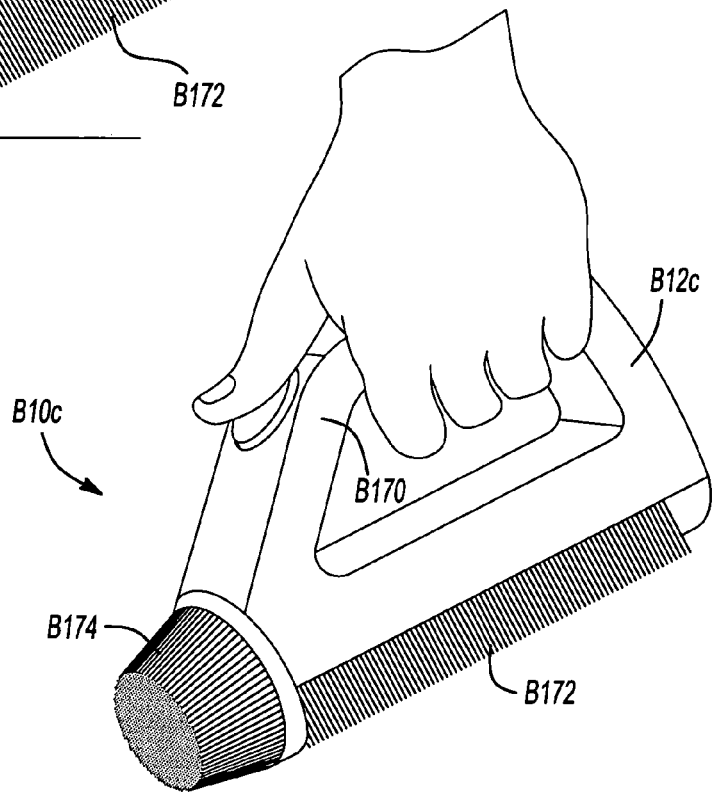
FIG. 53 is a perspective view of the hand-held motorized cleaning tool of FIG. 51.

In FIGS. 51 through 53, another cleaning tool constructed in accordance with the teachings of the present invention is generally indicated by reference numeral B10*c*. The cleaning tool B10*c* includes a D-handle housing B12*c*, a power-and-drive train B14*c* and a single, cylindrical tool head B16*c* that is mounted for rotation along an axis that is generally parallel to a handle B170 that is defined by the housing B12*c*.

The tool head B16*c* includes a first or large surface portion B172 and a second or detail portion B174. The first portion B172 may be a brush, pad or sponge-like material of a type that is well known in the art and employed for tasks such as scrubbing, polishing and buffing. The second portion B174 may also be a brush, pad or sponge-like material of a type that is well known in the art and employed for tasks such as scrubbing, polishing and buffing and may be different than the first portion B172 to provide, for example, more or less aggressive cleaning capabilities. In the particular embodiment provided, the first portion B172 is made of a sponge-like material, while the second portion B174 is made of a mildly abrasive pad-like material, such as SCOTCH-BRITE®, which is manufactured by the Minnesota Mining and Manufacturing Company. The second portion B174 is defined by a spherical radius that is generally smaller than the radius that defines the cylindrically shaped first portion B172 so as to avoid undesired contact between the second portion B174 and the work surface B176. Alternatively, the radii that define the first and second portions B172 and B174 may similarly sized, especially if the first and second portions B172 and B174 are made of similar materials. Also alternatively, the second portion B174 may include, for example, a plurality of bristles that are oriented generally parallel to the rotational axis of the tool head B16*c*.

Figure 54:
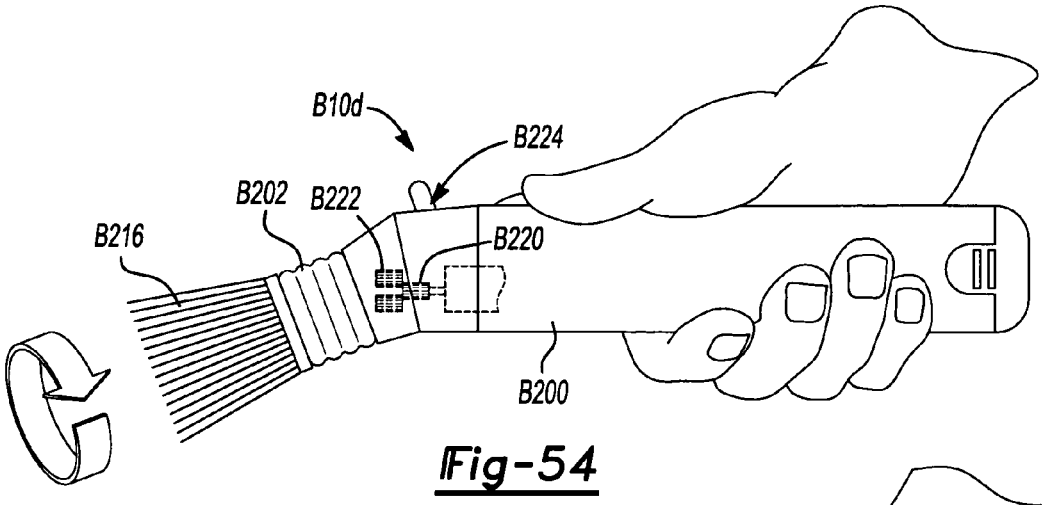
FIG. 54 is a side elevation view of another hand-held motorized cleaning tool constructed in accordance with the teachings of the present invention.

In FIG. 54, another cleaning tool constructed in accordance with the teachings of the present invention is generally indicated by reference numeral B10*d*. The cleaning tool B10*d* is illustrated to include a power-and-drive unit B200, a removable head B202 and a tool head B216, which is illustrated to be a rotary brush B218. The power-and-drive unit B200 includes an output member B220 that is received and meshingly engages an input member B222 of the removable head B202. A conventional latch B224 is employed to retain the removable head B202 to the power-and-drive unit B200. The interface between the power-and-drive unit B200 an the removable head B202, as well as the construction and operation of the latch B224, are similar to those that are commercially available and known in the art as is evidenced by U.S. Pat. Nos. 6,263,980; 6,206,107; 6,176,322; 6,170,579; and 6,153,838, the disclosures of which are hereby incorporated by reference as if fully set forth herein.

Figure 55:
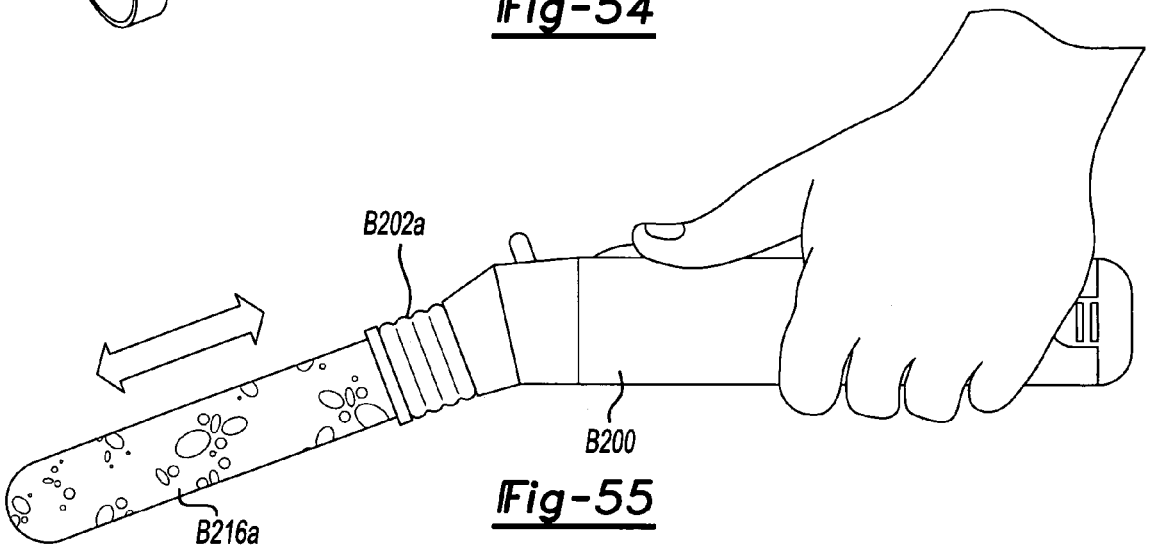
FIGS. 55 and 56 are side elevation views similar to that of FIG. 54 but illustrating the employment of alternate removable heads and tool heads.
Figure 56:
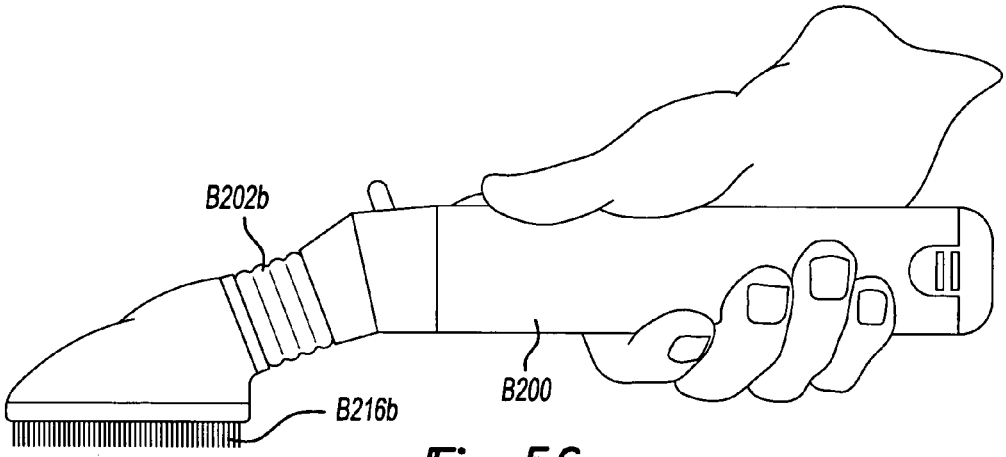

With additional reference to FIGS. 55 and 56, a second removable head B202*a* and a third removable head B202*b*, respectively, are illustrated in operative association with the power-and-drive unit B200. The second removable head B202*a* is operable for converting the rotational input that is provided by the power-and-drive unit B200 into reciprocating motion. The tool head B216*a* that is attached to the second removable head B202*a* may be a brush, a sponge or a pad-like material of the types that are well known in the art for tasks such as scrubbing, buffing or polishing.

The third removable tool head B202*b* has a generally triangular shape and is configured to provide a reciprocating output. Like the second removable tool head B202*a*, the third removable tool head B202*b* may be employed for powering a brush, a sponge or a pad-like material of the types that are well known in the art for tasks such as scrubbing, buffing or polishing. The nose B250 of the third removable tool head B202*b* is configured to provide access in relatively tight areas, such as corners. Although the third removable tool head B202*b* has been illustrated and described as being generally triangular in shape and providing a reciprocating output, those skilled in the art will appreciate that it may be configured somewhat differently in the alternative. For example, the third removable tool head B202*b* may have a round shape and be configured to provide a rotational output similar to the removable tool head B202, but otherwise in a different orientation that may be better suited from an ergonomic perspective for some tasks than the removable tool head B202. Construction in this manner permits the user to select a removable tool head that not only fits into a desired area but which is also more tailored to accommodate the various human factors that are associated with a given cleaning task.

Figure 57:
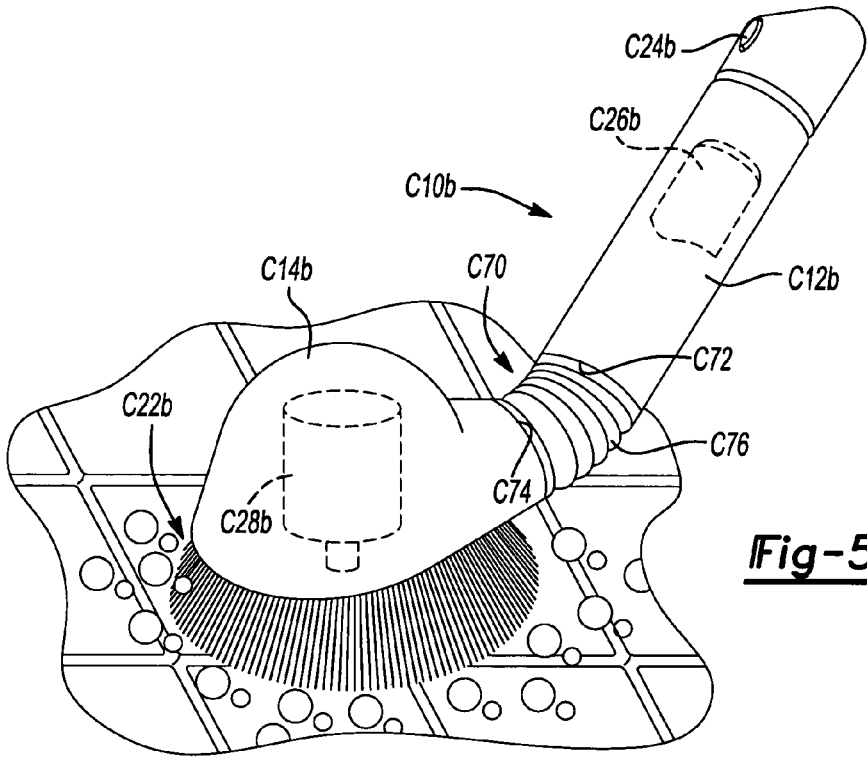
FIG. 57 is a perspective view of another cleaning tool constructed in accordance with the teachings of the present invention.
Figure 58:
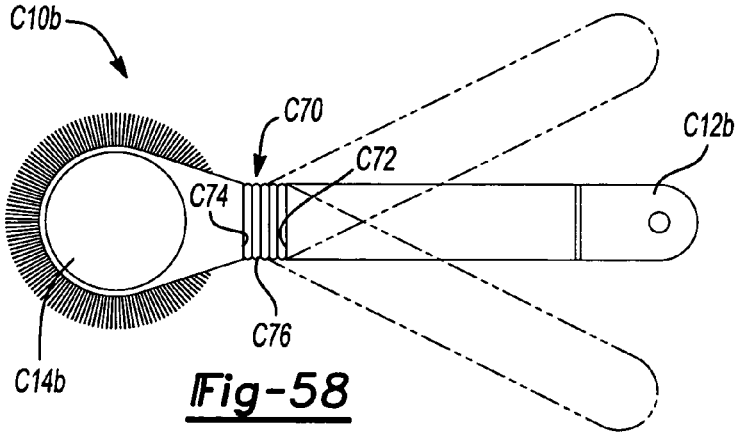
FIG. 58 is a top plan view of the cleaning tool of FIG. 57.
Figure 59:
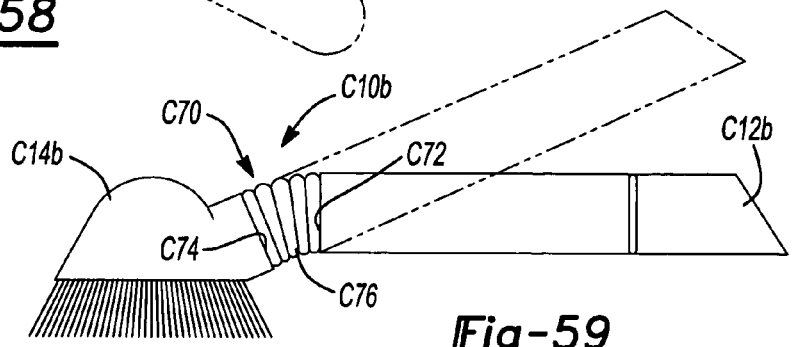
FIG. 59 is a side elevation view of the cleaning tool of FIG. 57.

In FIGS. 57 through 59, another hand-held cleaning tool constructed in accordance with the teachings of the present invention is generally indicated by reference numeral C10*b*. The cleaning tool C10*b* includes a handle portion C12*b* and a head portion C14*b*, which are interconnected by a flexible joint C70. In the example provided, the handle portion C12*b* operably houses a rechargeable battery C26*b* and a power switch C24*b*, while the head portion C14*b* houses an electric motor C28*b* that is configured to provide a rotational output for powering the tool head C22*b*, which may be a brush, sponge or pad-like material of the types that are well known in the art for tasks such as cleaning, scrubbing, buffing, polishing and waxing.

In the example provided, the flexible joint C70 includes a first portion C72, which is fixedly coupled to the handle portion C12*b*, a second portion C74, which is fixedly coupled to the head portion C14*b*, and an intermediate portion C76, which pivotably couples the first and second portions C72 and C74 to one another. The intermediate portion C76 is similar to a conventional universal joint but includes a plurality of detents (not shown). The detents, upon engagement, serve to resist movement of the first and second portions C72 and C74 relative to one another. When a force in excess of a predetermined threshold is applied to the flexible joint C70, however, the detents are disengaged to permit the position of the first and second portions C72 and C74 to be selectively adjusted relative to one another.

Advantageously, the incorporation of the detents into the flexible joint C70 aids the user to limit the force that is applied by the user to the cleaning tool C10*b*, since the application of a force that exceeds the predetermined threshold will cause the first and second portions C72 and C74 to be repositioned relative to one another. In this regard, the predetermined force may be sized so as to prevent the user from applying a force to the handle portion C12*b* that would drain the rechargeable battery C26*b* too rapidly or which would cause undue wear to either the motor C28*b* or the tool head C22*b*. Alternatively, a lock or latch may be used to releasably fix the first and second portions C72 and C74 to one another.

Figure 60:
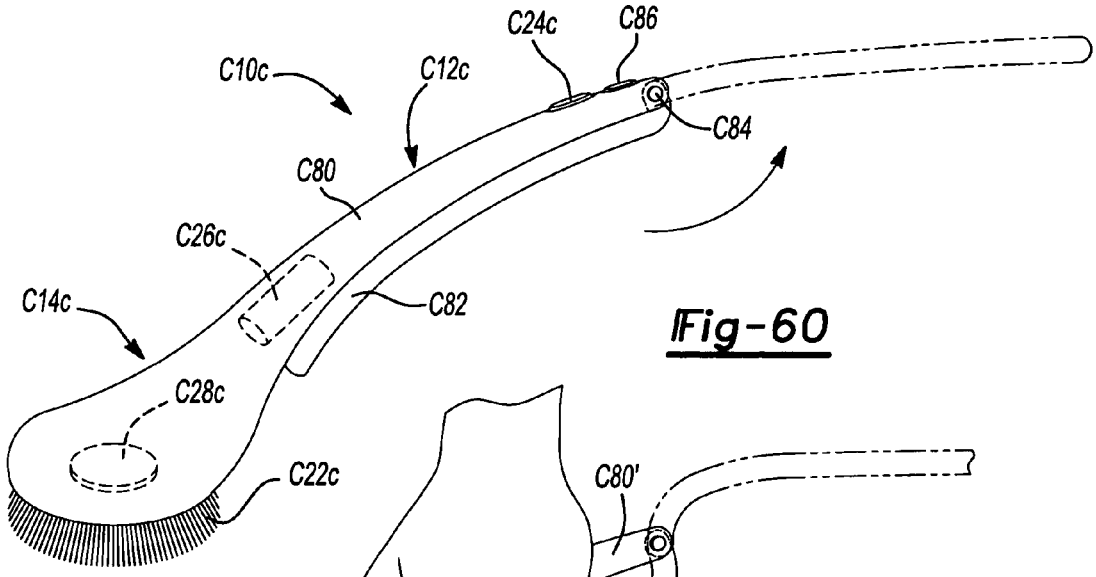
FIG. 60 is a side elevation view of another cleaning tool constructed in accordance with the teachings of the present invention.

In the embodiment of FIG. 60, another cleaning tool constructed in accordance with the teachings of the present invention is generally indicated by reference numeral C10*c*. The cleaning tool C10*c* includes a handle portion C12*c* that is fixedly coupled to a head portion C14*c*. The handle portion C12*c* houses a rechargeable battery C26*c* and a power switch C24*c*, while the head portion C14*c* houses a motor C28*c* that is employed to provide rotary power for a tool head C22*c*. As with the tool heads of the above described cleaning tools, the tool head C22*c* may be a brush, sponge or pad-like material of any of the various types that are known in the art for tasks such as scrubbing, cleaning, polishing, buffing and/or waxing.

The handle portion C12*c* includes a first portion C80 and a second portion C82 that are pivotally coupled via a hinge C84. The hinge C84 permits the second portion C82 to be moved between a folded condition (shown in solid line) and an extended condition (shown in phantom line). In the example provided, a spring (not shown) biases the second portion C82 toward the folded condition and a latch C86 is employed to inhibit rotation of the second portion C82 so as to retain the second portion C82 in the extended condition. Alternatively, the spring may be omitted and the latching configuration changed to latch the second portion C82 into the both the folded and extended conditions. In this regard, a second latch may be employed to releasably couple the second portion C82 to the first portion C80 when the second portion C82 is placed in the folded condition or a two-position latch may be substituted for the latch C86.

Figure 61:
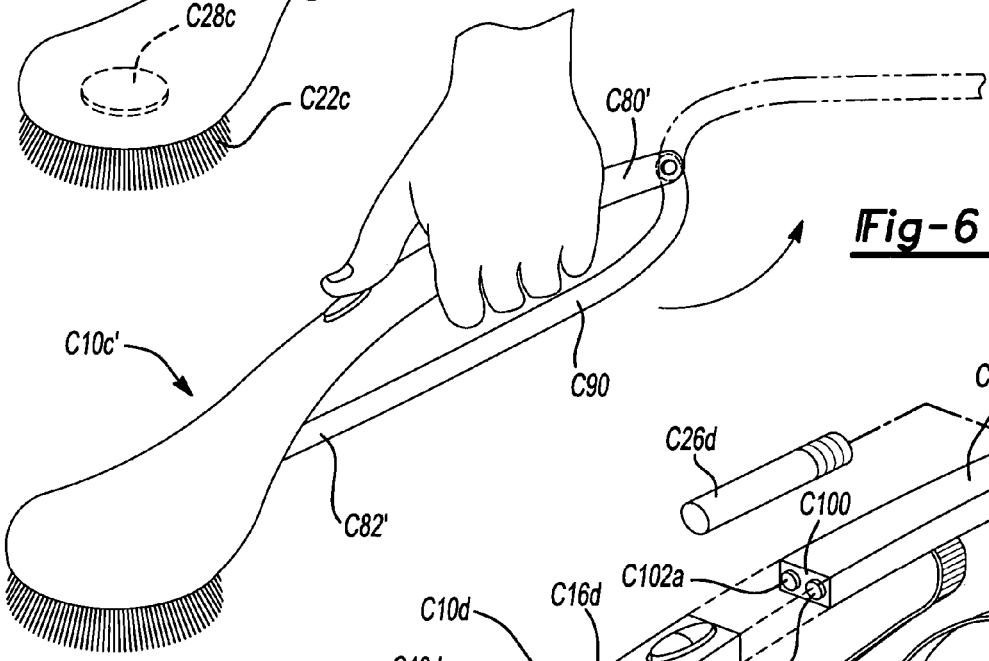
FIG. 61 is a side elevation view similar to FIG. 60 but illustrating an alternately constructed cleaning tool.

In FIG. 61, an alternate embodiment of the cleaning tool C10*c*' is illustrated. The cleaning tool C10*c*' is generally similar to the cleaning tool C10*c*, except that the second portion C82' is arcuate in shape so as to form a hand guard C90 when the second portion C82' is placed in the folded condition. This spacing apart of the first and second portions C80' and C82', respectively, when the second portion C82' is placed in the folded condition is advantageous in that the user must only grasp around one of the first and second portions C80' and C82' when using the cleaning tool C10*c*' (in contrast, the user must grasp around both the first and second portions C80 and C82 when using the cleaning tool C10*c* of FIG. 60 when the second portion C82 is placed in the folded condition).

Figure 62:
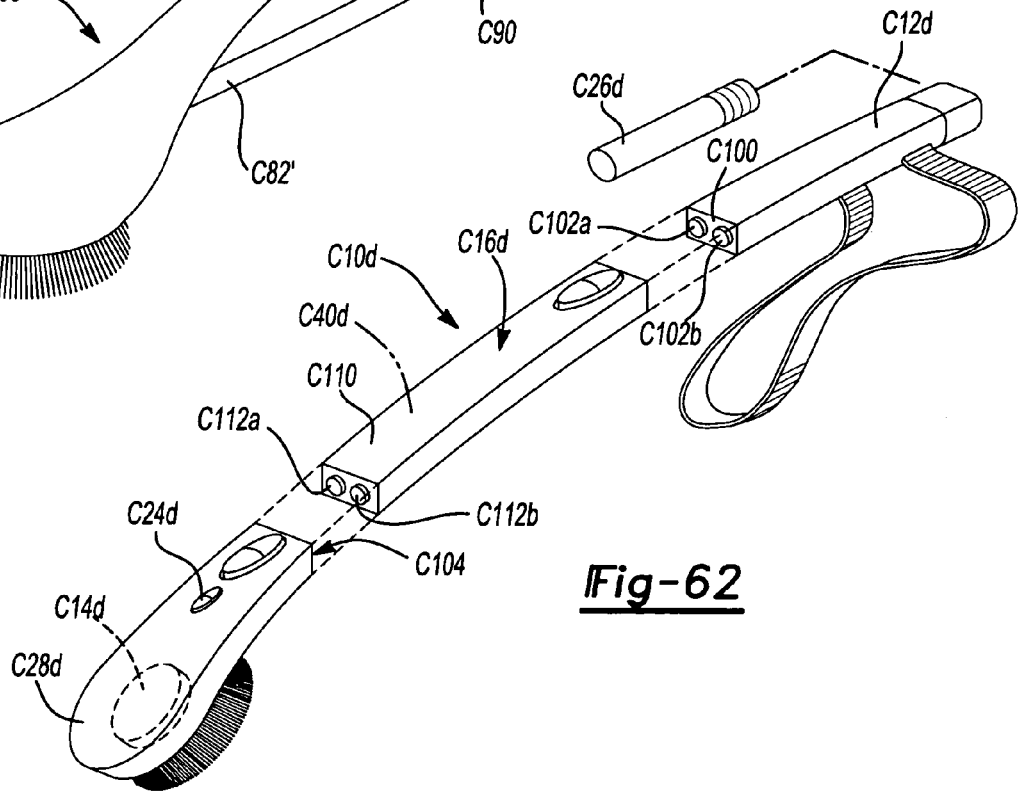
FIG. 62 is an exploded perspective view of another cleaning tool constructed in accordance with the teachings of the present invention.
Figure 63:
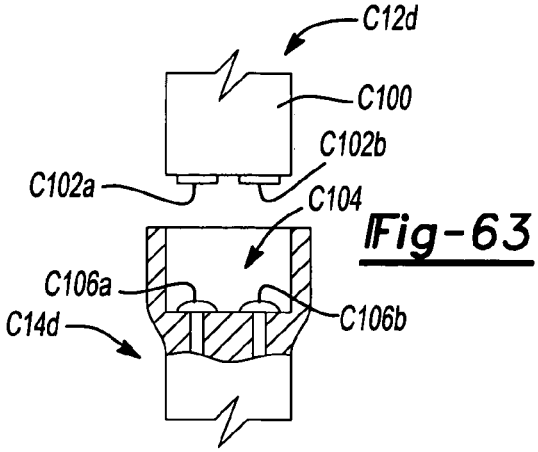
FIG. 63 is a exploded partially sectioned view of a portion of the cleaning tool of FIG. 62.
Figure 64:
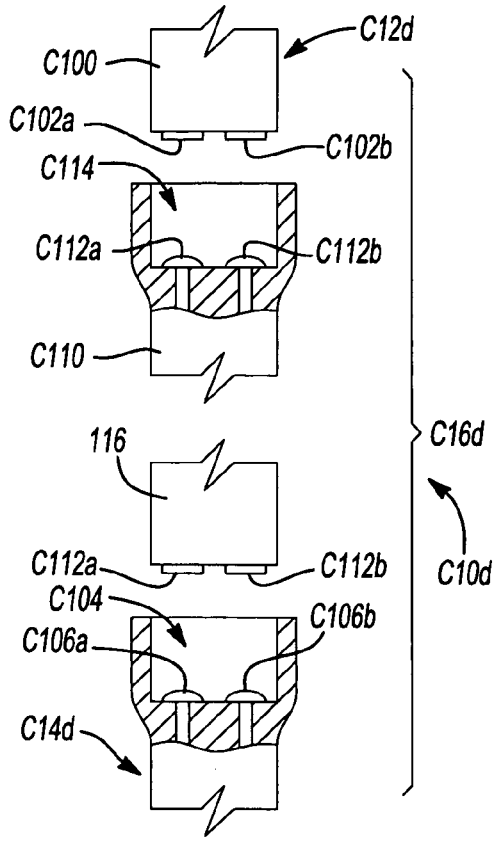
FIG. 64 is an exploded partially sectioned view of a portion of the cleaning tool of FIG. 62.

In FIGS. 62 through 64, another cleaning tool constructed in accordance with the teachings of the present invention is generally indicated by reference numeral C10*d*. The cleaning tool C10*d* is illustrated as including a handle portion C12*d*, a head portion C14*d* and an optional intermediate portion C16*d*. The handle portion C12*d* operably houses a rechargeable battery C26*d* and includes a first coupling stem C100 onto which a pair of first contacts C102*a* and C102*b* are mounted. The first contacts C102*a* and C102*b* are electrically coupled to the opposite terminals of the rechargeable battery C26*d*.

The head portion C14*d* includes a motor C28*d*, which provided rotational power for a tool head C22*d*, a power switch C24*d* for selectively operating the motor C28*d*, a first coupling recess C104, which is sized to receive the first coupling stem C100, and a pair of second contacts C106*a* and C106*b*, which are located in the coupling recess C104. The contact C106*a* is electrically coupled to the power switch C24*d* while the contact C106*b* is electrically coupled to the motor C28*d*.

The intermediate portion C16*d* is illustrated as including a housing C110 and a pair of intermediate contacts C112*a* and C112*b*. The housing C110 defines a second coupling recess C114 and a second coupling stem C116. The intermediate contacts C112*a* and C112*b* extend the length of the housing C110, terminating at their opposite end at locations in the second coupling recess C114 and on the second coupling stem C116.

An optional reservoir C40*d* is also housed in the housing C110 and may be employed to hold and selectively dispense a cleaner, rinse agent or wax in a manner that is similar to that which is described above. Alternatively, a hollow interior portion of housing C110 may define the reservoir C40*d*.

The modular configuration of the cleaning tool C10*d* permits the user to convert between a compact configuration and an extended configuration. With the compact configuration, the handle portion C12*d* is coupled directly to the head portion C14*d*. More specifically, the first coupling stem C100 is lockably but releasably inserted into the first coupling recess C104 such that the first contacts C102*a* and C102*b* are electrically coupled to the second contacts C106*a* and C106*b*, respectively, to thereby electrically couple the power switch C24*d* and the motor C28*d* to the rechargeable battery C26*d*.

With the extended configuration, the first coupling stem C100 is lockably but releasably inserted into the second coupling recess C114 such that the first contacts C102*a* and C102*b* are electrically coupled to the intermediate contacts C112*a* and C112*b*, respectively. Also, the second coupling stem C116 is lockably but releasably inserted into the first coupling recess C104 such that the second contacts C106*a* and C106*b* are electrically coupled to the intermediate contacts C112*a* and C112*b*, respectively, to thereby electrically couple the power switch C24*d* and the motor C28*d* to the rechargeable battery C26*d*.

Figure 65:
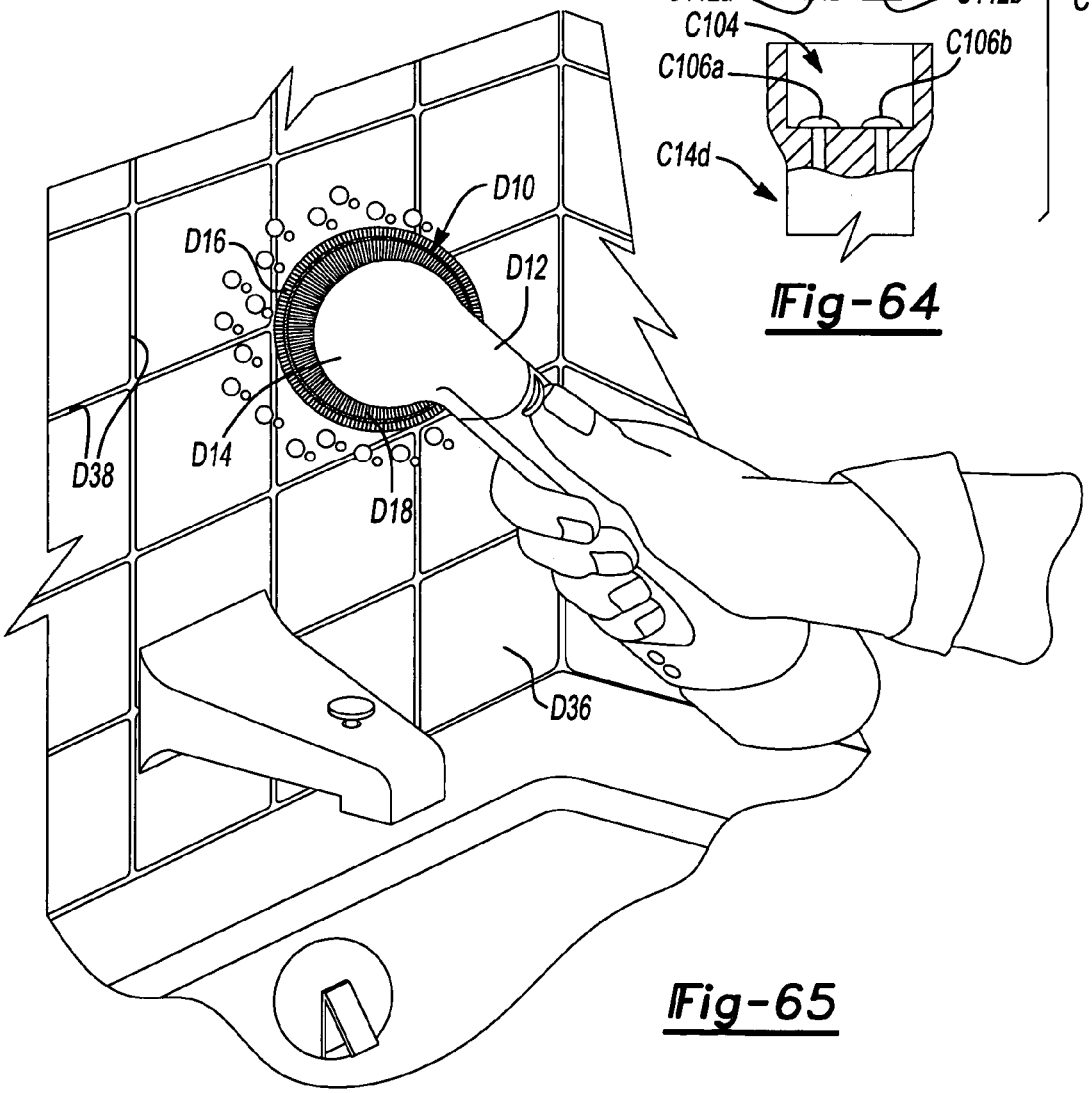
FIG. 65 is a perspective view illustrating a first tool head constructed in accordance with the teachings of the present invention in operative association with a mechanized tool and with the tool head being used to clean a large surface.
Figure 66:
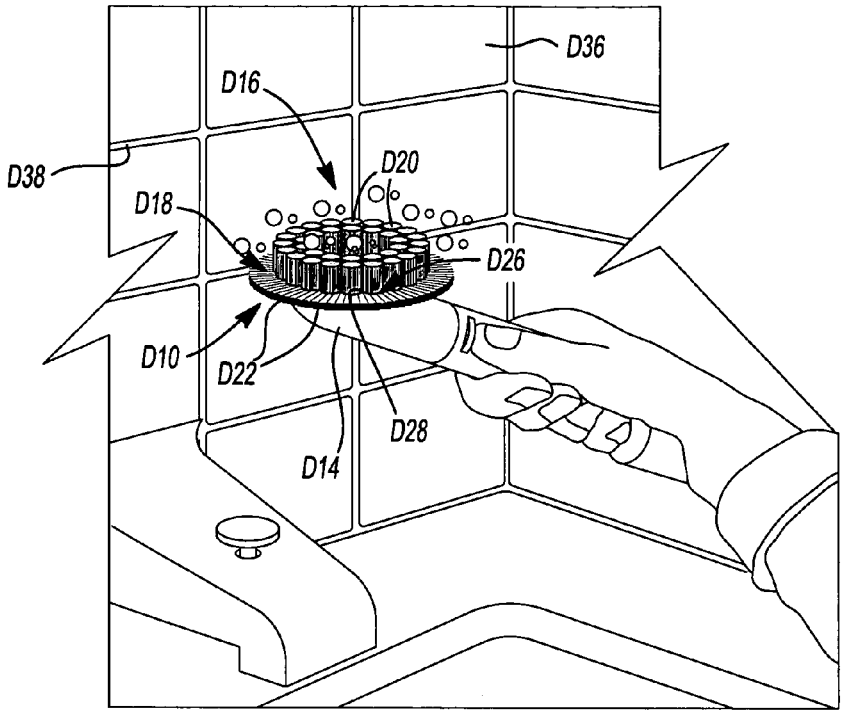
FIG. 66 is another perspective view of the tool head of FIG. 65 with the tool head being used for detail cleaning.

With reference to FIGS. 65 and 66 of the drawings, a tool attachment D10, which is constructed in accordance with the teachings of the present invention, is illustrated in operative association with a mechanized tool D12. Exemplary mechanized tools include those described and illustrated in U.S. Pat. Nos. 5,697,115; 5,718,014; 5,956,792; 5,978,999; 6,248,007; and 6,253,405, the disclosures of which are hereby incorporated by reference as if fully set forth herein. While the tool attachment D10 is illustrated as being used in a rotary manner, those skilled in the art will appreciate that the teachings of the present invention are applicable to tool attachments that are used in a reciprocating manner as well.

The tool attachment D10 includes a base portion D14, a first or large surface cleaning portion D16 and a second or detail cleaning portion D18. The base portion D14 is configured from a suitable material, such as wood or plastic, and facilitates the coupling of the tool attachment D10 to the mechanized tool D12 as well as supports both the first and second portions D16 and D18. Suitable means for coupling the base portion D14 to the mechanized tool D12 are well known in the art and need not be discussed in detail herein. Examples of several coupling means are disclosed in the above-referenced U.S. Pat. Nos. 5,697,115; 5,718,014; 5,956,792; 5,978,999; 6,248,007; and 6,253,405.

The first portion D16 includes a plurality of bristles D20 that are fixedly coupled to the base portion D14. The bristles D20 extend outwardly from the base portion D14 in a first direction. The second portion D18 similarly includes a plurality of bristles D22 that are fixedly coupled to the base portion D14, but the bristles D22 extend outwardly from the base portion D14 in a second direction that is skewed to the first direction by an amount that is greater than about 45°. In the particular example provided, the bristles D20 of the first portion D16 extend generally perpendicularly downward from a first surface or face D26 of the base portion D14, while the bristles D22 of the second portion D18 extend from a second surface or edge D28 of the base portion D14 in a manner that is generally parallel to the face D26.

In the embodiment illustrated, the quantity of the bristles D22 that extend from the edge D28 is substantially smaller than the number of bristles D20 that extend from the face D26, such that the first portion D14 is suited for cleaning relatively large surfaces, such as the flat tiles D36 of a shower enclosure, while the second portion D18 is suited for detail cleaning, such as the grout lines D38 between the flat tiles D36.

While the bristles D20 and D22 may be formed from any natural or synthetic material, the bristles D20 and D22 need not be made of identical materials, or have identical shapes, sizes or other characteristics, due to the nature of the tasks that they perform. In one embodiment, the bristles D20 are formed of a relatively soft nylon whereas the bristles D22 are formed from a relatively harder or stiffer nylon to provide the second portion D18 with scrubbing capabilities that are relatively more aggressive that that of the first portion D16. In another embodiment, the bristles D20 are formed from a material that is relatively harder or stiffer than that of the bristles D22, so that the bristles D22 perform less aggressively than the bristles D20.

Figure 67:
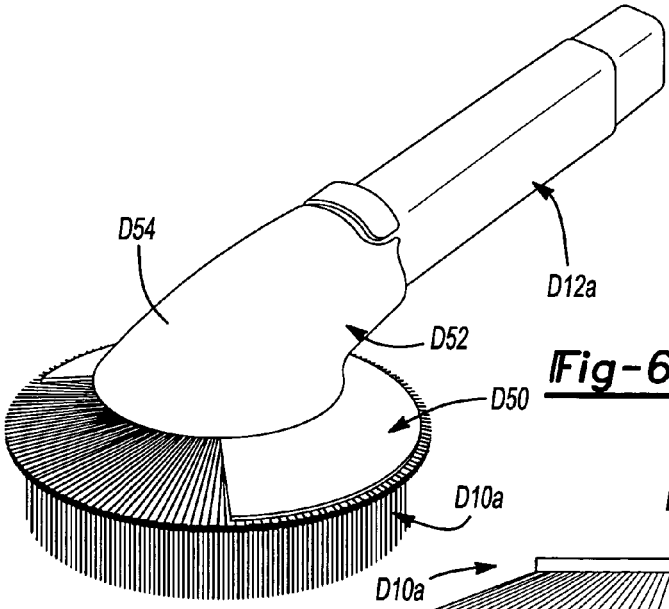
FIG. 67 is a perspective view illustrating a second tool head constructed in accordance with the teachings of the present invention in operative association with a mechanized tool.
Figure 68:
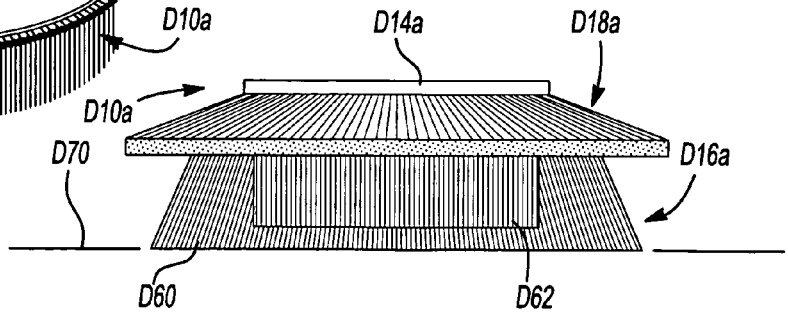
FIG. 68 is a side elevation view in partial section of the tool head of FIG. 67.
Figure 69:
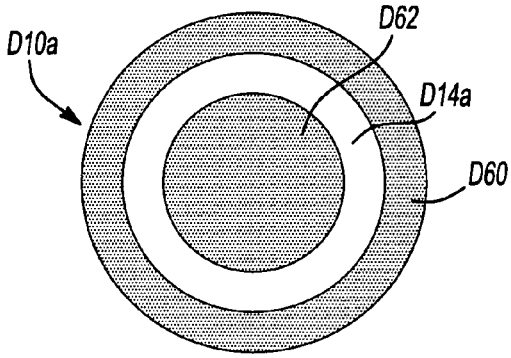
FIG. 69 is a bottom view of the tool head of FIG. 67.

In FIGS. 67 through 69, a second tool head constructed in accordance with the teachings of the present invention is generally indicated by reference numeral D10*a*. The tool head D10*a* is shown in operative association with a mechanized tool D12*a*, which is generally similar to the mechanized tool D12 of FIGS. 65 and 66 except for the inclusion of an annular shroud D50 that extends at least partially around the circumference of the head D52 of the mechanized tool D12*a*. The shroud D50 may be formed of any suitable material, such as a plastic or rubber material, and may be integrally formed with the housing D54 of the head D52 or discretely formed and coupled to the head D52 in either a permanent or removable manner. The shroud D50 forms a barrier between the tool head D10*a* and the user of the mechanized tool D12*a* that guards against the spattering or slinging of water, soap and/or cleanser off the tool head D10*a* toward the user.

While the tool head D10*a* is illustrated as being used in a rotary manner, those skilled in the art will appreciate that the teachings of the present invention are applicable to tool attachments that are used in a reciprocating manner as well. The tool head D10*a* includes a base portion D14*a*, a first portion D16*a* and a second portion D18*a*. The base portion D14*a* and the second portion D18*a* are generally similar to the base portion D14 and second portion D18, respectively, discussed above. The first portion D16*a* includes a set of first bristles D60 and a set of second bristles D62. The first bristles D60 extend from the base portion D14*a* by a first length have a first set of characteristics, such as bristle diameter, bristle shape, bristle material and bristle hardness. The second bristles D62 extend from the base portion D14*a* by a second length, which is smaller than the first length, and have a second set of characteristics that are at least partially different from the first set of characteristics so that the second set of bristles D62 provide a different scrubbing characteristic (e.g., more aggressive or abrasive than that of the first set of bristles D60). In the particular example provided, the first set of bristles D60 is relatively smaller in diameter and softer than the second set of bristles D62.

Figure 70:
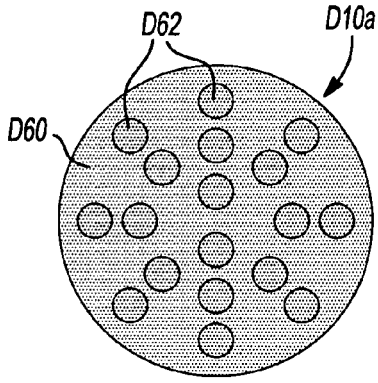
FIG. 70 is a bottom view of an alternately constructed tool head.

As best shown in FIG. 69, the second set of bristles D62 are preferably arranged in a circular pattern while the first set of bristles D60 are arranged uniformly about the perimeter of the second set of bristles D62. Those skilled in the art will appreciate, however, that the particular configuration of the first and second bristles D60 and D62 may be shaped in any desired pattern or that one of the sets of bristles may be interspersed (in a predetermined manner or randomly) throughout the other set of bristles as is illustrated in FIG. 70.

Figure 71:
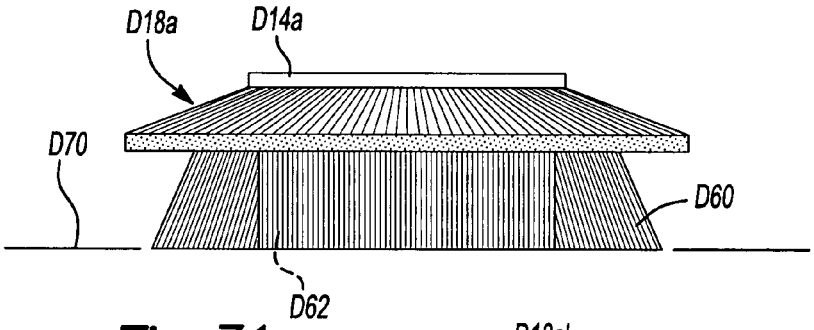
FIG. 71 is a view similar to that of FIG. 68 but illustrating the application of additional pressure to the tool head to facilitate contact between the second set of bristles and a work surface.

With reference to FIGS. 67, 68 and 71, when the user of the mechanized tool D12*a* desires to employ the characteristics of the first set of bristles D60, relatively light pressure is applied to the mechanized tool D12*a* such that only the first set of bristles D60 come into contact with the work surface D70. When the user of the mechanized tool D12*a* desires to employ the characteristics of the second set of bristles D62, increased pressure is applied to the mechanized tool D12*a* such that both the first and second sets of bristles D60 and D62 come into contact with the work surface D70. In the particular bristle arrangement provided, the first set of bristles D60 deflect radially outwardly in response to the increased pressure applied to the mechanized tool to thereby permit the second set of bristles D62 to contact the work surface D70.

Figure 72:
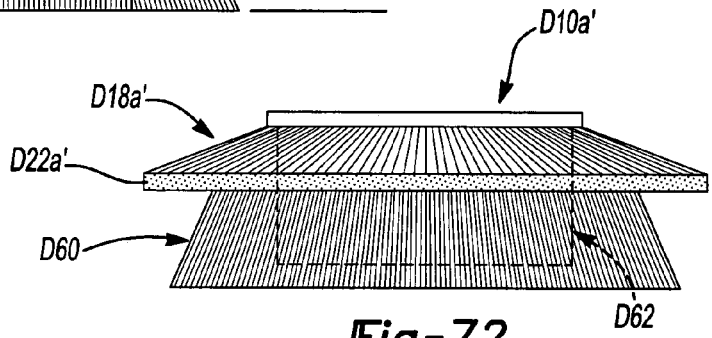
FIG. 72 is a side elevation view of an alternately constructed tool head.

An alternate form of the tool head is illustrated in FIG. 72 and generally indicated by reference numeral D10*a*'. The tool head is generally similar to the tool head D10*a*, except that a second portion D18*a*' has been substituted for the second portion D18. The second portion D18*a*' includes a plurality of bumper bristles D22*a*' that extend outwardly from the tool head D10*a*'. The bumper bristles D22*a*' may be at least partially formed from or covered with a rubber or elastomeric material such that the distal ends of the bristles D22*a*' deflect in an immediately perceivable manner when the edge of the tool head D10*a*' is brought into contact with an object so as to alert the user of the tool head D10*a*' of its proximity to the object.

Figure 73:
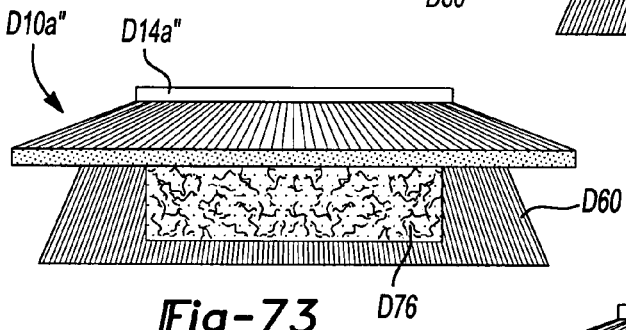
FIG. 73 is a side elevation view in partial section of a second alternately constructed tool head.
Figure 74:
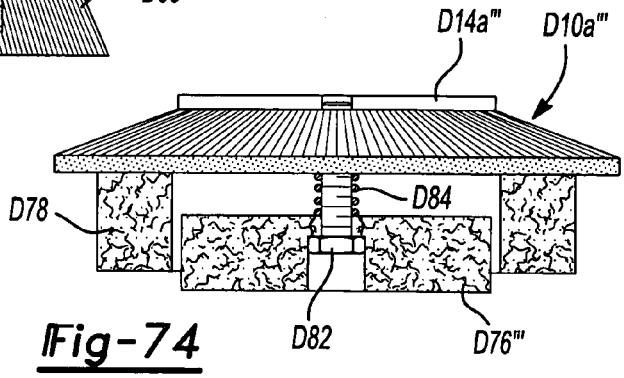
FIG. 74 is a side elevation view in partial section of a third alternately constructed tool head.

A second alternate form of the tool head is illustrated in FIGS. 73 and 74 and generally indicated by reference numeral D10*a*". The tool head D10*a*" is generally similar to the tool head D10*a* except that an abrasive pad D76, such as a SCOTCHBRITE® pad manufactured by the Minnesota Mining and Manufacturing Company, for example. In this embodiment, the abrasive pad D76 is permanently mounted to the base portion D14*a*" through an adhesive material, but those skilled in the art will appreciate that any known method for permanently or removably coupling the abrasive pad D76 to the base portion D14*a*" may be used, including fasteners, clips and/or Velcro®. The tool head D10*a*" is used in a manner that is similar to that which is described for the tool head D10*a*, above (i.e., relatively light pressure is used to employ only the first set of bristles D60, while increased pressure is used to employ the abrasive pad D76).

FIG. 74 illustrates yet another alternative form of the tool head and is generally indicated by reference numeral D10*a*'". The tool head D10*a*'" is somewhat similar to the tool head D10*a*", except that a second abrasive pad D78 has been substituted for the first set of bristles D60 and the (first) pad D76'" is movably mounted to the base portion D14*a*'" and biased away from the base portion D14*a*'". In the particular example provided, the first pad D76'" is secured to the base portion D14*a*'" via a conventional shoulder bolt D82 and biased away from the base portion D14*a*'" via a conventional compression spring D84. The first pad D76'" may be made from an abrasive material, such as a SCOTCHBRITE® pad manufactured by the Minnesota Mining and Manufacturing Company, for example, or a non-abrasive material, such as a sponge. The shoulder bolt D82 facilitates and limits movement of the first abrasive pad D76'" along the rotational axis of the tool head D10*a*'". In addition to biasing the first abrasive pad D76'" away from the base portion D14*a*'", the compression spring D84 serves to inhibit relative rotation between the base portion D14*a*'" and the first abrasive pad D76'".

The second abrasive pad D78 is an annular pad that may be permanently or removably mounted to the base portion D14*a*'" via any known method, including adhesives, fasteners, clips and/or VELCRO®. In the particular embodiment provided, the first abrasive pad D76'" has a mildly abrasive characteristic that is relatively less abrasive than that of the second abrasive pad D78. When the user of the tool head D10*a*'" desires to employ the second abrasive pad D78, sufficient pressure is applied to cause the compression spring D84 to compress so that second abrasive pad D78 may be lowered to the work surface.

Figure 75:
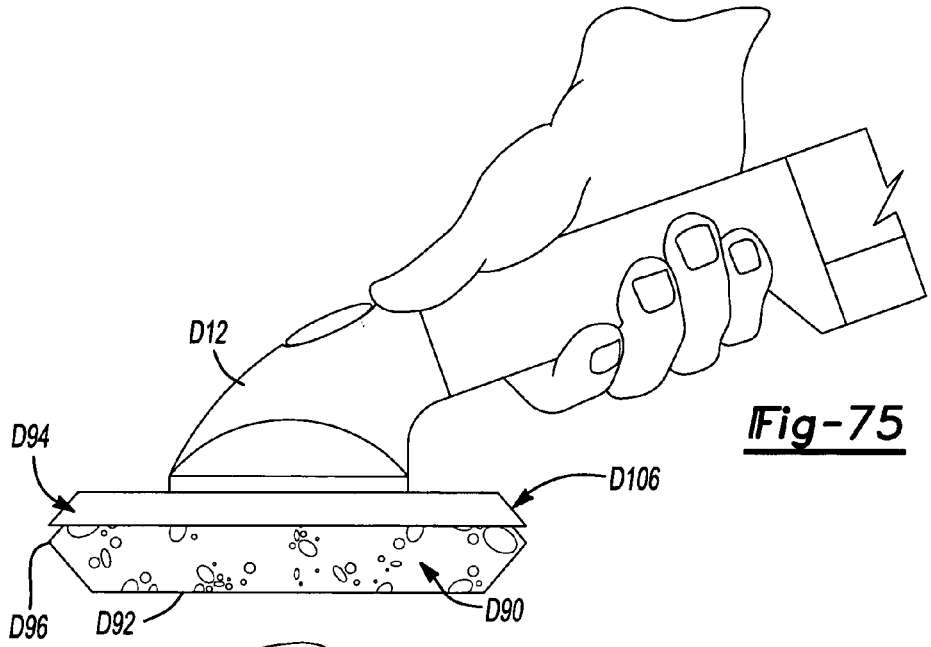
FIG. 75 is a side elevation view illustrating a third tool head constructed in accordance with the teachings of the present invention in operative association with a mechanized tool.
Figure 76:
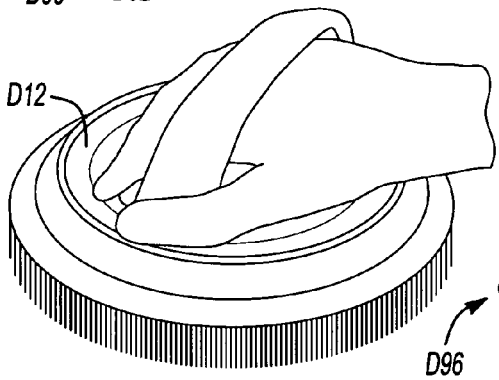
FIG. 76 is a perspective view illustrating a tool head similar to that of FIG. 75 in operative association with a mechanized tool.
Figure 77:
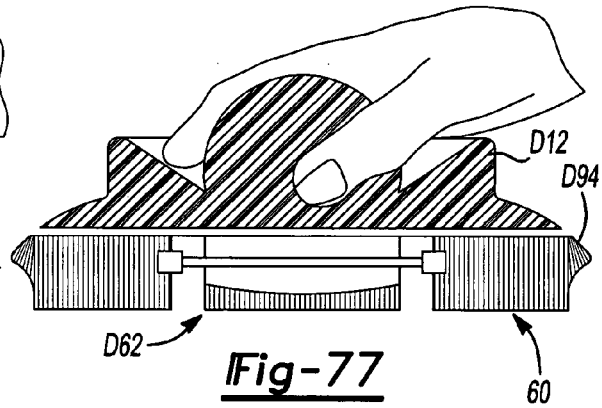
FIG. 77 is a sectional view showing the tool head of FIG. 76 in greater detail.

With reference to FIG. 75, a third tool head D10*b* constructed in accordance with the teachings of the present invention is illustrated in operative association with the mechanized tool D12. The tool head D10*b* includes a pad D90, which may be formed from an abrasive or non-abrasive material. The pad D90 is configured with a relatively large bottom surface D92, which is especially suited for use in the cleaning of relatively large surfaces, and a contoured edge D94. In the example provided, the contoured edge D94 includes a relatively sharp corner D96 that facilitates employment of the tool head D10*b* for detail cleaning tasks, such as at the intersection between two planar work surfaces or in and along grout lines. Those skilled in the art will appreciate that the tool head D10*b* may alternatively be constructed with bristles D98, as is illustrated in FIGS. 76 and 77.

Figure 78:
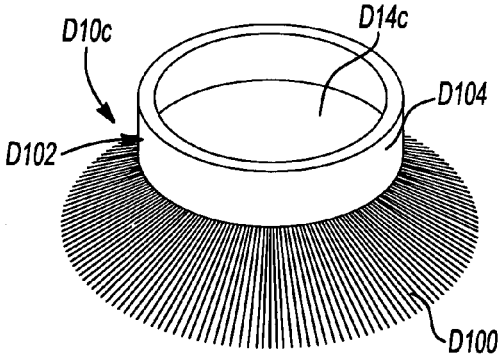
FIG. 78 is a perspective view illustrating a fourth tool head constructed in accordance with the teachings of the present invention.
Figure 79:
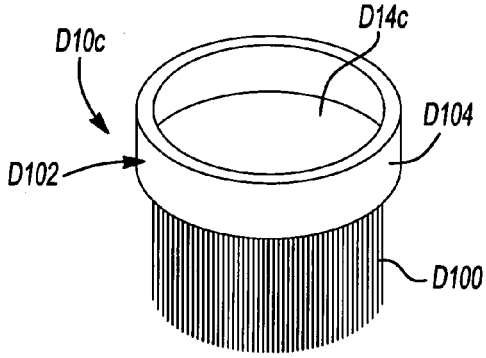
FIG. 79 is a perspective view of the tool head of FIG. 78 but illustrating the adjustment mechanism in a lowered position.

FIGS. 78 and 79, a fourth tool head D10*c* is illustrated. The tool head D10*c* includes a base portion D14*c*, a plurality of bristles D100 that are fixedly coupled to the base portion D14*c*, and an adjustment mechanism D102. The bristles D100 are coupled to the base portion D14*c* such that they extend downwardly and radially outwardly therefrom. The adjustment mechanism D102 is illustrated to be an annular ring D104 that is fitted in frictional engagement around the bristles D100. The annular ring D104 is translatable in a direction that is generally parallel to the rotational axis of the tool head D10*c* between a raised position, which is illustrated in FIG. 78, and a lowered position, which is illustrated in FIG. 79. Placement of the annular ring D104 in the lowered position constrains the bristles D100 such that they are relocated radially inward relative to their location when the annular ring D104 is in the raised position; as so positioned, the bristles D100 are better suited for detail work, whereas the bristles D100 are best suited for large surface cleaning when the annular ring D104 is placed in the raised position. Those skilled in the art will appreciate that the amount by which the bristles D100 are moved radially inward is a function of the nominal angle of the bristles D100 (i.e., the angle of the bristles D100 relative to the base D14*c* when the annular ring D104 is in the raised position), the inner diameter of the annular ring D104 and the amount by which the annular ring D104 has been translated.

Figure 80:
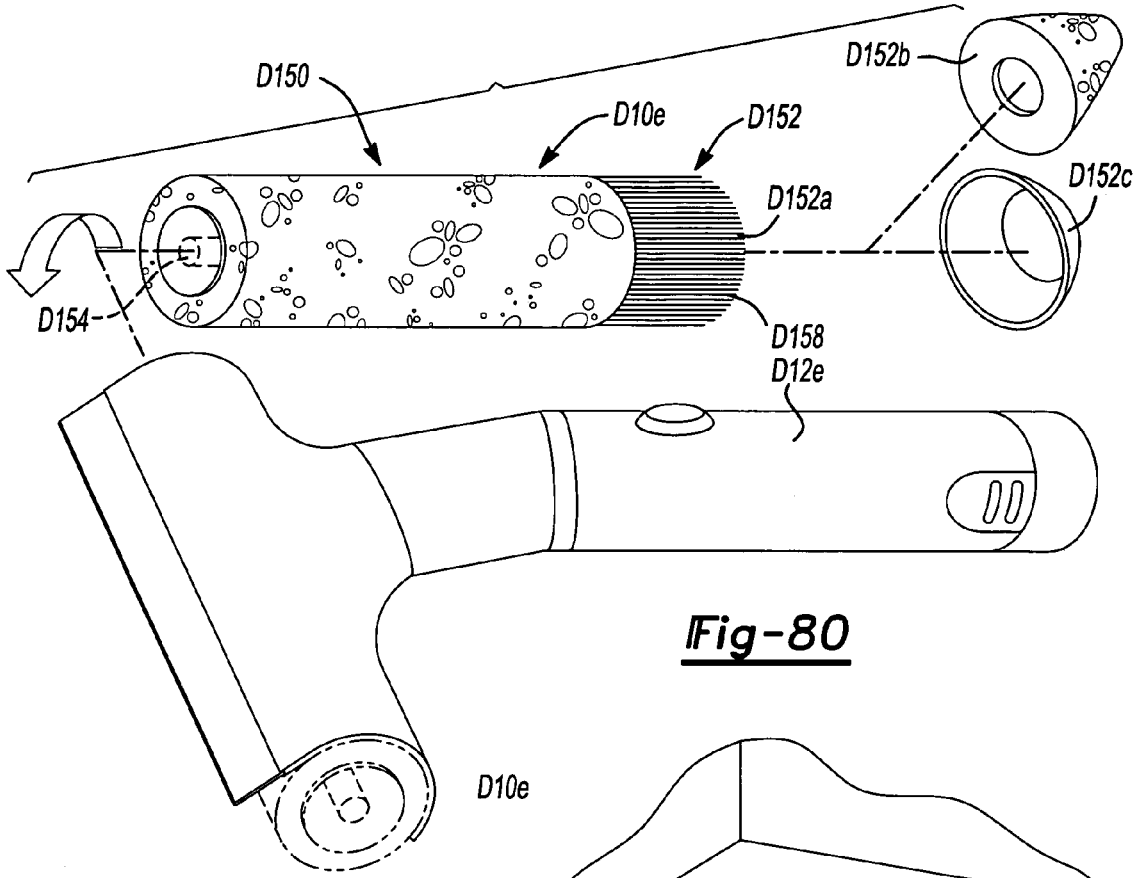
FIG. 80 is an exploded perspective view of a sixth tool head constructed in accordance with the teachings of the present invention in operative association with a mechanized tool.

In FIG. 80, a sixth tool head D10*e* is illustrated in association with a mechanized tool D12*e*. The tool head D10*e* includes a first portion D150, which is well suited to cleaning relatively large surfaces, and a second portion D152, which is configured for detail cleaning as will be described in greater detail, below. The first and second portions D150 and D152 are preferably removably mounted on a drive axle D154 that is driven by the mechanized tool D12*e* (e.g., through a suitable gear train or drive pulley mechanism) such that the first and second portions D150 and D152 are rotatable about a longitudinal axis of the tool head D10*e*.

The first portion D150 is shaped as a generally hollow cylinder, and may be formed with a plurality of bristles or from a suitable pad-type material, such as an abrasive pad or a sponge. The second portion D152 is configured from a material and/or with a shape that facilitates detail cleaning. In the example provided, the second portions D152*a*, D152*b* and D152*c* are provided in a kit so that the user of the tool head D10*e* may selectively attach a desired one to the mechanized tool D12*e*.

The second portion D152*a* is illustrated to be an annular ring of fairly coarse bristles D158 having relatively more aggressive cleaning characteristics than that of the first portion D150. The bristles D158 of the second portion D152*a* are relatively shorter than the bristles of the first portion D150 so that the second portion D152*a* is ordinarily not in contact with the work surface; increased pressure or tilting of the mechanized tool D12*e* is required to bring the bristles D158 into contact with the work surface. Alternatively, the second portion D152*a* may be formed from an abrasive or sponge-like pad material. The second portion D152*b* is formed of a desired material, which may or may not be identical to that of the first portion D150, and is shaped in a conical manner that permits the tool head D10*e* to access corners and crevices. The second portion D152*c* is formed from a suitable material that permits the user of the tool head D10*e* to perform a buffing or polishing operation. Although the second portion D152*c* is illustrated as being hollow and frustoconical in shape, those skilled in the art will appreciate that the second portion D152*c* may formed to any desired shape.

Figure 81:
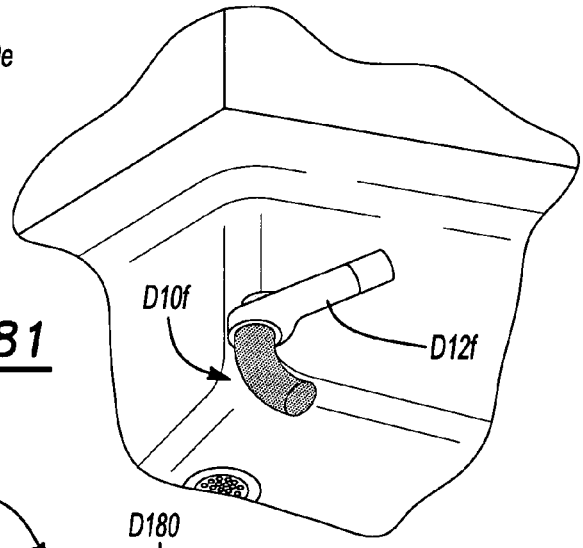
FIG. 81 is a perspective view of a seventh tool head constructed in accordance with the teachings of the present invention in operative association with a mechanized tool.
Figure 82:
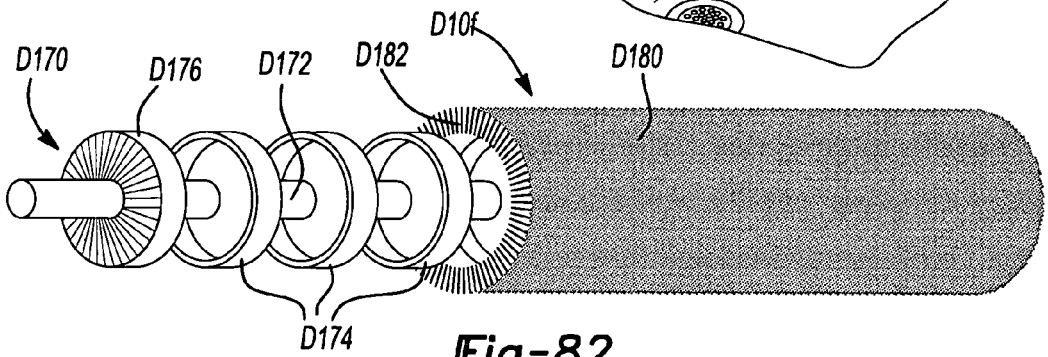
FIG. 82 is an exploded perspective view of a portion of the mechanized tool of FIG. 81.

In FIGS. 81 and 82, a seventh tool head D10*f* constructed in accordance with the teachings of the present invention is illustrated in operative association with a mechanized tool D12*f*. The mechanized tool D12*f* includes a drive mechanism D170 that includes flexible spine D172, a plurality of brush mounts D174 that are fixedly coupled to the spine D172 and a gear D176, such as a face gear, that is fixedly coupled to the spine and configured to receive a rotary input to facilitate rotation of the spine D172.

The tool head D10*f* is a hollow cylinder that is preferably closed on one end in a spherical radius. In the embodiment provided, the tool head D10*f* includes a plurality of bristles D180 that extend outwardly from a flexible base portion D182, but as those skilled in the art will appreciate, any flexible pad-like material (e.g., a sponge or an abrasive pad) may be used in the alternative. In use, the tool head D10*f* is ordinarily biased by the spine D172 into a straight or in-line configuration. As best seen in FIG. 82, however, the flexible nature of the spine D172 permits the tool head D10*f* to be resiliently deformed so as to access corners and crevices.

Figure 83:
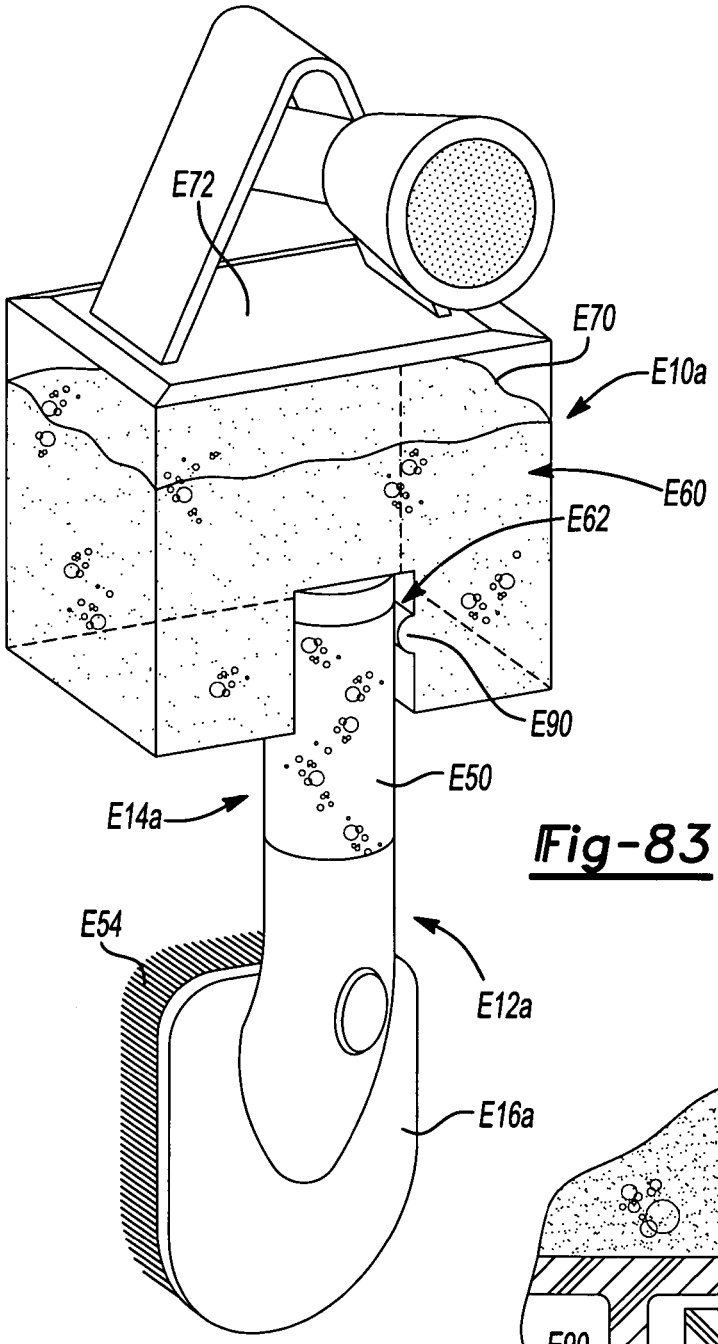
FIG. 83 is a perspective view of a caddy constructed in accordance with the teachings of the present invention in operative association with a cleaning tool.

In FIG. 83, a caddy E10*a* constructed in accordance with the teachings of the present invention is illustrated in operative association with a second hand-held motorized cleaning tool E12*a*. The cleaning tool E12*a* includes a handle E14*a* that is mounted to a cleaning head E16*a*. The handle E14*a* includes a fluid reservoir E50 from which a fluid (e.g., cleaner, rinse agent, wax, polish) may be selectively dispensed, either through a nozzle (not shown) or through the rotating or reciprocating tool head E54 that is attached to the cleaning head E16*a*.

Figure 84:
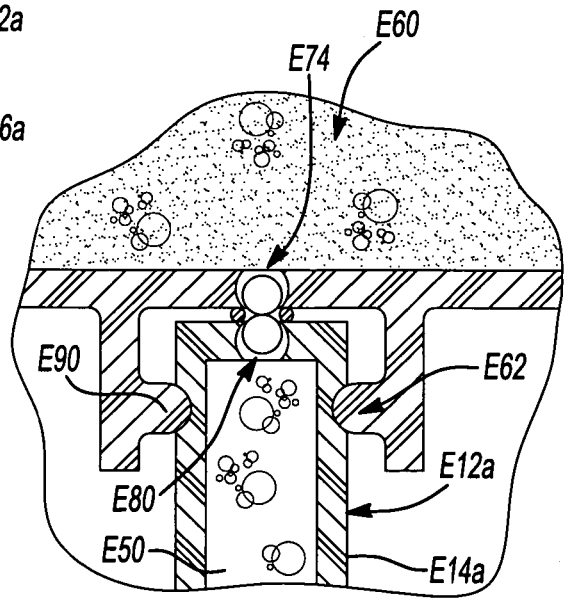
FIG. 84 is a partial sectional view of the caddy and cleaning tool illustrated in FIG. 83.

The caddy E10*a* includes a reservoir portion E60 and a coupling portion E62. With additional reference to FIG. 84, the reservoir portion E60 includes a reservoir E70, for containing a desired fluid, such as a cleaner, rinse agent, wax or polish, a reservoir lid E72 for covering the reservoir E70, and a valve E74 that is in fluid connection with the reservoir E70. The valve E74 is a normally closed valve of the type that is well known in the art.

The coupling portion E62 is configured to align a corresponding valve E80 on the fluid reservoir E50 of the cleaning tool E12*a* to the valve E74. More specifically, alignment of the valve E80 to the valve E74 effects the opening of both valves E74 and E80 to permit fluid to drain from the reservoir E70 in the caddy E10*a* to the fluid reservoir E50 in the cleaning tool E10*a*. In this manner, the fluid reservoir E50 may be re-charged when ever the cleaning tool E10*a* is replaced to the caddy E10*a*. In the particular embodiment provided, the coupling portion E62 includes a pair of laterally spaced apart guide rails E90 that cooperate with a mating geometric form on the handle E14*a* to center the handle E14*a* relative to the valve E74 as well as to position the valve E80 in a vertical direction relative to the valve E74. A blind wall (not shown) is employed to limit the amount by which the handle E14*a* may be pushed into the coupling portion E62; placement of the handle E14*a* at the blind wall while it is engaged to the guide rails E90 aligns the valve E80 to the valve E74. In the particular embodiment provided, the caddy E10*a* is supported via a strap E92. Those skilled in the art will appreciate, however, that any other known means for retaining the caddy E10*a* to an appropriate (generally vertical) surface may alternatively be employed.

Figure 85:
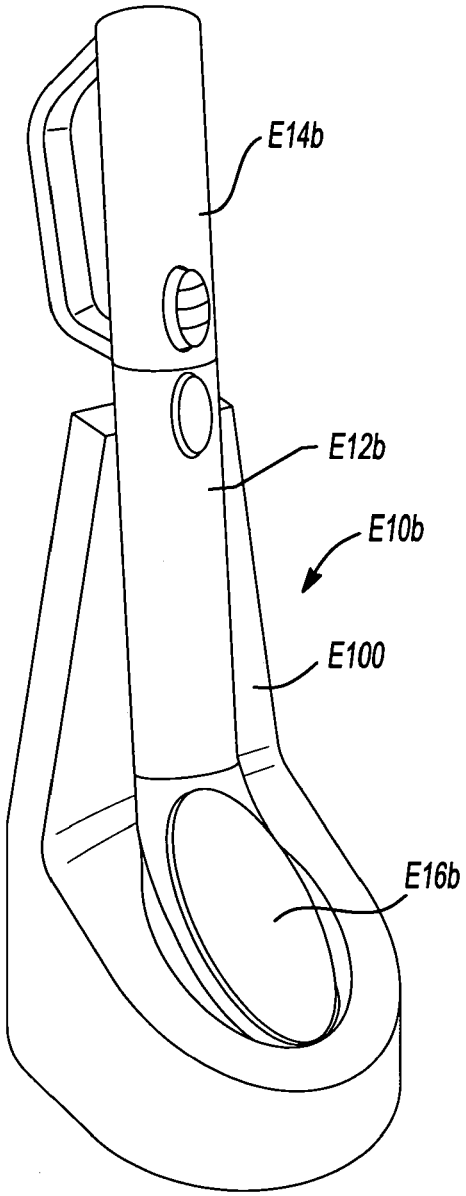
FIG. 85 is a perspective view of a second caddy constructed in accordance with the teachings of the present invention in operative association with a cleaning tool.
Figure 86:
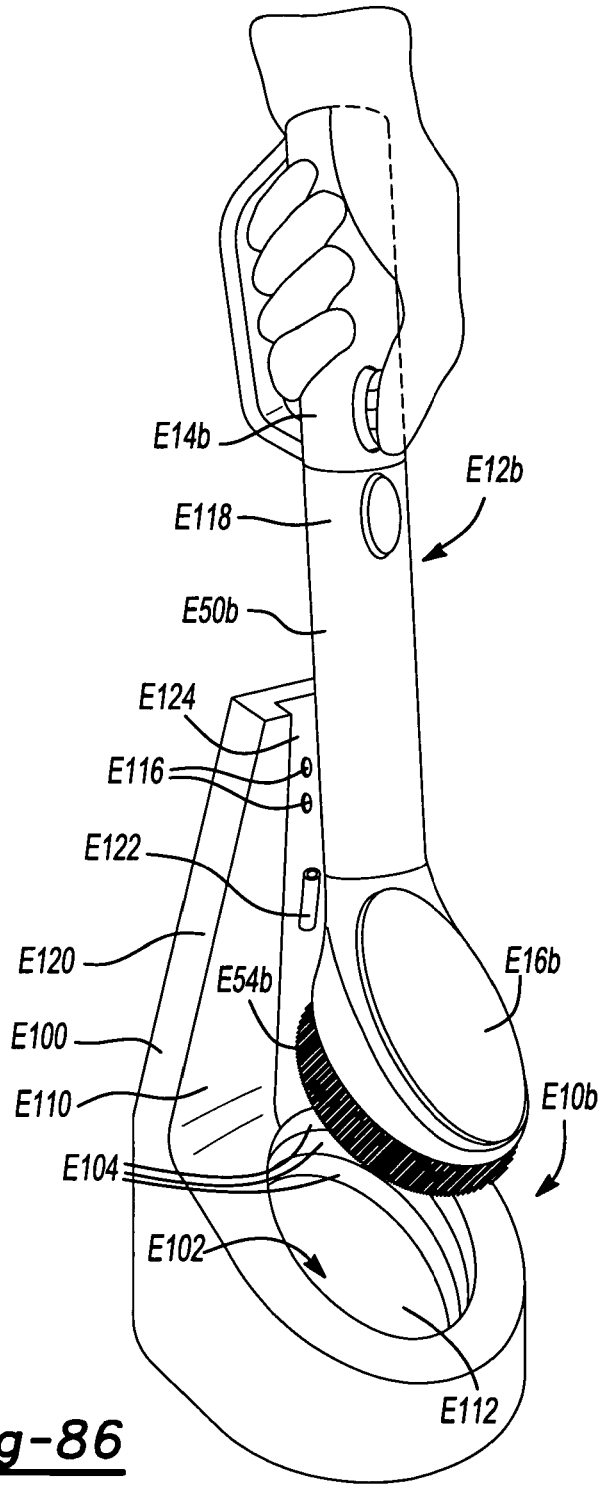
FIG. 86 is a perspective view of a caddy of FIG. 85 with the cleaning tool docked thereto.

In FIGS. 85 and 86, a second caddy E10*b* constructed in accordance with the teachings of the present invention is illustrated in conjunction with a motorized hand-held cleaning tool E12*b*. The cleaning tool E12*b* includes a handle E14*b* that is mounted to a cleaning head E16*b*. The handle E14*b* includes a fluid reservoir E50*b* from which a fluid (e.g., cleaner, rinse agent, wax, polish) may be selectively dispensed, either through a nozzle (not shown) or through the rotating or reciprocating tool head E54*b* that is attached to the cleaning head E16*b*.

The caddy E10*b* includes a housing E100 that defines an aperture E102 for receiving the tool head E54*b*. One or more seals E104 extend around the perimeter of the aperture E102 and are located vertically such that they sealingly engage the tool head E54*b* or the cleaning head E16*b* to thereby prevent the emission of undesirable odors from the caddy E10*b*.

Additionally or alternatively, the caddy E10*b* may include a charger base E110 and/or a sanitizing system E112. The charger base E110 is of the type that whose construction and operation are well known in the art and as such, a detailed discussion of the charger base E110 need not be provided herein. Briefly, the charger base E110 includes a plurality of electrical contacts E116 that engage mating contacts (not shown) on the cleaning tool E12*b* when the cleaning tool E12*b* is docked to the caddy E10*b* to thereby facilitate the recharging of the battery E118 in the cleaning tool E12*b*. The sanitizing system E112 may be of a type that is known in the art and may utilize chemicals, ultraviolet light and/or ultrasound to effect the sanitizing of the tool head E54*b*.

Also additionally or alternatively, the caddy E10*b* may be employed to replenish the reservoir E50*b* in the cleaning tool E12*b*. In this regard, the caddy E10*b* includes a caddy reservoir E120 and a nozzle E122 that is in fluid connection with the caddy reservoir E120 and is employed to inject or dispense fluid into a valve (not shown) in the fluid reservoir E50*b*. The caddy reservoir E120 and nozzle E122 may be a discrete and disposable unit that is removably coupled to the housing E100. In such an embodiment, the caddy reservoir E120 may be charged with a dispensing fluid that causes the fluid contained therein to be dispensed through the nozzle E122 when the nozzle E122 is coupled to the valve in the fluid reservoir E50*b*. Alternatively, the caddy reservoir E120 may simply employ gravity to dispense the fluid contained therein through the nozzle E122. A pair of guide rails E124 (only one of which is shown) or other alignment means may be employed to better control the alignment of the cleaning tool E12*b* to the caddy E10*b*.

Also alternatively, the caddy reservoir E120 may be defined by the housing E100 and manually refillable. In such an embodiment, gravity may be used to dispense the fluid contained in the caddy reservoir E120 or the action of inserting the cleaning tool E12*b* to the caddy E10*b* may be employed to generate fluid pressure within the caddy reservoir E120 that is employed to inject the fluid through the nozzle E122 and the valve in the reservoir E50*b*.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A hand-held motorized household cleaning apparatus comprising:

a housing;

a battery located in the housing;

a motor located in the housing and connected to the battery;

an output drive shaft powered by the motor;

a cleaning attachment coupled for rotational movement with the output drive shaft and having an axis of rotation; and a liquid delivery system operable independently from the motor and having a reservoir, a valve, a valve actuator, a nozzle coupled to the housing, and at least one fluid conduit, the reservoir being coupled to the housing and operable for storing a pressurized fluid therein, the valve being at least partially housed in the housing and operable for selectively permitting fluid communication between the reservoir and the nozzle in response to movement of the valve actuator and dispensing fluid from the liquid delivery system, the nozzle being operable for directing the dispensed fluid obliquely relative to the axis of rotation of the cleaning attachment and having at least one aperture being operable for dispersing the fluid dispensed from the liquid delivery system; and wherein the reservoir has a variable internal volume.

2. The hand-held motorized household cleaning apparatus of claim 1, wherein the reservoir includes a reservoir housing and a piston that is slidably received into the reservoir housing.

3. The hand-held motorized household cleaning apparatus of claim 2, wherein the reservoir further includes a spring for biasing the piston into the reservoir housing.

4. The hand-held motorized household cleaning apparatus of claim 2, wherein the reservoir further includes a cylinder sleeve that is removably coupled to the reservoir housing.

5. A hand-held motorized household cleaning apparatus comprising:

a housing;

a battery located in the housing;

a motor located in the housing and connected to the battery;

an output drive shaft powered by the motor;

a cleaning attachment coupled for rotational movement with the output drive shaft and having an axis of rotation; and a liquid delivery system operable independently from the motor and having a reservoir, a valve, a nozzle coupled to the housing, and at least one fluid conduit, the reservoir being coupled to the housing and operable for storing a pressurized fluid therein, the valve being at least partially housed in the housing and operable for selectively permitting fluid communication between the reservoir and the nozzle and dispensing fluid from the liquid delivery system, the nozzle being operable for directing the dispensed fluid obliquely relative to the axis of rotation of the cleaning attachment and having at least one aperture being operable for dispersing the fluid dispensed from the liquid delivery system;

wherein the housing includes a handle and wherein the reservoir extends from the housing generally parallel to the handle.

6. The hand-held motorized household cleaning apparatus of claim 5, wherein the fluid conduit includes a first portion, which fluidly couples the reservoir and the valve, and a second portion, which fluidly couples the valve and the nozzle, the valve including a valve element that is interposed between the first and second portions of the fluid conduit, the valve element being selectively positionable in a first position, which inhibits fluid communication between the first and second portions of the fluid conduit, and a second position, which permits fluid communication between the first and second portions.

7. The hand-held motorized household cleaning apparatus of claim 5, wherein the handle and reservoir are generally perpendicular to a rotational axis of the motor.

8. The hand-held motorized household cleaning apparatus of claim 5, wherein the battery is received by the handle.

9. The hand-held motorized household cleaning apparatus of claim 5, wherein a switch is mounted to the handle and electrically coupled to the battery and the motor the switch being operable for selectively activating the motor, the switch including a switch actuator that is adapted to be employed by an operator to selectively activate the switch, the switch actuator extending from a first side of the handle, the valve including a valve actuator that is adapted to be employed by an operator to selectively actuating the valve to permit fluid communication between the reservoir and the nozzle, the valve actuator being disposed on a side of the handle opposite the switch actuator.

10. The hand-held motorized household cleaning apparatus of claim 9, wherein the switch actuator is disposed between the handle and the reservoir.

11. The hand-held motorized household cleaning apparatus of claim 9, further comprising an extension handle that is removably coupled to the housing.

12. The hand-held motorized household cleaning apparatus of claim 11, wherein the removable handle includes a handle actuator, the handle actuator permitting remote actuation of one of the switch actuator and the valve actuator when the extension handle is coupled to the housing.

13. The hand-held motorized household cleaning apparatus of claim 5, wherein the housing includes a pair of housing shells and a cap, the housing shells cooperating to define the handle, the battery being received in the handle, the cap closing an end of the handle.

14. The hand-held motorized household cleaning apparatus of claim 13, wherein a pair of electrical contacts are coupled to the cap, the electrical contacts being electrically coupled to the battery and being adapted to be electrically coupled to a source of electrical power to recharge the battery.

15. The hand-held motorized household cleaning apparatus of claim 5, wherein the valve includes a valve body and a valve element that is disposed in the valve body, the valve element being biased into a position that inhibits fluid communication through the valve body.

16. The hand-held motorized household cleaning apparatus of claim 5, wherein the nozzle is forwardly disposed on the housing relative to the cleaning attachment and the handle.

17. A hand-held motorized household cleaning apparatus comprising:

a housing having a body portion and a handle portion;

a battery located in the handle portion of the housing;

a switch that is mounted in the handle portion, the switch being electrically coupled to the battery;

a motor located in the body portion of the housing, the motor having a rotational axis that is disposed generally perpendicular to the handle portion, the motor being electrically coupled to the switch and the battery;

an output drive shaft driven by the motor;

a cleaning attachment removably coupled to the output drive shaft for movement therewith; and a liquid delivery system having a reservoir, a nozzle, a valve and at least one fluid conduit, the reservoir extending generally parallel to the handle portion of the housing and including a reservoir housing, a piston, a spring and a cylinder sleeve, the reservoir housing being coupled to the body portion of the housing, the piston being received in the reservoir housing and cooperating with the reservoir housing to define a variable volume fluid container, the cylinder sleeve being coupled to the reservoir housing, the spring biasing the piston away from the cylinder sleeve, the valve coupled to the housing and operable for selectively permitting fluid communication through the at least one fluid conduit between the variable volume fluid container and the nozzle.

18. A hand-held motorized household cleaning apparatus comprising:

a housing;

a first handle extending from the housing;

a second handle removably coupled to the housing and extending obliquely relative the first handle;

a battery received by the housing;

a motor located in the housing and connected to the battery;

an output drive shaft powered by the motor;

a cleaning attachment coupled for movement with the output drive shaft; and a liquid delivery system having a reservoir, a valve, a nozzle, and at least one fluid conduit, the reservoir coupled to the housing and extending from the housing generally parallel to the first handle, the reservoir being operable for storing a pressurized fluid therein, the valve being at least partially housed in the housing and selectively operable to permit fluid communication between the reservoir and the nozzle and dispense fluid from the liquid delivery system, the nozzle being coupled to the housing and operable for dispersing the fluid as the fluid is dispensed from the liquid delivery system.

19. The hand-held motorized household cleaning apparatus of claim 17, wherein the valve includes a valve actuator at least partially housed in the first handle and the second handle includes a handle actuator communicating with the valve actuator for selectively actuating the valve actuator to permit fluid communication between the reservoir and the nozzle.

20. The hand-held motorized household cleaning apparatus of claim 19, wherein the reservoir is spaced apart from the first handle along an axis defined by the motor.

21. A hand-held motorized household cleaning apparatus comprising:

a housing;

a battery located in the housing;

a motor located in the housing and connected to the battery;

an output drive shaft powered by the motor;

a cleaning attachment coupled for rotational movement with the output drive shaft and having an axis of rotation; and a liquid delivery system operable independently from the motor and having a reservoir, a valve, a valve actuator, a nozzle coupled to the housing, and at least one fluid conduit, the reservoir being coupled to the housing and operable for storing a pressurized fluid therein, the valve being at least partially housed in the housing and operable for selectively permitting fluid communication between the reservoir and the nozzle in response to movement of the valve actuator and dispensing fluid from the liquid delivery system, the nozzle being operable for directing the dispensed fluid obliquely relative to the axis of rotation of the cleaning attachment and having at least one aperture being operable for dispersing the fluid dispensed from the liquid delivery system;

wherein the reservoir includes a reservoir housing and a piston that is slidably received into the reservoir housing;

wherein the reservoir further includes a spring for biasing the piston into the reservoir housing; and wherein the reservoir further includes a cylinder sleeve that is removably coupled to the reservoir housing.

* * * * *

UNITED STATES PATENT AND TRADEMARK OFFICE

CERTIFICATE OF CORRECTION

PATENT NO. : 7,363,673 B2
APPLICATION NO. : 10/778016
DATED : April 29, 2008
INVENTOR(S) : Todd Alan Schonewille et al.

It is certified that error appears in the above-identified patent and that said Letters Patent is hereby corrected as shown below:

Title Page,
Item (60), Related U.S. Application Data, line 2, "60/477,240" should be --60/447,240--.

Title Page,
Item (56), References Cited, OTHER PUBLICATIONS, lines 1 and 2,
"www.oami.eu.int/bulletin/2004/2004/_012/000089008_0003.htm" should be
--www.oami.eu.int/bulletin/rcd/2004/2004/_012/000089008_0003.htm--.

Column 31,
Line 35, "claim 17" should be --claim 18--.

Signed and Sealed this
Thirteenth Day of September, 2011

David J. Kappos

David J. Kappos
*Director of the United States Patent and Trademark Office*